US005139128A

United States Patent [19]

Carmen et al.

[11] Patent Number: 5,139,128

[45] Date of Patent: Aug. 18, 1992

[54] CHUTE FOR CONTROLLING THE MOTION OF A TOKEN MOVING BY GRAVITY THROUGH A TOKEN-RECEIVING DEVICE

[75] Inventors: Ralph H. Carmen, Lebanon, N.J.; John W. Van Horn, Harrison, Ark.

[73] Assignee: Ducan Industries Parking Control Corp., Harrison, Ark.

[21] Appl. No.: 500,029

[22] Filed: Mar. 27, 1990

[51] Int. Cl.[5] ..... G07F 1/04

[52] U.S. Cl. ..... 194/343; 194/344

[58] Field of Search ..... 194/344, 346, 347, 348, 194/349, 342, 343

[56] References Cited

U.S. PATENT DOCUMENTS

| | | | |
|---|---|---|---|
| 2,611,468 | 9/1952 | Rockola | 194/342 |
| 2,656,908 | 10/1953 | Ellison | 194/279 |
| 3,166,732 | 1/1965 | Ljungman et al. | 194/353 |
| 3,373,856 | 3/1968 | Kusters et al. | 194/318 |
| 3,952,850 | 4/1976 | Andersson et al. | 194/218 |
| 4,249,648 | 2/1981 | Meyer | 194/212 |
| 4,326,621 | 4/1982 | Davies | 194/319 |
| 4,334,604 | 6/1982 | Davies | 194/319 |
| 4,356,903 | 11/1982 | Lemelson et al. | 194/217 |
| 4,410,077 | 10/1983 | Okolischan | 194/344 |
| 4,460,080 | 7/1984 | Howard | 194/317 |
| 4,483,431 | 11/1984 | Pratt | 194/317 |
| 4,823,928 | 4/1989 | Speas | 194/217 |
| 4,848,556 | 7/1989 | Shah | 194/212 |

FOREIGN PATENT DOCUMENTS

| | | | |
|---|---|---|---|
| 367011 | 2/1932 | United Kingdom | 194/344 |
| 8100778 | 3/1981 | World Int. Prop. O. . | |

*Primary Examiner*—F. J. Bartuska

*Attorney, Agent, or Firm*—Jones, Day, Reavis & Pogue

[57] ABSTRACT

A token receiving chute for use in a token operated device is disclosed. The chute is designed so that a token inserted therein will fall toward an appropriate location due to the force of gravity. In order to decrease the kinetic energy imparted to the falling token, and thereby increase the accuracy of various coin sensing devices to be subsequently employed, an inclined wall section is provided for imparting lateral momentum to the falling token causing it to bounce back and forth between the side walls.

7 Claims, 25 Drawing Sheets 44
43
46
52
49
47
50
45
48
M
37,39
22
20
54,55
56
18
84
54,66
70
76
26
28
86
72
54
59
62
18
64
W
82
80

MATSNS
(TO FIG.30)
(FROM FIG.30)
V SENSOR
UGN 3503
UBN 3505
LM 258
HSCH 1001
PO CD 4043 BC
2N4403
VBIAS
GND
39
41
42
56

230
DISPLAY CONTROLLER AND DISPLAY
271
VOLTAGE REGULATION AND SWITCHING
269
H-BRIDGE CIRCUIT
270
DATA INTERFACE
268
MICRO COMPUTER U4
32.768 KHz
~400 KHz
276
274
100
102
104
ANALOG-TO-DIGITAL CONVERTER
U2
COIN IDENTIFICATION AND TIME MEMORY
U3
MASS SENSOR 64
AREA SENSOR 60
VBATT
VC
VBIAS
VMEM
MATSNS
TURN A
TURN B
RTN A
RTN B
160
161
(TO FIGS. 29A, 29B)
(TO AND FROM FIG. 25)

CHUTE FOR CONTROLLING THE MOTION OF A TOKEN MOVING BY GRAVITY THROUGH A TOKEN-RECEIVING DEVICE

INCORPORATION BY REFERENCE FROM EARLIER PATENT

The machines described herein use certain components described in U.S. Pat. No. 4,848,556 to Shah, Pester, and Stern, issued Jul. 18, 1989 (the "Shah, Pester, and Stern patent"), which is hereby incorporated herein by reference.

INCORPORATION BY REFERENCE FROM CO-PENDING PATENT APPLICATIONS

This disclosure (the "instant application") uses certain components described more fully in (a) the United States Patent Application of John W. Van Horn and Ralph H. Carmen for a COIN OPERATED TIMING MECHANISM, filed Jul. 24, 1989, U.S. application Ser. No. 07/384,781 (the "'781 application") and/or in (b) the United States Patent Application of Ralph H. Carmen and James Michael Rodgers for an ULTRA-LOW-POWER AMPLIFIER FOR A COMMUNICATIONS RECEIVER WITH LIMITED ACCESS TO POWER, filed Mar. 2, 1990, U.S. application Ser. No. 07/487,630 (the "Ultra-Low-Power Amplifier application"). The disclosures of the '781 application and of the Ultra-Low-Power Amplifier application are hereby incorporated herein by reference. The '781 application has been assigned to Duncan Industries Parking Control Systems Corp., a Delaware corporation ("Duncan"). Duncan is the equitable owner of the Ultra-Low-Power Amplifier application and the instant application, and the Ultra-Low-Power Amplifier application and the instant application will also be assigned to Duncan.

BACKGROUND OF THE INVENTION

A tremendous variety of token-actuated devices are known and have proved commercially successful, including (but not limited to) parking meters which control individual parking spaces, vending machines, newspaper racks, electronic games, and jukeboxes. Many token-actuated devices respond to the insertion of a token which is legal tender (that is, a coin). Other token-actuated devices respond to a token which is not itself legal tender and which is ordinarily specifically designed for use in a particular type of token-actuated device. (As used herein the term "token" includes both a token which is legal tender in some nation—that is, a coin—and a specially-designed token which is not legal tender.)

Many early token-actuated devices were wholly mechanical. Examples of such devices are early parking meters, such as those disclosed in U.S. Pat. No. 1,799,056 to Miller and U.S. Pat. No. 2,603,288 to Sollenberger.

Although mechanical token-actuated devices remain useful, mechanical devices have disadvantages in comparison with electronic devices. Mechanical devices generally have many more moving parts than electronic devices; those moving parts tend to need repair or replacement more frequently than electronic parts. Replacing mechanical parts ordinarily requires much more labor than replacing electronic parts.

Electronic devices have other advantages in comparison with mechanical devices. For example, electronic devices can economically provide a wide variety of special functions which would be prohibitively expensive to implement in a wholly mechanical device.

Thus, those working in the field of token-actuated devices have sought to develop token-actuated devices which incorporate electronic components. See, for example, U.S. Pat. No. 3,757,916 to Selby; U.S. Pat. No. 4,031,991 to Malott; U.S. Pat. No. 4,792,032 to Shapiro; U.S. Pat. No. 4,848,556 to Shah, Pester, and Stern; and U.S. Pat. No. 4,823,928 to Speas.

One problem which has impeded the use of electronic components in token-actuated devices is inadequate repeatability in the operation of electronic token validation systems. Many token-actuated devices incorporate token validation systems to indicate whether an inserted token is valid or invalid. For example, parking meters should distinguish between a valid coin (such as a United States quarter in parking meters located in the United States) and an invalid coin (such as a Canadian quarter for parking meters located in the United States) or an invalid token (such as a worthless slug). Mechanical parking meters incorporate a variety of mechanical token validation systems for performing such tests. Those mechanical token validation systems have proved adequate in the sense that they yield the same result—that is, they accept or reject the same token—in a consistently repeatable and reproducible manner as long as their mechanical parts have not become worn. However, mechanical token validation systems are severely limited in the types of tests of token characteristics which they can perform.

Replacing the mechanical token validation systems with electronic token validation systems is desirable for the reasons noted above; in particular, electronic token validation systems can perform a much wider variety of tests of token characteristics than mechanical token validation systems. However, conventional electronic token validation systems produce results which are not sufficiently repeatable (the conventional electronic validation systems often do not yield the same acceptance or rejection result for the same token) and/or not sufficiently reproducible (the conventional electronic validation systems do not yield the same acceptance or rejection result for different tokens of the same type)—even though the electronic validation system is not worn and in fact is operating as satisfactorily as it is able to operate. Although those working in the art continue to devote considerable attention to improving the electronic token characteristic sensors which are used in electronic token validation systems, the problems of inadequate repeatability and inadequate reproducibility continue to impede progress toward wider use of electronic token-actuated devices.

Thus, there has been and is a need for improving the repeatability and the reproducibility of the token validation results which electronic token validation systems generate.

Another problem which has impeded the wider use of electronic token-actuated devices is the difficulty of designing electronic token validation systems to detect certain types of special-purpose tokens.

As noted above, many electronic token validation systems are designed to validate tokens which are not coins. Coins ordinarily are made of metal and have a metal content which is uniform with increasing radius from the axis of the coin disk. Some types of token actuated devices—for example, the turnstiles of some subway systems or the fareboxes of some mass transit systems—require a payment amount which is either greater than the value of a simple grouping of common coins or which is not convenient to provide for in coin acceptance devices. As an example, a subway fare may be 90 cents—an amount which could be reached by numerous combinations of numerous coins of the same or different denominations. For such fares it may be more efficient to accept a single, special-purpose token rather than various combinations of numerous coins of the same or different denominations.

Such special-purpose tokens are often made of metal disks which do not have a uniform metallic content with increasing radius from the axis of the token disk. One common token of this type—the present-day New York City subway token—has one type of metal in approximately the first one-third of the radius extending from the axis of the token disk and another type of metal in the remainder of the token disk. Electronic token validation systems designed to validate coins often do not work well in validating such special-purpose tokens. In particular, conventional token characteristic sensors (for example, frequency-shift sensors) use the change in inductance or change in capacitance of some type of circuit as a metal token passes through a token-actuated device to produce a signal indicative of the token characteristics. Such conventional sensors are difficult to use with a token such as a New York City subway token. If two such conventional token characteristic sensors are mounted close together to permit sensing the different metals in the disk of the New York City subway token, the magnetic and/or electric fields of each sensor may interfere with the other sensor. This makes accurate detection of the characteristics of an inserted token very difficult. Thus, there has been and is a need to improve the design of electronic token validation systems so that those systems can be used effectively to validate such special-purpose tokens.

Another problem which has impeded the wider use of electronic token-actuated devices is the amount of current which an electronic token-actuated device draws in its operation. Many types of token-actuated devices— particularly parking meters and newspaper vending machines—are ordinarily used in places where the devices cannot be conveniently connected to electric power lines. Thus, those types of token-actuated devices must usually rely on batteries for electric power. (U.S. Pat. No. 4,823,928 to Speas also discloses the use of solar cells.) Because a battery can only supply a limited amount of current before the battery must be recharged and/or replaced, a battery-powered token-actuated device should draw as little current as possible.

The requirement for low current consumption has limited the ability of battery-powered token-actuated devices—such as parking meters—to perform certain desirable functions. Thus, there has been and is a need to develop improved designs so that electronic token-actuated devices can perform desired functions with low current consumption.

One desirable function in a token-actuated device is for the token-actuated device to return a token which the token-actuated device has not accepted as a valid token. A token-actuated device frequently rejects a token which is in fact a valid token but which has become worn or which for some other reason does not satisfy the acceptance criteria which the token-actuated device employs. Such tokens should be returned to the user rather than simply kept by the token-actuated device. Users become annoyed when a token-actuated device keeps but does not respond to a valid (even if worn, and especially if not worn) token inserted in the device. Even if the rejected token is in fact an invalid token (for example, a worthless slug inserted in a token-actuated device which responds to a quarter), holding the invalid token in a token receptacle wastes space which could be occupied by valid tokens and requires an eventual sorting step to separate the valid tokens from the invalid tokens.

Unfortunately, many conventional ways of returning tokens which are not accepted by the token-actuated device draw more power than is acceptable in a free-standing, battery-powered, token-actuated device such as a parking meter or a newspaper vending rack. Thus, there has been and is a need for a token return system which draws less current.

SUMMARY OF THE INVENTION

The improvements described herein meet the foregoing technical objectives by providing an improved token chute for controlling the motion of the token as it travels by gravity within the token-actuated device, an improved magnetic field sensor to be located close to the improved token chute, and an improved token accepting or rejecting system for directing tokens either to a token storage receptacle or to a token return opening.

A chute for controlling the motion of a token in a token-actuated device has four walls, one of which defines an opening for receiving tokens. A token which passes through the opening falls by gravity and strikes a sloping portion of one of the walls. The lower edge of the falling token strikes the sloping wall portion as the token falls, causing the token to tilt to one side as it continues to fall and/or slide downward. While continuing to fall and/or slide downward the token strikes a recessed portion of a wall opposite the sloping portion and begins vibrating rapidly from side to side as the token falls. The falling token then strikes an inclined token track base and continues rapidly vibrating from side to side. A portion of the translational kinetic energy which the token acquired in falling is transferred to this vibrational motion, and the center of mass of the token is believed to remain relatively stationary during that vibrational motion before the token begins to roll by gravity down the inclined token track base. The impact of the token with the sloping wall portion and with the recessed portion of the opposite wall, and the resulting vibrational motion of the token, control the motion of the token and greatly reduce the tendency of the token to bounce as the token travels down the inclined token track base. This improved token chute design greatly improves the repeatability and the reproducibility of the signals produced by token characteristic sensors mounted near the token track base as the token moves by gravity past those sensors.

From the location where the token first strikes the inclined token track base the incline of the token track base then encourages the token to roll downward past token characteristic sensors. In one embodiment the token rolls past a magnetic field sensor and past an area sensor. A programmed microprocessor uses the signals from those sensors to determine whether to accept the token as valid or not. In another embodiment the token also is evaluated by a mass sensor. In that other embodiment the programmed microprocessor uses the signals from the magnetic field sensor, the area sensor, and the mass sensor to determine whether to accept a token as valid or not.

DESCRIPTION OF THE DRAWINGS

FIG. 5 shows some of the components mounted inside the parking meter in a state in which those components permit a token to fall into a token vault.

FIG. 6 shows some of the components mounted inside the parking meter in a state in which those components lead a token to be returned from the parking meter.

FIG. 8A shows the section of this part also shown in FIG. 5. FIG. 8B shows the section of this part also shown (in part) in FIG. 6.

FIG. 15A is a side view of the token insertion slot lever and the wake-up switch actuation lever shown in FIGS. 5 and 6. FIG. 15B is a top view of these items together with the wake-up switch.

FIG. 16A shows these items in a position to which they are raised while a token is being inserted through the token insertion slot. FIG. 16B shows these items in the position they occupy when they are not raised.

DETAILED DESCRIPTION OF THE INVENTION

A Parking Meter

Figure 1:
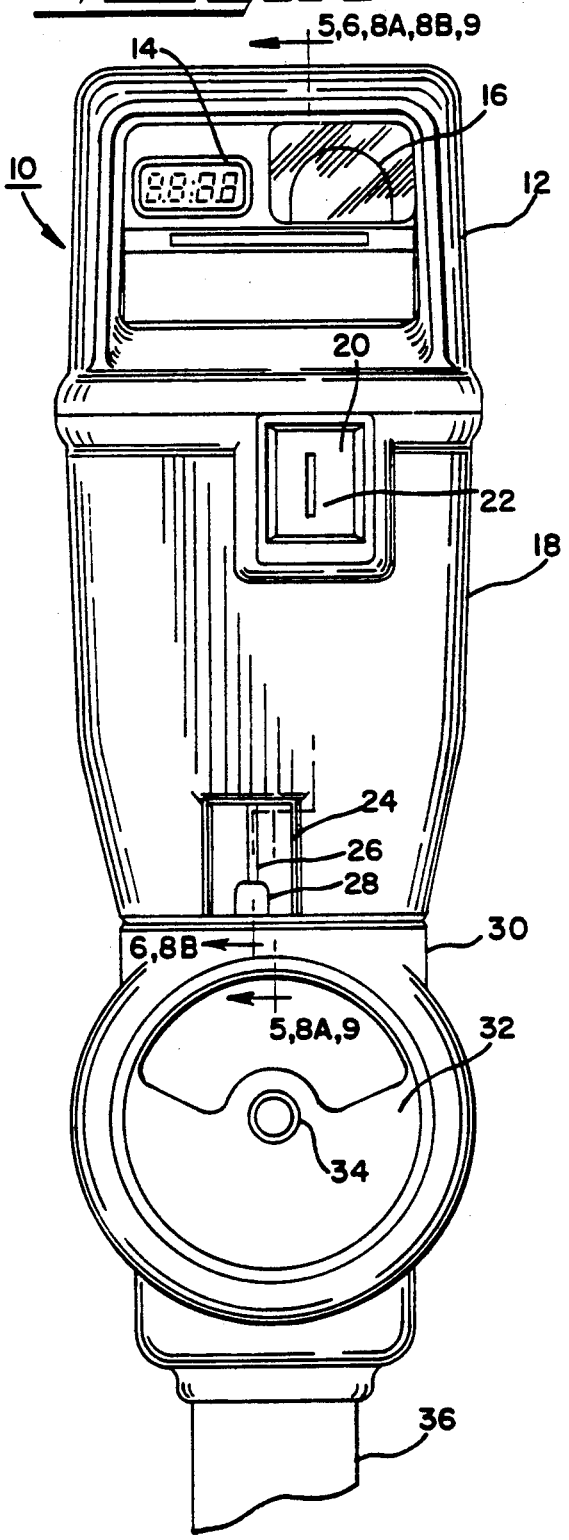
FIG. 1 is a front view of the exterior of a parking meter equipped with an embodiment of the inventions described herein.
Figure 2:
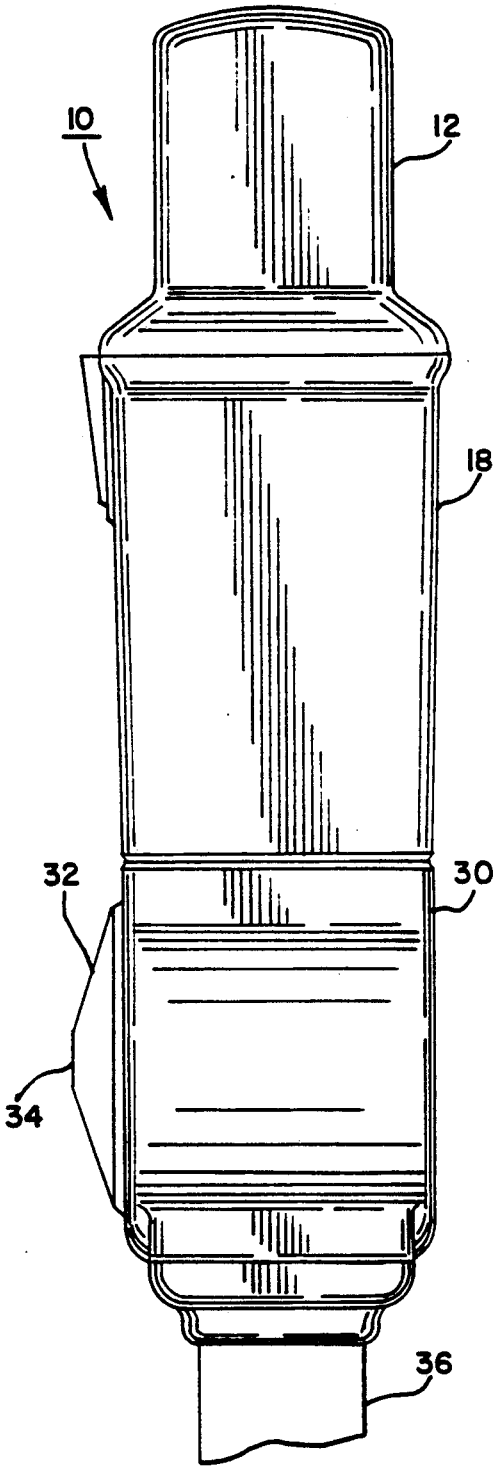
FIG. 2 is a side view of the exterior of the parking meter depicted in FIG. 1.

FIG. 1 is a front view of the exterior of a parking meter 10 equipped with an embodiment of the invention. FIG. 2 is a side view of the exterior of the parking meter 10 shown in FIG. 1.

As shown in FIGS. 1 and 2, the parking meter 10 has a display section 12 which provides protection for a time display 14 and a flag display 16. The time display 14 and the flag display 16 are mounted in a mechanism housed within the display section 12. The display section 12 is mounted on a body section 18. The body section 18 is equipped with a token insertion plate 20 defining a token insertion slot 22 and a token return plate 24 defining a token return slot 26. The token return plate 24 also has a token return stop 28 to prevent a returned token from rolling away from the parking meter 10.

The token insertion slot 22 is sized to pass a token (described below and shown in FIGS. 3A, 3B, 4A, and 4B) of predetermined maximum size. By preventing the insertion of a token which has either a thickness or a diameter greater than the width and height, respectively, of the token insertion slot 22, the token insertion slot 22 preliminarily prevents the insertion of certain invalid tokens and also prevents the insertion of tokens which might become stuck, or become frictionally or magnetically held, in the interior of the parking meter 10. The token return slot 26 is sized large enough to allow any token which has passed through the token insertion slot 22 to pass out easily.

The body section 18 is in turn mounted on a token vault section 30, which has a token vault plate 32 secured by a lock (not shown). The lock of the token vault plate 32 opens in response to a key (also not shown) which may be inserted in token vault plate key opening 34. The token vault section 30 is in turn mounted on a pole 36, which itself is mounted on a surface (not shown) near a parking space (not shown) for which the parking meter 10 is to measure the parking time.

Because the display section 12, the body section 18, and the token vault section 30 of the parking meter 10 are separately formed, a body section 18 incorporating the invention may be formed so as to mount a display section 12 of an older meter (such as a parking meter sold by Duncan Industries Parking Control Systems of Harrison, Ark., under the registered trademark EPM) and/or to fit on a token vault section 30 of an older meter (such as a parking meter sold by Duncan Industries Parking Control Systems Corp. as a Duncan Model 70 Single parking meter). This interchangeability of the sections of the parking meter 10 is economical because it permits an older parking meter to be upgraded in part by adding a new body section 18 for use with an older display section 12 and/or an older token vault section 30.

The display section 12 and the body section 18 depicted in FIGS. 1 and 2 provide mechanical support for various components described below and help in protecting those components against the elements, damage, tampering, and vandalism.

The Tokens

Not all tokens have a circular shape when viewed from the disk side. As used herein, the term "token" includes not only those tokens which have a circular shape when viewed from the disk side but also those tokens which, although not having a circular shape when viewed from the disk side, will travel through the parking meter 10 without becoming stuck or coming to rest in the token track described below.

Figure 3A:
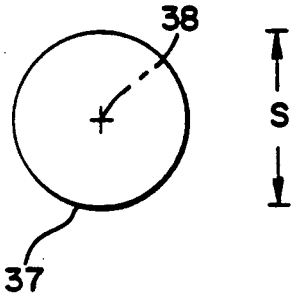
FIG. 3A is a disk side view of a token having uniform composition with increasing radius from the disk axis of the token.
Figure 3B:
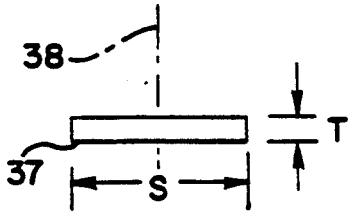
FIG. 3B is an edge view of the token shown in FIG. 3A.
Figure 4A:
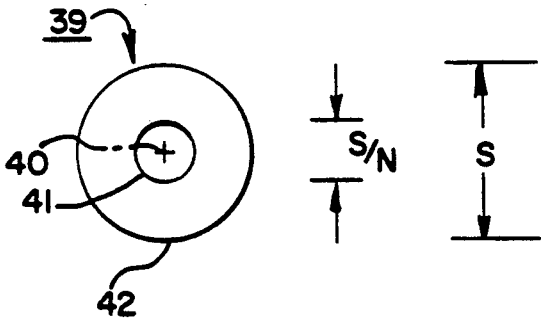
FIG. 4A is a disk side view of a token having two concentric, coaxial regions with different composition.
Figure 4B:
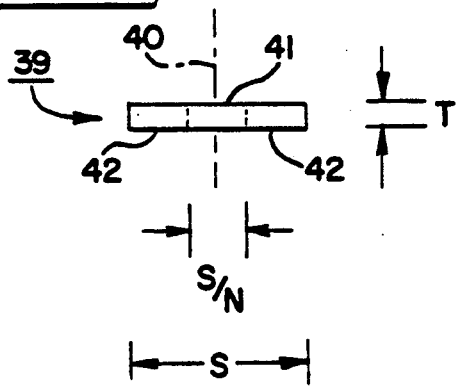
FIG. 4B is an edge view of the token shown in FIG. 4A.

The parking meter 10 recognizes a valid token of two different types. FIGS. 3A and 3B show one type of token; FIGS. 4A and 4B show a different type of token.

FIG. 3A is a disk side view of one type of token 37; FIG. 3B is an edge view of the token 37 shown in FIG. 3A. The token 37 may be a coin; that is, the token 37 may be legal tender in some nation.

As shown in FIG. 3A the token 37 has the shape of a disk with diameter S. The token 37 has a uniform composition with increasing radius from the disk axis 38 of the token 37. Typically coins such as the token 37 are made of metal.

As shown in FIG. 3B the token 37 has a thickness T. Many tokens (such as United States dimes and quarters manufactured in recent years) are made of layers of different metals arranged as a sandwich to form the thickness T of the token. Even with that sandwich layer construction the metal composition of such a token is substantially uniform with increasing radius from the axis of the disk.

FIG. 4A is a disk side view of another type of token 39; FIG. 4B is an edge view of the token 39 shown in FIG. 4A.

As shown in FIG. 4A the token 39 has the shape of a disk with diameter S. The token 39 does not have a uniform composition with increasing distance from the axis 40 of the token disk. Instead, an inner portion 41 of the token 39 is made of one material and occupies the portion of the token 39 extending from the disk axis 40 of the token 39 a distance S/2N radially toward the edge of the token 39. The diameter of the inner portion 41 is thus S/N. The parameter N need not be an integer.

The token 39 also has an outer portion 42 which may be made of a different material than the material from which the inner portion 41 is made. The outer portion 42 extends from the outer edge of the inner portion 41 radially outward from the disk axis 40 of the disk 39. The outer portion 42 thus forms an annulus around the inner portion 41.

An example of a token 39 as depicted in FIGS. 4A and 4B is a New York City subway token as manufactured in recent years, which has an overall diameter S of approximately 0.870 inch and a diameter of its inner portion 41 of approximately 0.315 inch. For is New York City subway token N is approximately 2.76, or roughly 3 (three). The way in which the parking meter 10 evaluates such a token is discussed below in connection with FIGS. 20 through 27.

The inner portion 41 and the outer portion 42 may be made of different metals, particularly metals with different magnetic characteristics. For example, the inner portion 41 may be made of a substance (such as a ferrous metal) which is strongly attracted by a magnetic field, while the outer portion 42 may be made of a substance (such as copper) which is much less strongly attracted by a magnetic field than the metal from which the inner portion 41 is made.

Alternatively, both the inner portion 41 and the outer portion 42 could be made of a substance which is strongly attracted by a magnetic field, or both the inner portion 41 and the outer portion 42 could be made of a substance which is not attracted by a magnetic field.

As shown in FIG. 4B the token 39 has a thickness T. Those skilled in the art will recognize that such special-purpose tokens may be made in many forms and that the diameter S and thickness T of a special-purpose token such as the token 39 shown in FIGS. 4A and 4B may be chosen in any desired relationship to the diameter and thickness of any coin.

In the following discussion it is to be understood that the parking meter 10 receives and evaluates a variety of different types of tokens and that the diameter S and thickness T will ordinarily each be different for each different type of token. The token insertion slot 22 is sized to pass any type of token which has a diameter S and a thickness T less than or equal to the height and width of the token insertion slot 22. Preferably the token insertion slot 22 has clearances of approximately 0.002 inch larger than the largest thickness T and largest diameter S of tokens which are to be accepted as valid.

The Path Of A Token Through The Parking Meter 10

The following discussion describes in general terms the path which the token 37 or 39 follows in traveling through the parking meter 10. A more detailed description of particular components of the parking meter 10 follows this general discussion.

In ordinary usage the term "vertical" means "parallel to the acceleration due to gravity", that is, parallel to the direction in which a stationary object would fall if it were dropped (hereinafter "true vertical"). In ordinary usage the term "horizontal" means "perpendicular to the vertical" as the term "vertical" is ordinarily used (hereinafter "true horizontal"). A parking meter such as the parking meter 10 should ordinarily be mounted in substantially a true vertical position. Often, however, a parking meter has been bumped by a vehicle, causing the parking meter to be at an angle to true vertical.

As used herein the term "vertical" means not only true vertical but also a direction which is not true vertical but which, if the parking meter 10 were tilted in such direction, would still allow a token to travel through the parking meter 10 without becoming frictionally or magnetically stuck. As used herein the term "horizontal" means "perpendicular to the vertical as the term 'vertical' has just been defined as used embodiment of the token chute described herein." An embodiment of the token chute described herein operates satisfactorily (at least with substantially circular tokens) when the parking meter 10 is mounted at an angle of as much as 15 (fifteen) degrees to true vertical (but not more than 10 (ten) degrees angle toward the front of the parking meter). Preferably, however, the parking meter 10 (and the alternative parking meter 89 discussed below) are mounted at an angle of not more than 5 (five) degrees to true vertical.

Figure 5:
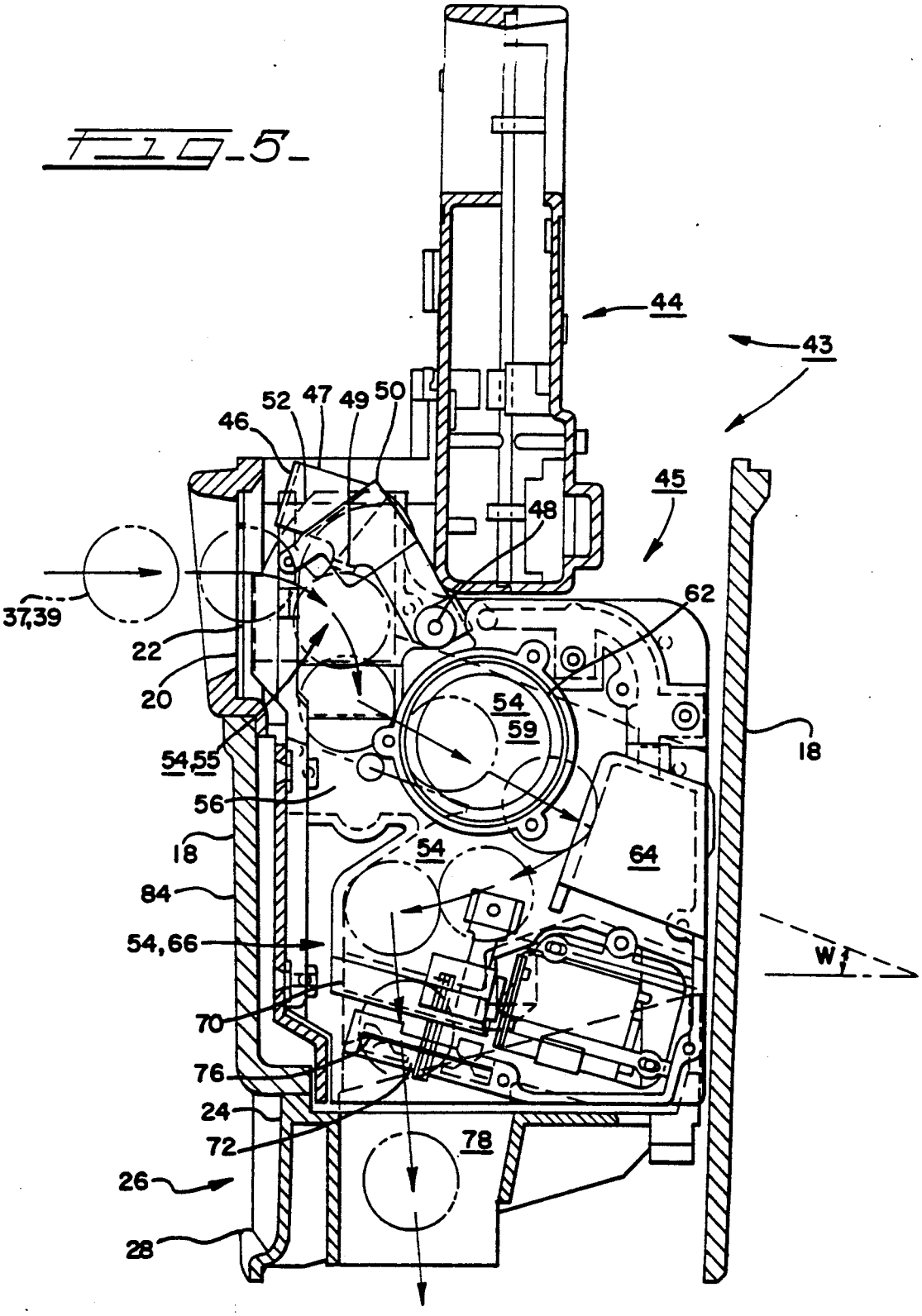
FIG. 5 is a sectional view, taken along the line 5—5 of FIG. 1, of the parking meter shown in FIG. 1, with many parts omitted for clarity.
Figure 6:
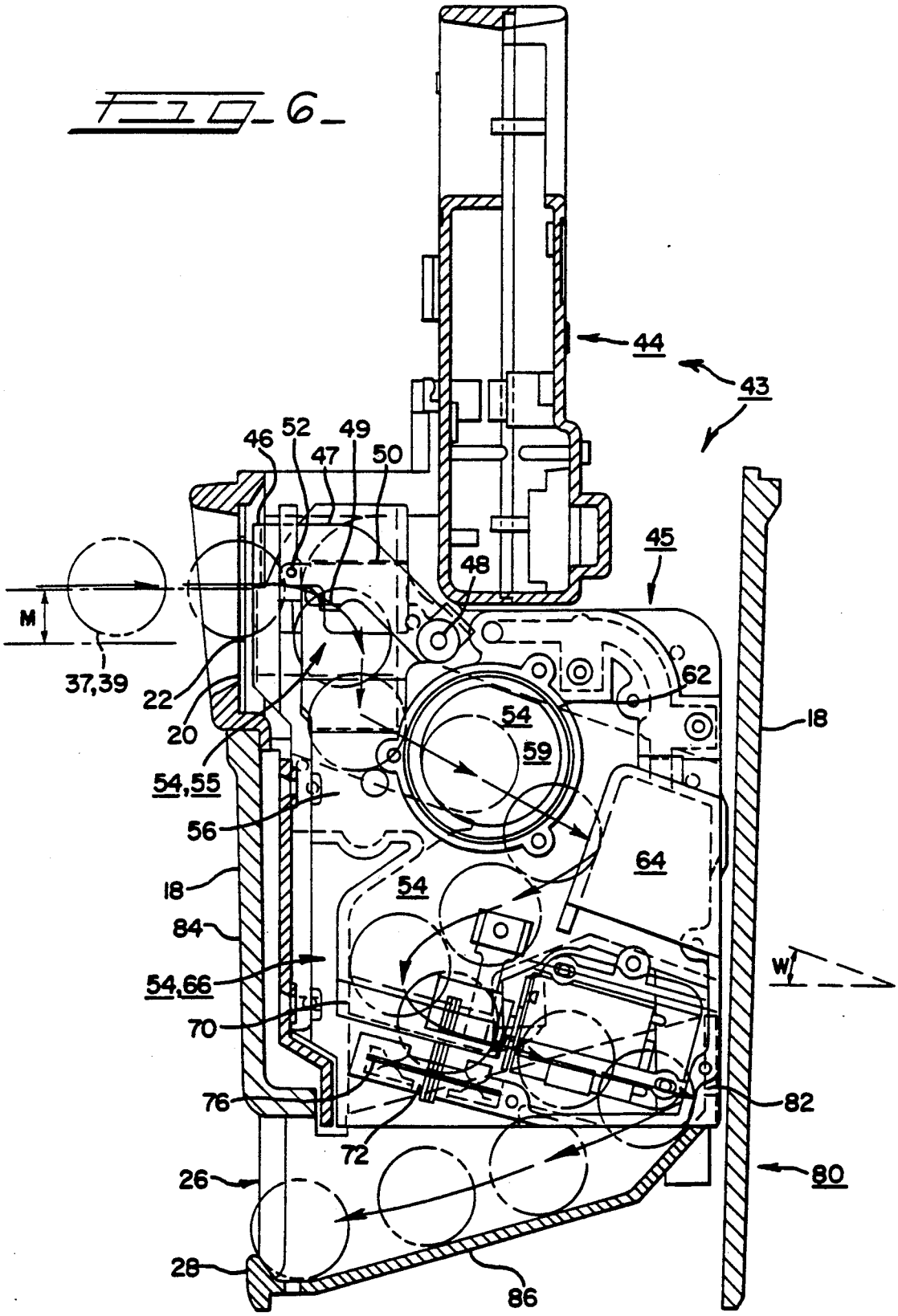
FIG. 6 is a sectional view, taken along the line 6—6 of FIG. 1, of the parking meter shown in FIG. 1, with many parts omitted for clarity.

FIGS. 5 and 6 are cross-sectional views, taken along (in the case of FIG. 5) and substantially along (in the case of FIG. 6) the line 5—5 shown in FIGS. 1 and 2, of the body section 18 of the parking meter 10 shown in FIGS. 1 and 2 and of various parts contained in the body section 18. As shown in FIGS. 5 and 6 the body section 18 is formed to receive within it a variety of parts which collectively comprise the parking meter mechanism 43 of the parking meter 10. The parking meter mechanism 43 in turn comprises a display mechanism unit 44 and a token track unit 45. The display mechanism unit 44 contains the time display 14 and the flag display 16, shown in FIG. 1, which are housed by the display section 12. The token track unit 45 contains the parts, described below, which define the path of a token through the parking meter 10 and which provide a variety of signals influenced by the characteristics of the token. To facilitate the operation of the magnetic field sensor 58 and of the area sensor 60 described below, the token track unit 45 (and the token track unit 91 of the alternate parking meter 89 described below) are made of an opaque material not attracted by a magnetic field, for example, a black plastic such as the acetal resin plastic sold by E.I. du Pont de Nemours & Co. under the registered trademark DELRIN. The token track units 45 and 91 are preferably also made of a material having low thermal conductivity—also a characteristic of DELRIN plastic.

FIG. 5 shows the path which a token follows in traveling by gravity through the token track unit 45 when the parking meter 10 determines to accept the token as valid. FIG. 6 shows the path which a token follows in traveling by gravity through the token track unit 45 when the parking meter 10 determines to reject the token as invalid.

Figure 16A:
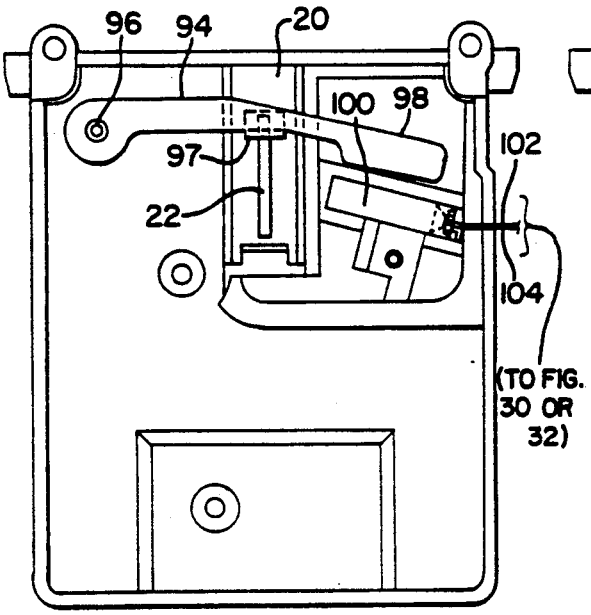
FIGS. 16A and 16B are simplified views of an alternative embodiment of the wake-up switch and the token slot insertion lever which may be used in the parking meter shown in FIGS. 5 and 6 in place of the parts shown in FIGS. 5, 6, 15A, and 15B, or which may be used in the internal mechanism of the alternative parking meter shown in FIGS. 10 through 14.
Figure 16B:
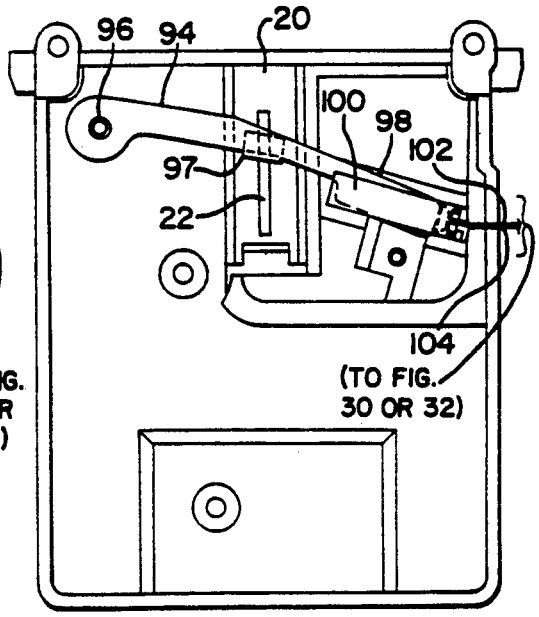
Figure 15A:
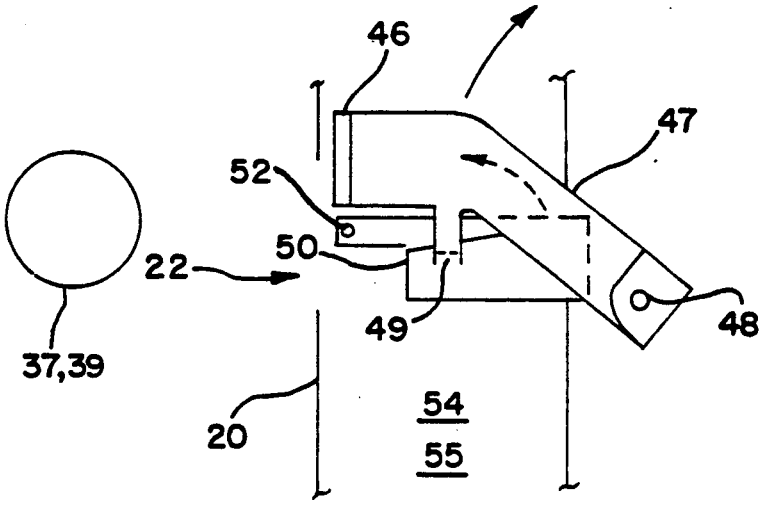
FIGS. 15A and 15B are simplified views of parts relating to the token slot insertion lever shown in FIGS. 5 and 6.
Figure 15B:
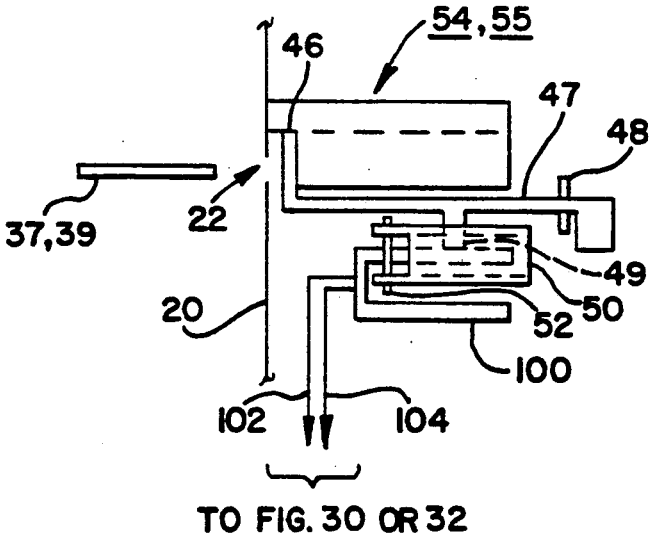

FIGS. 5 and 6 show (as a circle with a broken line as its boundary) a token 37 or 39 at various stages in traveling by gravity through the token track unit 45. In both FIG. 5 and FIG. 6 the direction in which the token 37 or 39 travels is indicated by arrows. As the token 37 or 39 is inserted in the token insertion slot 22 the lower edge of the token 37 or 39 rests on or passes above the lower edge of the token insertion slot 22 as the leading edge of the token 37 or 39 contacts and lifts the free end 46 of a token insertion slot lever 47, the other end of which is pivotally mounted to the token track unit 45 at pivot 48. (FIGS. 15A and 15B show more detailed views of the token slot insertion lever 47 and related parts. FIGS. 16A and 16B show an alternative token slot insertion lever 94, which is described below in connection with those Figures.) As the token 37 or 39 raises the token insertion slot lever 47 a detent 49 formed in the token insertion slot lever 47 engages and lifts a wake-up switch actuation lever 50, one end of which is pivotally mounted to the token track unit 45 at pivot 52. FIG. 5 shows these parts 46, 47, 49, and 50 in the positions to which they are raised by the insertion of a token 37 or 39. FIG. 6 shows these parts 46, 47, 49, and 50 in the position they occupy when they are not raised.

The wake-up switch actuation lever 50, which is made of a magnetically-responsive material, interacts with a wake-up switch 100 (not shown in FIGS. 5 or 6 but shown in FIG. 15B and, in an alternate arrangement, in FIGS. 16A and 16B) to send an electrical signal—the wake-up signal—indicating whether the token slot insertion lever 47 is in a raised position such as shown in FIG. 5 or in the lower position such as shown in FIG. 6. The wake-up signal is not indicated in FIGS. 5 or 6, but the use of that signal is described below in connection with FIGS. 15A, 15B, 16A, 16B, and 30 through 33.

The token slot insertion lever 47, in its lowered position (shown in FIG. 6), partially closes the token insertion slot 22, providing some further protection against the elements to the components within the body section 18.

When a token 37 or 39 has been inserted more than approximately half-way in the token insertion slot 22, the token slot insertion lever 47, in cooperation with the wake-up switch actuation lever 50, provides a force against the edge of the token. That force tends to force the token to the interior of the token track unit 45 and (to a very slight extent) downward.

This arrangement of the token slot insertion lever 47 and the wake-up switch actuation lever 50 serves two functions.

First, the arrangement provides the wake-up signal (summarized just above and described in greater detail below) which indicates whether the token slot insertion lever 47 and the wake-up switch actuation lever 50 are in their lowered positions or are in a raised position. If those levers are in their lowered positions, the nonassertion of the wake-up signal indicates that no token with a diameter greater than a predetermined minimum diameter is being inserted in the token insertion slot 22. That predetermined minimum diameter is the distance between the lower edge of the token slot insertion lever 47 when in the lowered position and the lower edge of the token insertion slot 22 when the token insertion slot lever 47 is in the lowered position shown in FIG. 6. This distance is indicated by the letter M on FIG. 6.

The distance M is chosen when manufacturing the token track unit 45 (and, in particular when manufacturing the token insertion plate 20 with its token insertion slot 22 and the token slot insertion lever 47) to be less than the diameter S of the token 37 or 39 of smallest diameter which the parking meter 10 is to accept as valid. Such a selection of the distance M assures that the wake-up switch actuation lever 50 will move to at least some extent when a token of the smallest diameter to be accepted by the parking meter 10 is inserted in the token insertion slot 22. A smaller dimension M also provides correspondingly greater protection against the elements and correspondingly less room for the insertion of probes or other objects with which a person might attempt to activate the parking meter 10 in an effort to gain parking time without inserting a valid token or in an effort to confuse or disable the parking meter 10. Of course, the dimension M must be large enough for a user to be able to insert through the token insertion slot 22 a token of the largest diameter to be accepted by the parking meter 10.

Second, the arrangement provides a modest degree of control over the way in which a user inserts a token 37 or 39 in the parking meter 10. This arrangement somewhat reduces a user's ability to impart a substantial downward velocity to a token being inserted through the token insertion slot 22, particularly when the token 37 or 39 is inserted more than half way in the token insertion slot 22, at which point the token presents less surface for the user to grasp. The token 37 or 39 thus tends to fall within the token track unit 45 more nearly under the acceleration due to gravity alone than if this arrangement of the token insertion slot lever 47 and the wake-up switch actuation lever 50 were not provided.

When the token 37 or 39 passes completely into the token insertion slot 22, the token insertion lever 37 and the wake-up switch actuation lever 50 return to the lowered positions shown in FIG. 6, and the token 37 or 39 begins to travel by gravity through the interior of the token track unit 45.

The path of the token 37 or 39 through the token track unit 45 is guided by a token chute 54. The token chute 54 has, throughout much of its length, a rectangular cross-section with a token track base somewhat wider than the width of the token insertion slot 22 and a height somewhat greater than the height of the token insertion slot 22. Those dimensions of the cross-section of the token chute 54 assure that a token will travel freely through the token chute 54 and not become frictionally stuck within the token chute 54.

The token chute 54 is indicated by some of the broken lines near the token disks in FIGS. 5 and 6. The overall token chute 54 has several regions, which are shown more clearly in certain of the simplified figures which follow FIGS. 5 and 6.

As shown in FIGS. 5 and 6 the token first falls primarily by gravity through a vertical portion 55 of the token chute 54 and then strikes an inclined token track base 56. This vertical portion 55 of the token chute 54, and the motion of the token 37 or 39 in this vertical portion 55 the token chute 54, are described in detail below in connection with FIGS. 11, 13, 14, 17, 18, and 19.

The inclined token track base 56 is inclined at an angle to the horizontal. This angle is shown as the angle W in FIGS. 5 and 6. The angle W need only be such as to lead an inserted token to roll readily down the inclined token track base 56. While various values of the angle W may be acceptable, a value of approximately 15 (fifteen) to 20 (twenty) degrees is acceptable for the operation of a parking meter 10 such as illustrated in FIGS. 5 and 6.

The inclined token track base 56 may have an optional energy-absorbing surface layer 57 (not shown in FIGS. 5 or 6 for clarity but shown in FIGS. 17 and 18) made of material such as a rubber-like plastic. An energy-absorbing surface 57 helps to reduce any tendency of an inserted token 37 or 39 to bounce up and down after striking the inclined token track base 56.

After striking the inclined token track base 56 the token 37 or 39 begins to roll by gravity down the incline of the inclined token track base 56. The token first passes a magnetic field sensor, which is not shown in FIGS. 5 or 6 for clarity but which is described below in connection with FIGS. 11, 12, 14, 19, 20, 21, 22, 23, and 24.

The token then passes through an area sensing region 59. An area sensor (not shown in FIGS. 5 or 6 for clarity but shown in part in FIGS. 10 and 11 and described in greater detail below) is mounted in the token track unit 45 adjacent to the area sensing region 59. Part of the area sensor is mounted in a mounting ring 62.

While passing through region 59 the token 37 or 39 rolls off the end of the inclined token track base 56 and strikes a mass sensor 64, which is described in greater detail below.

After striking the mass sensor 64 the token enters a token selection region 66 of the token chute 54 and falls and/or rolls to strike an inclined region 70 of a wall of the token chute 54. Region 70 slopes outward from one wall of the token chute 54 and guides the leading edge of the token toward a token acceptance slot 72.

Figure 29B:
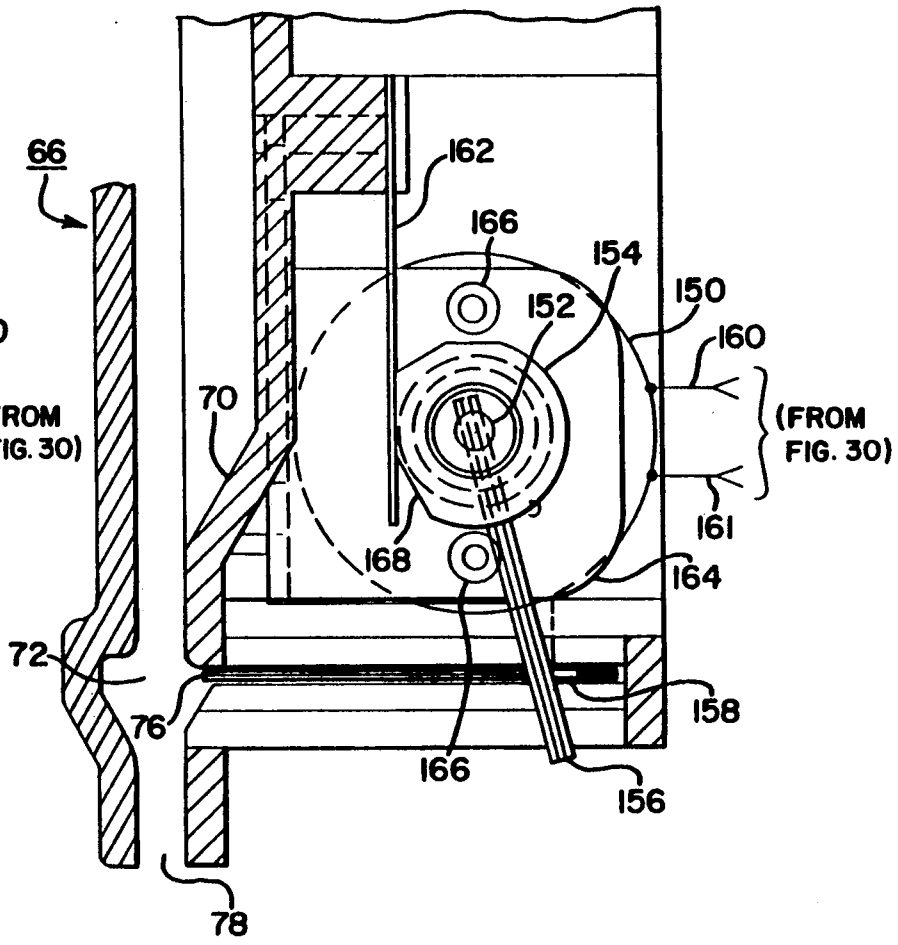
FIG. 29B shows the token gate in its open position.
Figure 29A:
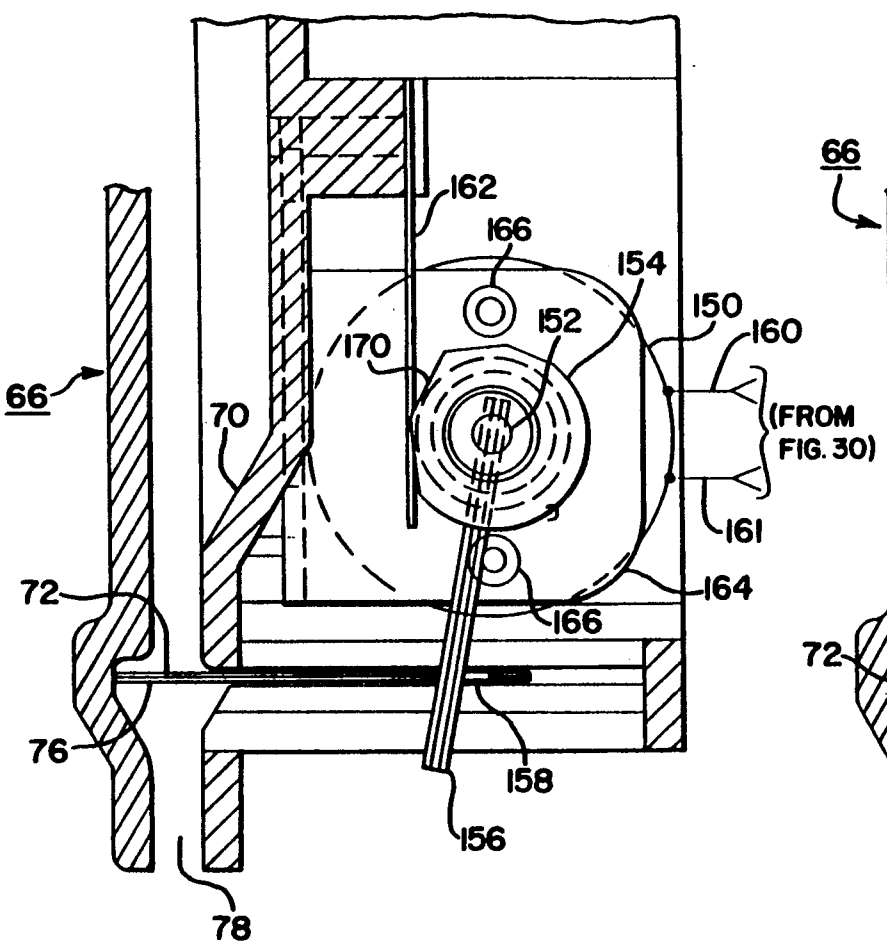
FIG. 29A shows the token gate in its closed position.

In the token acceptance slot 72 a plate 76 is free to slide back and forth between two positions. Those two positions of the plate 76 are not shown directly in FIGS. 5 and 6 because those two positions have substantially the same cross-section in the views shown in FIGS. 5 and 6. However, those two positions are shown in FIGS. 29A and 29B and are described below in connection with those Figures.

In one position—which allows the token to travel as shown in FIG. 5—the plate 76 does not enter the token chute 54 in the token acceptance slot 72. When the token 37 or 39 reaches the token acceptance slot 72, the token continues falling through the token acceptance slot 72 and through a token drop chute portion 78 of the token chute 54 out of the body section 18 and into the token vault section 30. (The token vault section 30 is not shown in FIGS. 5 or 6 but may be seen from FIGS. 1 and 2 to be located below the body section 18.) This path is the path taken by a token 37 or 39 which the parking meter 10 has determined (as described below) to accept as valid.

In the other position—which leads the token to travel as depicted in FIG. 6—the plate 76 enters the token chute 54 in the token acceptance slot 72 and blocks the token from following the path depicted in FIG. 5. As shown in FIG. 6, in this other position of the plate 76 the path of a token 37 or 39 through the token chute 54 is the same as the path depicted in FIG. 5 and described above, until the token approaches the token acceptance slot 72. There, instead of falling through to the token vault in the token vault section 30, the token 37 or 39 strikes the upper surface cf the plate 76 and rolls across the plate 76 to an inclined token return track portion 80, which directs the rolling token toward a rear wall 82. The rear wall 82 may be formed integrally with a token return track 86. The token 37 or 39 strikes the rear wall 82 and continues rolling on the token return track 86 toward the front wall 84. The token return track 86 leads the token 37 or 39 to the token return slot 26, at which the token 37 or 39 strikes the token return stop 28, which holds the token 37 or 39 in the token return slot 26 and prevents the token 37 or 39 from rolling away from the parking meter 10. This path of token 37 or 39 is the path taken by a token which the parking meter 10 has determined (as described below) to reject as not valid. The user who inserted the token 37 or 39 can then recover the rejected token from the token return slot 26.

The components which move the plate 76 between the position which results in the token path shown in FIG. 5 and the other position which results in the token path shown in FIG. 6 are described below in connection with FIGS. 29A through 31 and 34.

Further details of the token selection region 66, the token acceptance slot 72, and the inclined token return track portion 80 are shown in FIGS. 7, 8A, 8B, and 9.

Figure 7:
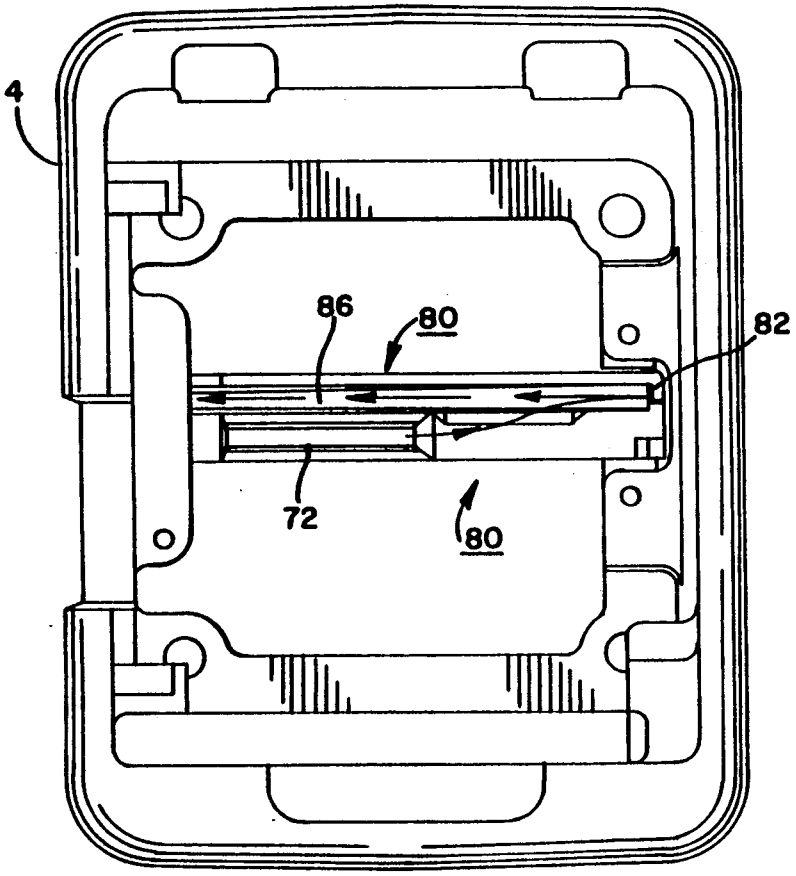
FIG. 7 is a top view of some of the components shown in FIGS. 5 and 6, with many components omitted for clarity.

FIG. 7 shows a top view of the token acceptance slot 72 and the inclined token return track portion 80. Arrows in FIG. 7 show the path a token 37 or 39 travels when the plate 76 (not shown in FIG. 7) is in the position which prevents the token from falling through the token acceptance slot 72 into the token drop chute portion 78. After striking the top of the plate 76 the token travels as shown by the arrows down an incline toward the rear wall 82, strikes and rebounds from the rear wall 82, and continues traveling down an incline toward the front wall 84 of the parking meter 10. The token return track 86 on which the token travels in this region leads to the token return slot 26 of FIG. 1.

Figure 8B:
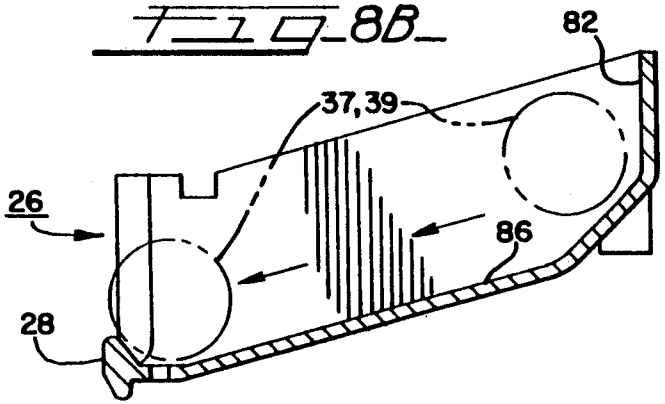
FIG. 8B is a sectional view, taken along the line 8B—8B of FIG. 1, of that part.
Figure 8A:
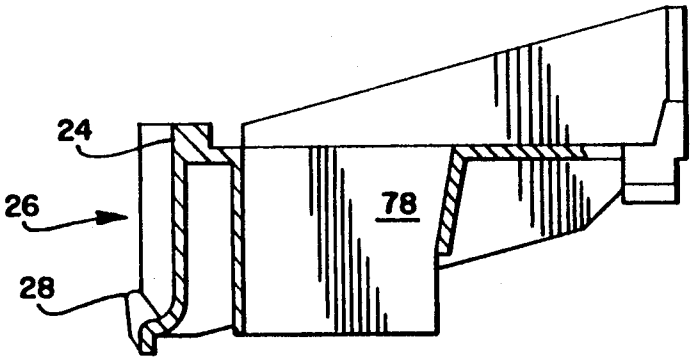
FIG. 8A is a sectional view, taken along the line 8A—8A of FIG. 1, of a part defining the token drop chute portion also shown in FIG. 5, with many components omitted for clarity.

FIG. 8A shows a simplified sectional view, taken substantially along section lines 8A—8A of FIG. 1, of a part defining the token drop chute portion 78. This part is also shown in FIG. 5.

FIG. 8B shows a simplified sectional view, taken along section lines 8B—8B of FIG. 1, of the part depicted in FIG. 8A. This part is also shown in FIG. 6 and defines a token return track 86. The token return track 86 shown in FIG. 8B has walls (one of which is not shown) which confine the rolling token 37 or 39 and cause the token to remain upright while rolling. The spacing between the walls of the token return track 86 is chosen to be adequate to permit free rolling passage of tokens through the token return track and will ordinarily be the same spacing used for other portions of the token chute designed to accommodate a rolling token.

As shown in FIG. 8B a token 37 or 39, after striking the rear wall 82, rebounds and/or falls down to the token return track 86, on which the token 37 or 39 travels until reaching the token return stop 28 in the token return slot 26.

Figure 9:
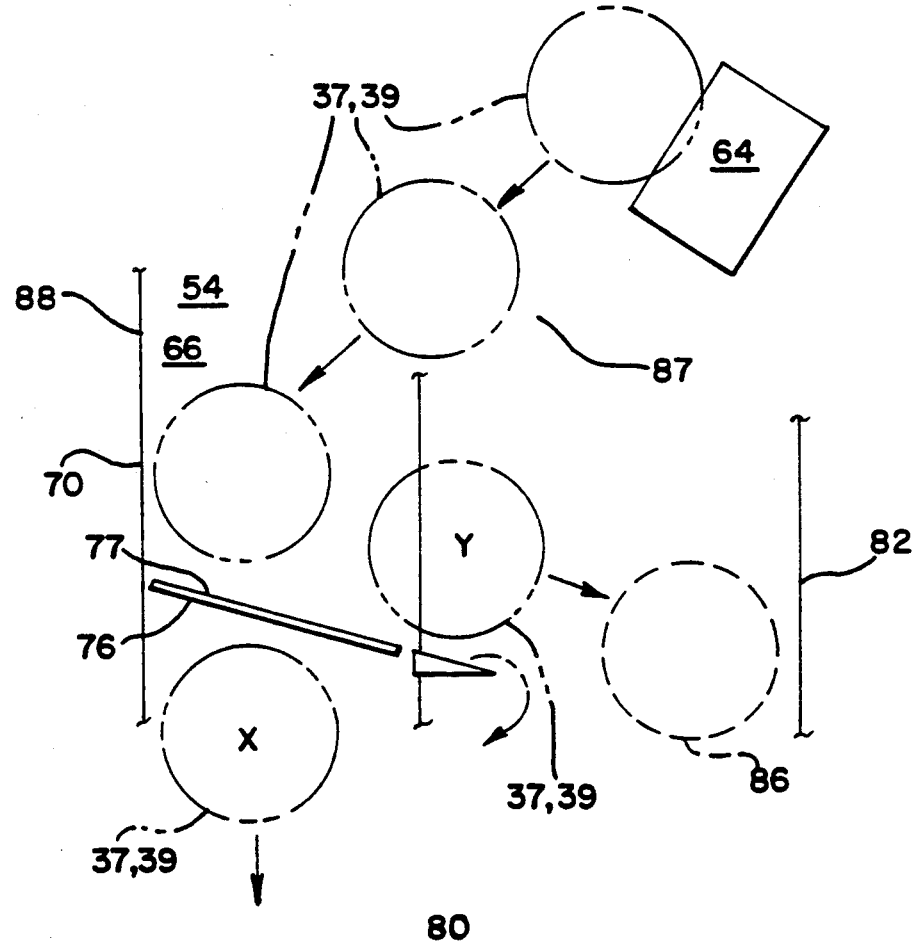
FIG. 9 is a simplified sectional view, taken along line 9—9 of FIG. 1, of certain components shown in FIGS. 5 and 6.

FIG. 9 shows a simplified cross-sectional view, taken along section lines 9—9 of FIG. 1, of the token selection region 66 and the token acceptance slot 72 shown in FIGS. 5, 6, and 7. As shown in FIG. 9, a token 37 or 39 traveling through the coin chute 54 strikes the mass sensor 64. The token 37 or 39 then strikes and rebounds from the walls 87 and/or 88, or falls directly through the region 66.

The token 37 or 39 passes or slides over the inclined region 70 of a wall of the token chute 54. The inclined region 70 narrows the token chute 54 to direct the falling token 37 or 39 toward the token acceptance slot 72. If the plate 76 is not projecting into the token chute 54, then the token 37 or 39 passes down through the token acceptance slot 72 as indicated by the token disk labeled X in FIG. 9. However, if the plate 76 is projecting into the token chute 54, then the token 37 or 39 strikes the upper surface of the plate 76 and rolls down the inclined token return portion 80 as indicated by the token disk labeled Y in FIG. 9. The token 37 or 39 then strikes the rear wall 82 and rebounds or rolls down the token return track 86 toward the token return slot 26. Because, as shown in FIG. 7, the token return track 86 is displaced horizontally from the inclined token return portion 80, the token return track 86 is out of the plane of the cross-section shown in FIG. 9 and is therefore shown in broken lines in FIG. 9.

Forming the token track unit 45 so that a rejected token rolls toward the rear wall 82 and then rolls forward down the token return track 86 to the front of the parking meter 10 makes it more difficult for a vandal to insert a probe into the token return slot 26 in an effort (1) to cause the parking meter 10 to malfunction and/or (2) to manipulate the plate 76 to cause coins to be returned which the parking meter 10 has accepted as valid.

An Alternate Parking Meter and The Path of A Token Through The Alternate Parking Meter The parking meter 10 shown in FIGS. 1, 2, and 5 through 9 incorporates a mass sensor 64 and components allowing the parking meter 10 to return tokens which the parking meter 10 has determined (as described below) to reject as invalid.

An alternate parking meter 89 omits the mass sensor 64 and the components allowing the parking meter to return tokens.

The parking meter 10 and the alternate parking meter 89 share many components, which are indicated herein by the same part number.

Before describing in detail certain features of the invention which are contained in the parking meter 10, it is convenient to follow the path of a token through the alternate parking meter 89, which has many elements in common with the parking meter 10 shown in FIGS. 1, 2, and 5 through 9. Because the alternate parking meter 89 is simpler than the parking meter 10, the views of certain components common to the parking meter 10 and the parking meter 89 are clearer in Figures showing the alternate parking meter 89.

Figure 10:
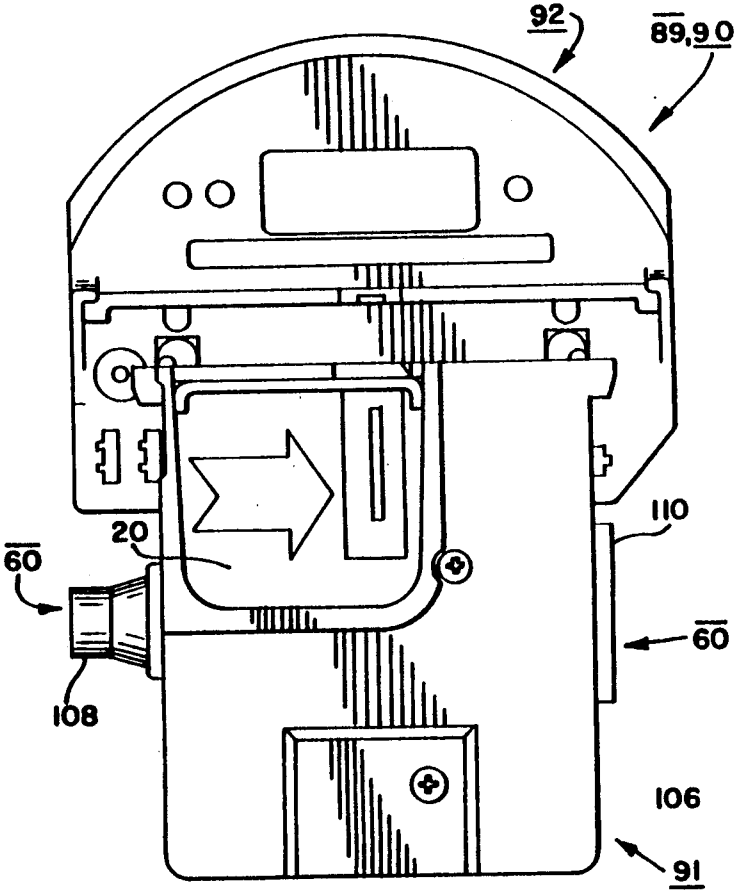
FIG. 10 is a front view of an interior mechanism of an alternative parking meter.

FIG. 10 is a front view of the mechanism 90 of the alternate parking meter 89, with a covering plate 106 attached. The mechanism 90 comprises a token track unit 91 and a display unit 92. Those of ordinary skill in the art will understand that a suitable display section 12 and body section 18 contain the mechanism 90 and that the body section 18 is mounted on a suitable token vault section 30. The alternate parking meter 89 does not return tokens it has determined not to recognize as valid. Thus, the body section 18 of the parking meter 89 differs from the body section 18 of the parking meter 10 in that the body section 18 of the parking meter 89 has no token return plate 24, no token return slot 26, and no token return stop 28. All tokens inserted in the alternate parking meter 89—whether the alternate parking meter 89 determines to recognize them as valid or not to recognize them as valid—fall into and are retained by the token vault in the token vault section 30.

As shown in FIG. 10, the covering plate 106 may hold the token insertion plate 20 with its token insertion slot 22. FIG. 10 also shows part of the light-source end 108 and part of the light-sensing end 110 of the area sensor 60, which is described in greater detail below. The same area sensor 60 may be used in the parking meter 10 and in the alternate parking meter 89.

Figure 11:
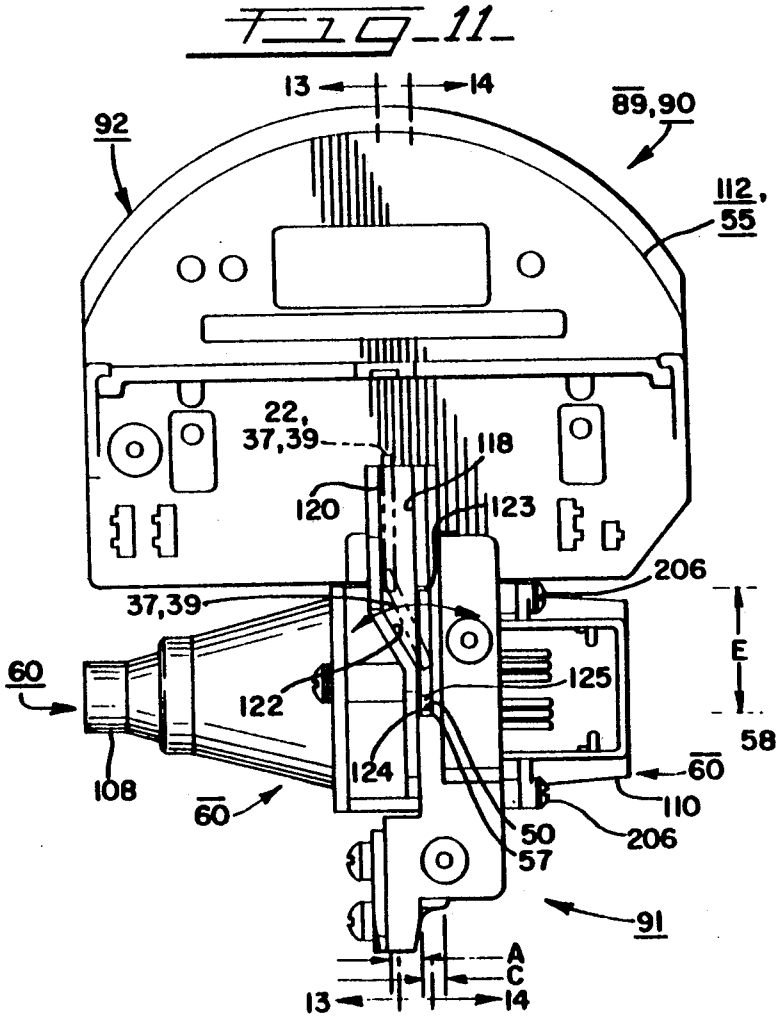
FIG. 11 is a front view of the interior mechanism of an alternative parking meter shown in FIG. 10, with a front covering plate removed.

FIG. 11 is a front view of the mechanism 90 of the alternate parking meter 89 shown in FIG. 10, but with the covering plate 106 removed. Because the alternate parking meter 89 does not incorporate the mass sensor 64, the token selection region 66, or the token acceptance slot 72, the parking meter 89 has a simpler token track unit 91 than the token track unit 45 used with the parking meter 10. FIG. 11 is a front view of that token track unit 91. FIG. 11 also shows the light-source end 108 of the area sensor 60 and part of the light-receiving end 110. FIG. 11 also shows a side view of the magnetic field sensor 58. The magnetic field sensor 58, and certain parts related to it which are omitted from FIG. 11 for clarity, are described in greater detail below in connection with FIGS. 20 through 24. The same magnetic field sensor 58 may be used in the parking meter 10 and the alternate parking meter 89.

Because the parking meter 89 omits certain features of the parking meter 10, the parking meter 89 has a token chute 112 which is simpler than the token chute 54 of the parking meter 10. However, the vertical portion 55 and the inclined token track base 56 (with the optional energy-absorbing surface 57) may be used with the token chute 54 of the parking meter 10 and with the token chute 112 of the parking meter 89.

The Vertical Portion 55 Of The Token Chute 54 Or The Token Chute 112

FIG. 11 shows a front view of the vertical portion 55 of the token chute 112, which was also shown in a partial side view (as part of the token chute 54) in broken lines in FIGS. 5 and 6. The token insertion slot 22 shown in FIG. 10, shown in broken lines in FIG. 11, is disposed so that a token 37 or 39—shown in broken lines in an edge view in FIG. 11—will fall into the vertical portion 55 after passing through the token insertion slot 22. The position of the token 37 or 39 just after passing through the token insertion slot 22 is shown as the upper edge view in broken lines shown in FIG. 11.

The vertical portion 55 of the token chute 54 or the token chute 112 has several features to control the motion of the token 37 or 39 through the token chute 54 or the token chute 112 so that the characteristics of the token 37 or 39 can be more reliably detected by the token characteristic sensors installed in the parking meter 10 or the alternate parking meter 89. These features are shown in FIGS. 11, 13, 17, 18, and 19.

The vertical portion 55 of the token chute 54 or the token chute 112 has four walls defining a chute with a rectangular cross-section. FIG. 11 shows in cross-section two of those four walls: the opposing first side wall 118 and second side wall 120. The separation between the first side wall 118 and the second side wall 120 is a distance A. The token insertion slot 22 lies closer to the second side wall 120 than to the first side wall 118. The second side wall 120 has a sloping portion 122 in which the second side wall 120 trends closer to the first side wall 118. The token insertion slot 22 is located vertically above this sloping region 122.

As shown in FIG. 11 the surface of the second side wall 120 is adjacent to and in line with the token insertion slot 22. This arrangement keeps the token 37 or 39 traveling in the proper direction when inserted.

The first side wall 118 has a recessed portion 123 in which the surface of the first side wall 118 increases its distance from the second side wall 120 by a distance C. This recessed portion 123 in the first side wall 118 begins far enough above the inclined token track base 56 that the largest token which passes through the token slot 22 will easily travel down the vertical portion 55 of the token chute 54 or the token chute 112 to land on edge on, and to roll freely down, the inclined token track base 56. The distance between the start of the recessed portion 123 of the first side wall 118 and the token track base 56 is the distance E shown in FIG. 11. The sloping portion 122 of the second side wall 120 continues to trend closer to the recessed portion 123 of the first side wall 118 until the distance between the sloping portion 122 and the recessed portion 123 is reduced to a distance C, as shown in FIG. 11. Below that point a lower portion 124 of the second side 120 continues downward parallel to the recessed portion 123 of the first side wall 118. The lower end of the lower portion 124 of the second side wall 120, the lower end of the recessed portion 123 of the first side wall 118, and the inclined token track base 56 define a groove 125 into which a token 37 or 39 falls after being inserted through the token insertion slot 22. The recessed portion 123 of the first side wall 118, and the lower portion 124 of the second side wall 120, become the side walls of the token chute 54 or of the token chute 112 as the inclined token track base 56 trends downward within the parking meter 10 or 89.

The vertical portion 52 of the token chute 54 or the token chute 112 just described is believed to control the motion of a token 37 or 39 as it falls after passing through the token insertion slot 22. The distance A is made considerably greater than the thickness T of the thickest token 37 or 39 the token slot 22 will allow to pass. The distance C, however, is preferably made at least 10 (ten) percent greater than the thickness T of that thickest valid token. Such a value for the parameter C assures that a token will remain reasonably upright while rolling down the inclined token track base 56 while reasonably reducing the possibility that a token might become frictionally stuck in the token chute 54 or the token chute 112.

This configuration of the vertical portion 55 of the token chute 54 or the token chute 112 offsets the token insertion slot 22 from the inclined token track base 56. That offset makes it more difficult for a vandal to insert a probe into the inclined token track 56 in an effort to interfere with the operation of the parking meter 10 or 89.

As the token 37 or 39 falls in the vertical portion 55 of the token chute 54 or the token chute 112 after passing the token insertion slot 22, the leading edge of the token 37 or 39 strikes the sloping portion 122 of the second side wall 120. The token 37 or 39 then begins to be confined between the sloping portion 122 and the recessed portion 123 of the first side wall 118, as shown in the outline of a tilted token 37 or 39 shown in broken lines in FIG. 11. The token 37 or 39 tilts as its leading edge slides down the sloping portion 122, and the leading edge of the token then strikes the recessed portion 123 of the first side wall 118. The token 37 or 39 then snaps back to a generally vertical position and vibrates back and forth between a slightly tilted position and a generally vertical position as the token 37 or 39 continues to fall, with its leading edge oscillating between contacting the recessed portion 123 of the first side wall 118 and contacting the lower portion 124 of the second side wall 120. The leading edge of the token approaches and then impacts on the inclined token track base 56. The token 37 or 39 is believed to vibrate rapidly from side to side in the groove 125 after its leading edge impacts on the inclined token track base 56. The token 37 or 39 is believed to continue to vibrate as the downward incline of the inclined token track base 56 leads the token 37 or 39 to begin to roll down the inclined token track base 56.

Causing the token 37 or 39 to vibrate as it falls down the vertical portion 55 of the token chute 54 or the token chute 112, and to continue to vibrate as the token rolls down the inclined token track base 56, tends to eliminate bouncing, and to cause the token to begin rolling down the inclined token track base 56 with very little initial translational velocity. This generally improves the repeatability and reproducibility of the motion of a token through the token chute 54 or the token chute 112, regardless of how forcefully a user inserted the token in the token insertion slot 22.

Figure 13:
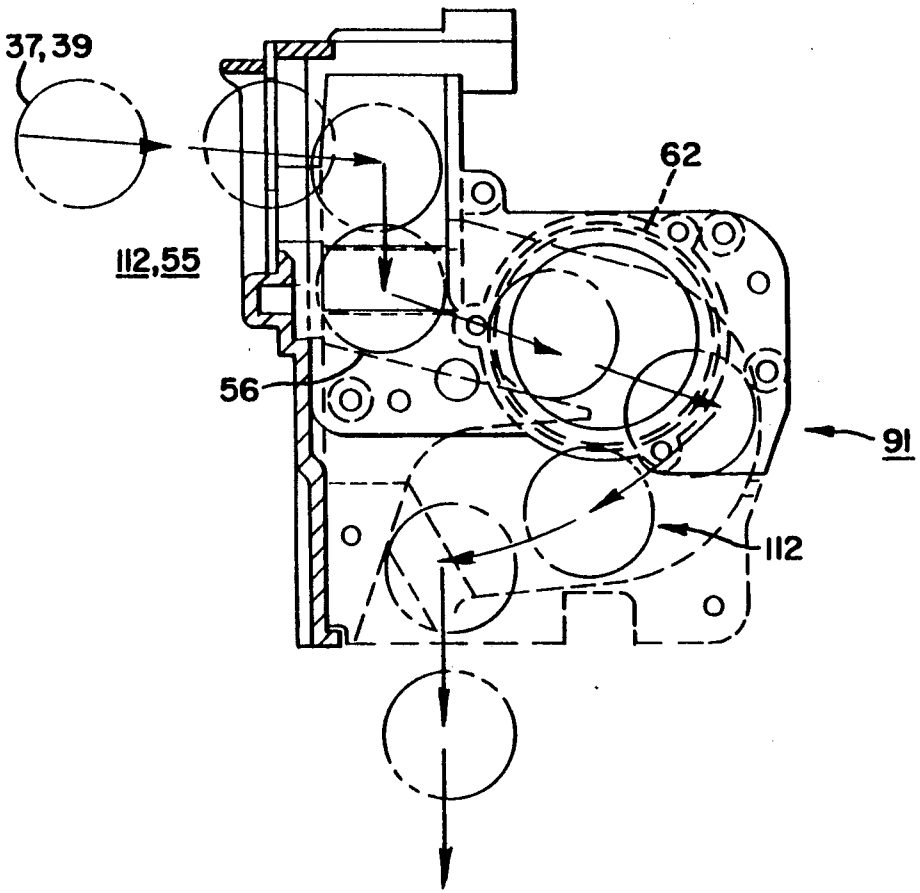
FIG. 13 is a sectional view along the section lines 13—13 of FIG. 11 of a portion of the interior mechanism of the alternative parking meter shown in FIGS. 10, 11, and 12, with many parts not shown for clarity.
Figure 12:
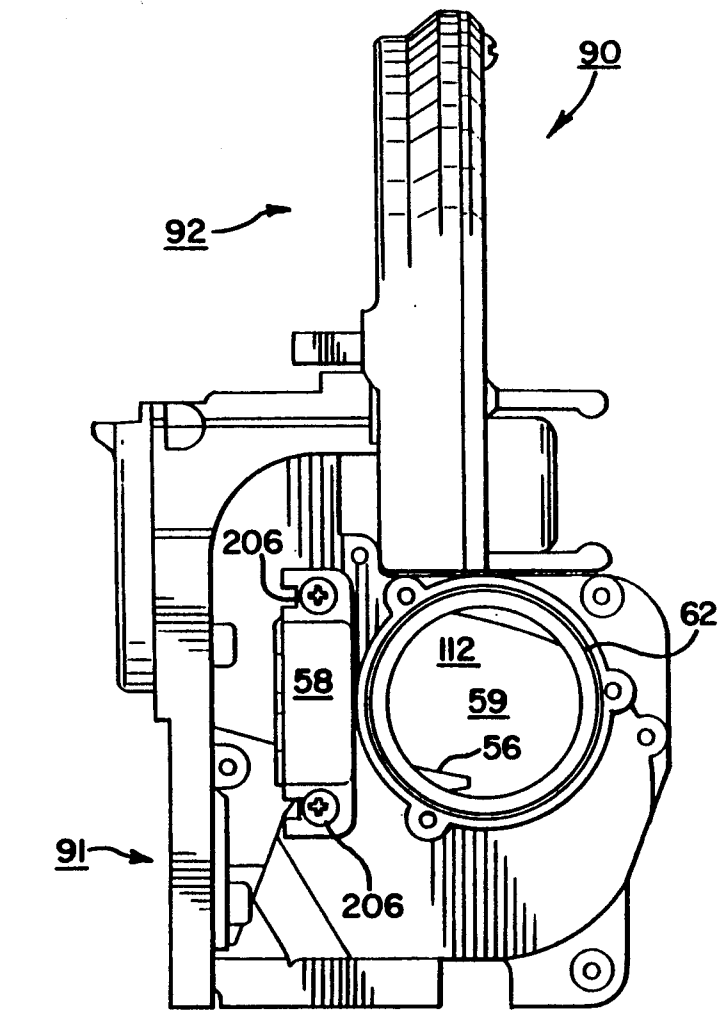
FIG. 12 is a side view (from the right-hand side) of the interior mechanism of the alternative parking meter shown in FIGS. 10 and 11.
Figure 14:
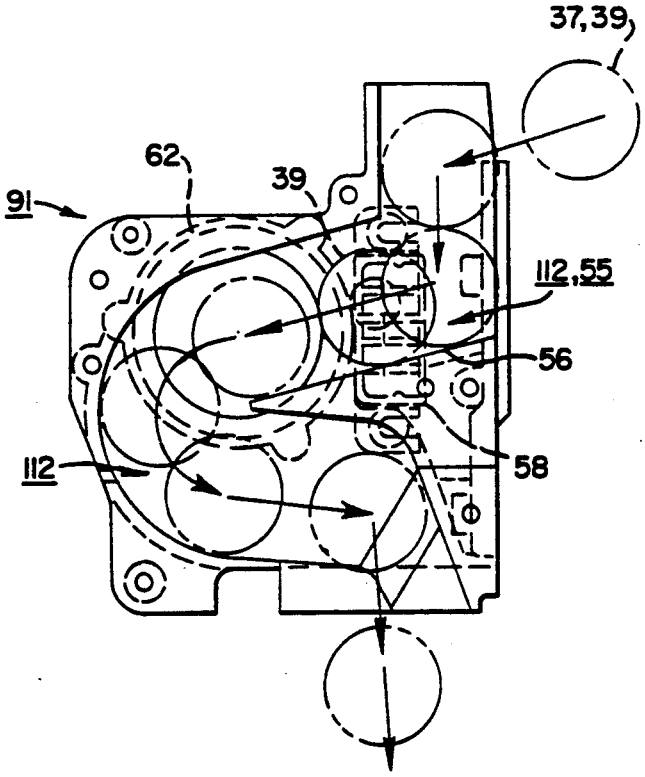
FIG. 14 is a sectional view along the section lines 14—14 of FIG. 11 of a portion of the interior mechanism of the alternative parking meter shown in FIGS. 10, 11, and 12, with many parts not shown for clarity.

Further details of the configuration of the token chute 112, of the vertical portion 55 of the token chute 112, and of the path of a token 37 or 39 through that vertical portion 55 are also shown in side view in FIGS. 12, 13, and 14. FIG. 12 shows a side view (from the right-hand side) of the parking meter mechanism 90 of the alternate parking meter 89 shown in FIGS. 10 and 11, with its token track unit 91 and its display unit 92. As shown in FIG. 12 the inclined token track base 56 of the token chute 112 leads the token 37 or 39 past the magnetic field sensor 58 and past the area sensing region 59 of the token chute 112, adjacent to which the area sensor 60 is mounted, with one part of the area sensor 60 mounted in the mounting ring 62.

FIG. 13 is a sectional view along the section lines 13—13 of FIG. 11 of the token track unit 91, as shown in FIG. 12, with various parts removed for clarity. FIG. 14 is a sectional view along the section lines 14—14 of FIG. 11 of the token track unit 91, as shown in FIG. 12, with various parts removed for clarity. As shown in FIGS. 13 and 14, the token track unit 91, and the token chute 112, differ from the token track unit 45, and the token chute 54, in that the token track unit 91 is not equipped with a mass sensor 64 or with the components relating to returning a token which the parking meter 10 has determined not to recognize as valid. Any token 37 or 39 inserted in the alternate parking meter 89 will travel along the token track 112 as shown in FIGS. 13 and 14 and fall down into a token vault section 30 (not shown in FIGS. 10, 11, 12, 13, or 14). In addition, in the parking meter 10 of FIG. 1 the vertical portion 55 of the token chute 54 is a mirror image of the vertical portion 55 of the token chute 112; but that difference does not affect the operation of the invention. However, in other aspects the token chute 112 is the same as the token chute 54. In particular, both the token chute 54 and the token chute 112: (a) have a vertical portion 55; (b) have an inclined token track base 56; (c) lead an inserted token 37 or 39 to roll past a magnetic field sensor 58 shown in FIG. 12 and (in broken outline) in FIG. 14 in the position in which it is mounted in the token track unit 91 and in the token track unit 45); (d) lead an inserted token to roll and/or fall through an area sensing region 59 controlled by an area sensor 60; and (e) lead an inserted token 37 or 39 to travel beyond the area sensing region 59 to clear the way for another token or other tokens to be inserted later.

Figure 17:
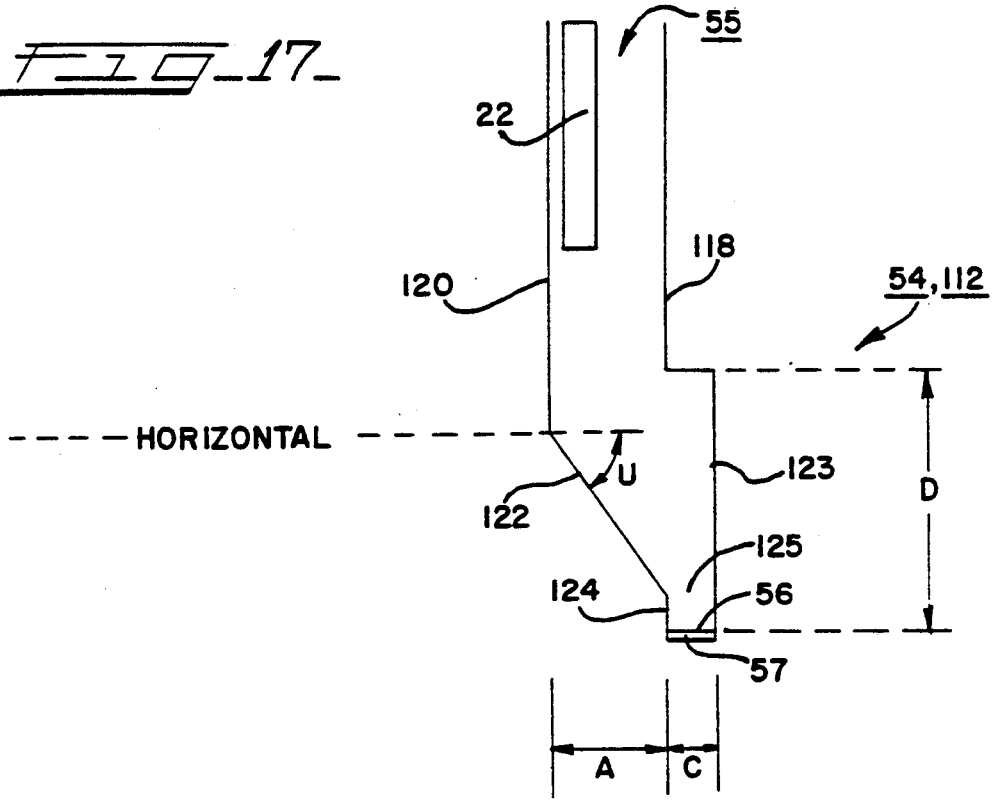
FIG. 17 is a simplified sectional view of a portion of the token chute shown in FIGS. 5, 6, 11, 13, and 14.
Figure 18:
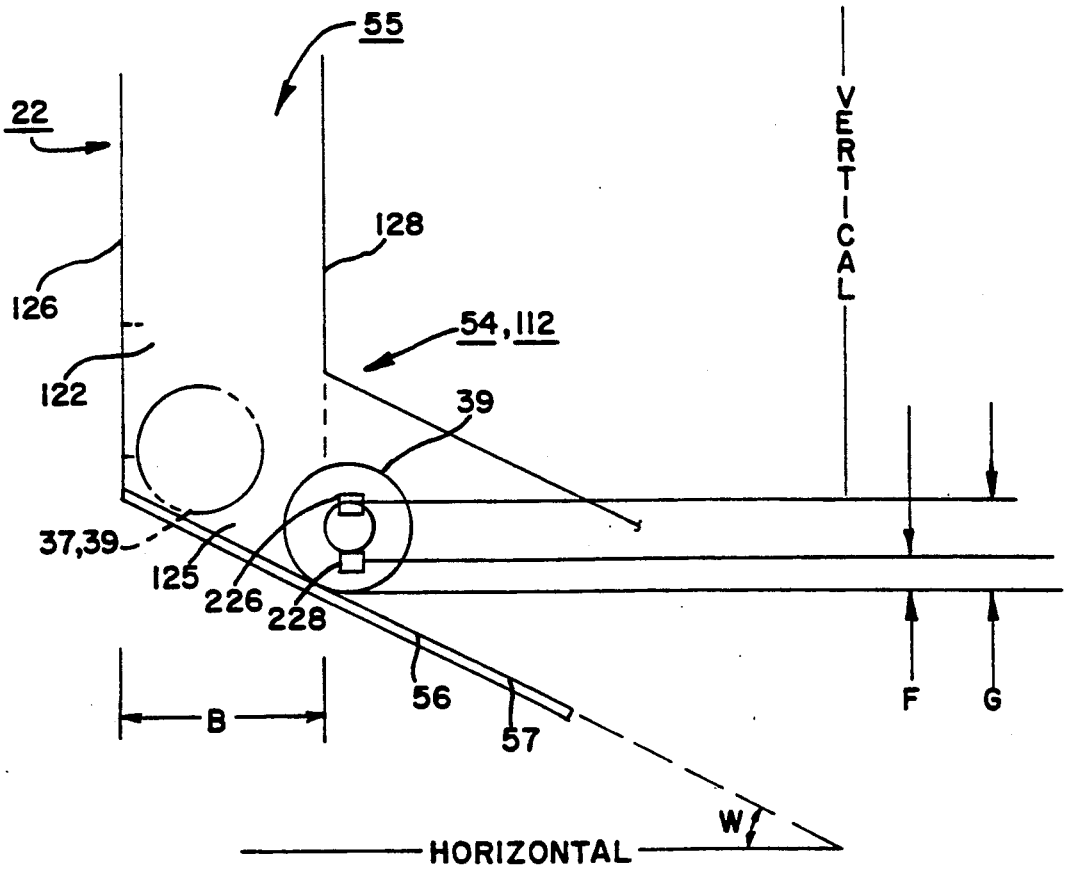
FIG. 18 is a simplified sectional view of a portion of the token chute shown in FIGS. 5, 6, 11, 13, and 14.
Figure 19:
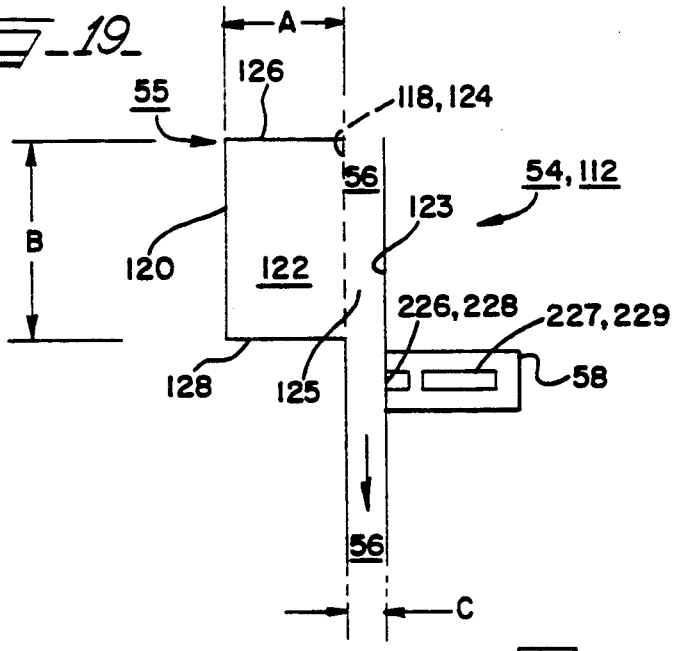
FIG. 19 is a simplified top view of the portion of the token chute shown in FIGS. 17 and 18.

FIGS. 17, 18, and 19 show details of the vertical portion 55 of the token track 54 and the token track 112, of the groove 125, and of the inclined token track base 56, with most other parts removed for clarity.

FIG. 17 is a simplified cross-sectional view of the vertical portion 55 of the token chute 54 or of the token chute 112, shown with many other parts in other Figures. In FIG. 17 the location of the token insertion slot 22 is shown by the rectangle labeled 22.

FIG. 17 also illustrates the angle U which the face of the sloping portion 122 of the second side wall 120 makes with the horizontal. The angle U is preferably approximately 60 (sixty) degrees.

FIG. 18 is a simplified cross-sectional view of the vertical portion 55 of the token chute 54 or of the token chute 112, with many parts omitted for clarity. The view shown in FIG. 18 is taken in the same plane as that shown in FIGS. 12 and 13; that is, in a vertical plane perpendicular to the view taken in FIGS. 11 and 17. FIG. 18 thus shows the opposing front (or third side) wall 126 and back (or fourth side) wall 128 of the vertical portion 55 of the token chute 54 or of the token chute 112. The front (or third side) wall 126 and the back (or fourth side) wall 128 are separated by a distance B which is slightly greater than the diameter of the largest token which will pass through the token insertion slot 22. Such a value for the distance B limits the inward motion of a token even if a user inserts the token very forcibly or rapidly.

FIG. 18 shows details of the placement of certain parts contained in the magnetic field sensor 58 to detect characteristics of a token as the token rolls down the inclined token track base 56. Two Hall-effect sensors 226 and 228 are mounted in the magnetic field sensor 58 (not shown explicitly in FIG. 18), with the active face of each Hall-effect sensor near the side wall of the token chute 54 or the token chute 112. FIG. 18 shows (in an end view) the active faces of the upper Hall-effect sensor 226 and the lower Hall-effect sensor 228, which extend into the plane of FIG. 18. The way in which the Hall-effect sensors 226 and 228 operate in the magnetic field sensor 58 is described in greater detail below in connection with FIGS. 20 through 26. As shown in FIG. 18, the face of the lower Hall-effect sensor 228 is mounted a distance F vertically above the inclined token track base 56, and the face of the upper Hall-effect sensor 226 is mounted a greater distance G vertically above the inclined token track base 56. FIG. 18 also shows again the angle W between the inclined token track base 56 and the horizontal previously shown in FIGS. 5 and 6.

After a token 37 or 39 has struck the inclined token track base 56 and begun to vibrate as discussed above, the token 37 or 39 begins to roll down the token chute 54 (or the token chute 112) past the Hall-effect sensors 226 and 228. It is believed that the vibratory motion of the token 37 or 39 induced by impact with the sloping portion 122 of the first wall 118 tends to reduce the tendency of the token 37 or 39 to bounce or to move erratically when rolling down the inclined token track base 56. This reduced tendency to bounce or to move erratically causes the token 37 or 39 to have a much more repeatable and reproducible (in the senses of those terms defined above) motion when traveling past the Hall-effect sensors 226 and 228 and (further down the inclined token track base 56) when passing the area sensing region 59. This leads to much more accurate signals from the magnetic field sensor 58 and from the area sensor 60 and thus greatly improves the usefulness of an electronic parking meter (or other token-actuated device) which incorporates those sensors or any magnetic, electronic, or photonic sensors which do not contact the inserted token.

The vibratory motion of the token 37 or 39 is believed to continue as the token rolls down the inclined token track base 56. However, that vibratory motion is believed to affect the repeatability and reproducibility of the signals produced by the magnetic field unit 58 and/or by the diameter sensor 60 far less than a bouncing motion of a token 37 or 39. Such a bouncing motion tends to be comparatively unpredictable and thus would tend to cause a token 37 or 39 to follow a comparatively unpredictable path past the magnetic field sensor 58 and the area sensor 60.

FIG. 19 is a top view of the portions of the token chute 54 and the token chute 112 shown in FIGS. 17 and 18. As shown in FIG. 19 (and also in FIG. 18), the magnetic field sensor 58 with its Hall-effect sensors 226 and 228 (shown as one profile in FIG. 19) is mounted a small distance down the inclined token track 56 from the back (or fourth side) wall 128. This small distance permits a token 37 or 39 to begin rolling before passing the magnetic field sensor 58 but assures that the token 37 or 39 will still have a small translational velocity in moving down the inclined token track 56 when passing the magnetic field sensor 58.

In addition to the elements also shown in FIGS. 17 and 18, FIG. 19 shows generally the location within the magnetic field sensor 58 of the Hall-effect sensors 226 and 228 (shown as one profile in FIG. 19) and their associated permanent magnets 227 and 229 (also shown as one profile in FIG. 19). The precise location of the Hall-effect sensors 226 and 118 and of the permanent magnets 227 and 229 is described in greater detail below in connection with FIGS. 20 through 24.

The Wake-Up Switch

The wake-up switch may be implemented in either of two possible alternatives. FIGS. 15A and 15B show one possible alternative, designed for use with the parking meter 10; FIGS. 16A and 16B show another possible alternative, designed for use with the alternate parking meter 89. However, either alternative of the wake-up switch could be used with the parking meter 10 or the alternate parking meter 89.

FIG. 15A shows a simplified side view of certain parts related to the wake-up switch. Just inside the token insertion slot 22 in the token insertion plate 20 the free end 46 of the token insertion slot lever 47 closes off a portion of the token insertion slot 22. The free end 46 of the token insertion slot lever 47 extends into the page in the view shown in FIG. 15A. Thus, when a token 37 or 39 is inserted in the token insertion slot 22, an edge of the token 37 or 39 will engage the free end 46 of the token insertion slot lever 47, causing the token insertion slot lever 47 to rise and to pivot about the pivot 48 in the direction shown by the solid arrow in FIG. 15A. The detent 49, formed in the token insertion slot lever 47, projects out from the token insertion slot lever 47 and under one side of the wake-up switch actuation lever 50.

As the token insertion slot lever 47 rises, the detent 49 engages the lower part of an edge of the wake-up switch actuation lever 50, raising the wake-up switch actuation lever 50 and causing it to pivot about the pivot 52 in the direction shown by the broken arrow in FIG. 15A. As the token 37 or 39 is inserted further into the token insertion slot 22, the token insertion slot lever 47 and the wake-up switch actuation lever 50 continue to rise. When the token 37 or 39 has been inserted more than approximately half-way in the token insertion slot 22, the token insertion slot lever 47 and the wake-up switch actuation lever 47 begin to pivot from raised positions back toward the lowered positions shown in FIG. 15A. As they pivot back toward those lowered positions, the free end 46 of the token insertion slot lever 47 forces the token 37 or 39 into the token chute 54.

FIG. 15B shows a top view of the items shown in FIG. 15A, with certain additional items shown which were omitted from FIGS. 5, 6, and 15A for clarity. As shown more clearly in FIG. 15B, the token insertion slot 22 is partially closed by the free end 46 of the token insertion slot lever 47; the free end 46 projects out from the side of the token insertion slot lever 47 to accomplish this partial closing of the token insertion slot 22. As the token 37 or 39 is inserted in the token insertion slot 22, both the token insertion slot lever 47 and the wake-up switch actuation lever 50 pivot up out of the plane of FIG. 15B.

The wake-up switch actuation lever 50 has two sides (shown by dashed lines in FIG. 15B) which project vertically into the plane of FIG. 15B. The detent 49 engages one side and lifts the entire wake-up switch actuation lever 50 as the token insertion slot lever 47 rises.

The other side of the wake-up switch actuation lever 50 extends between the two arms of a wake-up switch 100 comprising a U-shaped magnetic reed switch unit which is a standard Hamlin Inc. part. The U-shaped magnetic reed switch unit contains a permanent magnet and an electrical reed switch responsive to the magnetic field from the permanent magnet; when the wake-up switch actuation lever 50 is between the arms of the U-shaped magnetic reed switch unit, the arm of the lever 50 comes between the permanent magnet and the reed switch, causing the reed switch to open electrical contact between the lines 102 and 104. The reed switch is thus responsive to whether the wake-up switch actuation lever 50 is in its lowered position as shown in FIGS. 15A and 15B or in a raised position. If the wake-up switch actuation lever 50 is in its lowered position, the wake-up switch is open, and there is no electrical contact between lines 102 and 104. If the wake-up switch actuation lever 50 is in a raised position, the wake-up switch 100 is closed, and there is electrical contact between the lines 102 and 104. The lines 102 and 104 lead to the control unit 230 schematically shown in FIG. 30. Because the electrical connection between lines 102 and 104 is either open or closed (a condition which can readily be detected with little consumption of current by the control unit 230), using the wake-up switch 100 draws very little current. The wake-up switch actuation lever 50 is, of course, made of ferrous metal to affect the magnetic field of the permanent magnet in the U-shaped magnetic reed switch unit.

FIGS. 16A and 16B, which are views taken from inside the parking meter 89, show an alternative arrangement for opening or closing electrical connection between the lines 102 and 104. As shown in FIGS. 16A and 16B an alternate token insertion slot lever 94 may be pivotally mounted on a pivot 96 so that the token insertion slot lever 94 extends transversely across the token insertion slot 22. The part of the token insertion slot lever 94 which partially bars the token insertion slot 22 may be fitted with a shoe 97 adapted to receive the contact of a token 37 or 39 (not shown in FIGS. 16A or 16B) as the token is inserted in the token insertion slot 22. The shoe 97 is mounted on the lever 94 facing the token insertion slot 22.

FIG. 16A shows the token insertion slot lever 94 in a raised position such as may be caused by the insertion of a token 37 or 39 in the token insertion slot 22. In the raised position shown in FIG. 16A the free end 98 of the token insertion slot lever 94 is lifted away from between the arms of a wake-up switch 100 (which may be the same U-shaped magnetic reed switch unit described above in connection with FIG. 15). In the mounting shown in FIGS. 16A and 16B the arm of the U-shaped magnetic reed switch unit which contains the magnet is mounted toward the front of the parking meter 89, and the arm which contains the reed switch is mounted toward the interior of the parking meter 89. This mounting makes it more difficult for vandals to tamper with the reed switch. In the lowered position, shown in FIG. 16B, the free end 98 of the token insertion slot lever 94 is between the two arms of the wake-up switch 100. The token insertion slot lever 94 is made of a ferrous metal to affect the magnetic field of the permanent magnet contained in the U-shaped magnetic reed switch unit, as described above. The wake-up switch signal lines 102 and 104 (shown schematically in FIGS. 16A and 16B) lead to the control unit 230 shown schematically in FIG. 30 or to the control unit 272 shown schematically in FIG. 32. The presence or absence of electrical connection between the line 104 and 106 indicates whether the token insertion slot lever 94 is in a raised position or is in the lowered position shown in FIG. 16B.

After passing beyond the token insertion slot lever 47 or 94 the token 37 or 39 is in the token chute 54 or the token chute 112. As the token 37 or 39 passes through the token insertion slot 22, the token insertion lever 47 or 94 will (in the absence of tampering or malfunction) return to the lowered position shown in FIGS. 15A or 16B, respectively. In that lowered position the token slot lever 47 or 94 once again partially closes off the token insertion slot 22 and thus prevents the token 22 from passing back out the token insertion slot 22.

The Token Characteristic Sensors.

The parking meter 10 is equipped with three token characteristic sensors: (1) the magnetic field sensor 58 mentioned above in connection with FIGS. 5 and 6; (2) the area sensor 60 mentioned above in connection with FIGS. 5 and 6; and (3) the mass sensor 64 also mentioned above in connection with FIGS. 5 and 6. These three sensors are mounted adjacent to the token chute 54.

The parking meter 89 is equipped with two token characteristic sensors: (1) the magnetic field sensor 58 mentioned above in connection with FIGS. 5 and 6; and (2) the area sensor 60 mentioned above in connection with FIGS. 5 and 6. These two sensors are mounted adjacent to the token chute 112.

The magnetic field sensor 58 and the diameter sensor 60 may be, and preferably are, the same in the parking meter 10 and the alternative parking meter 89.

The Magnetic Field Sensor 58

The magnetic field sensor 58 is mounted in the token track unit 45 or in the alternative token track unit 91 adjacent to the inclined token track base 56 and sightly after the vertical portion 55 of the token chute 54, as shown in FIGS. 11, 12, 14, 18, and 19. This location places the magnetic field sensor 58 in the region of the inclined token track base 56 in which the token 37 or 39 is near its point of least translational speed—a point at which the token 37 or 39 has just begun to roll down the inclined token track base 56 and at which the token 37 or 39 has not begun to move at a substantial translational speed down the inclined token track base 56. FIG. 14 shows, adjacent to the magnetic sensor 58 and on the inclined token track base 56, a token 39 as depicted in FIGS. 4A and 4B, which has an inner portion 41 and an outer portion 42.

Figure 20:
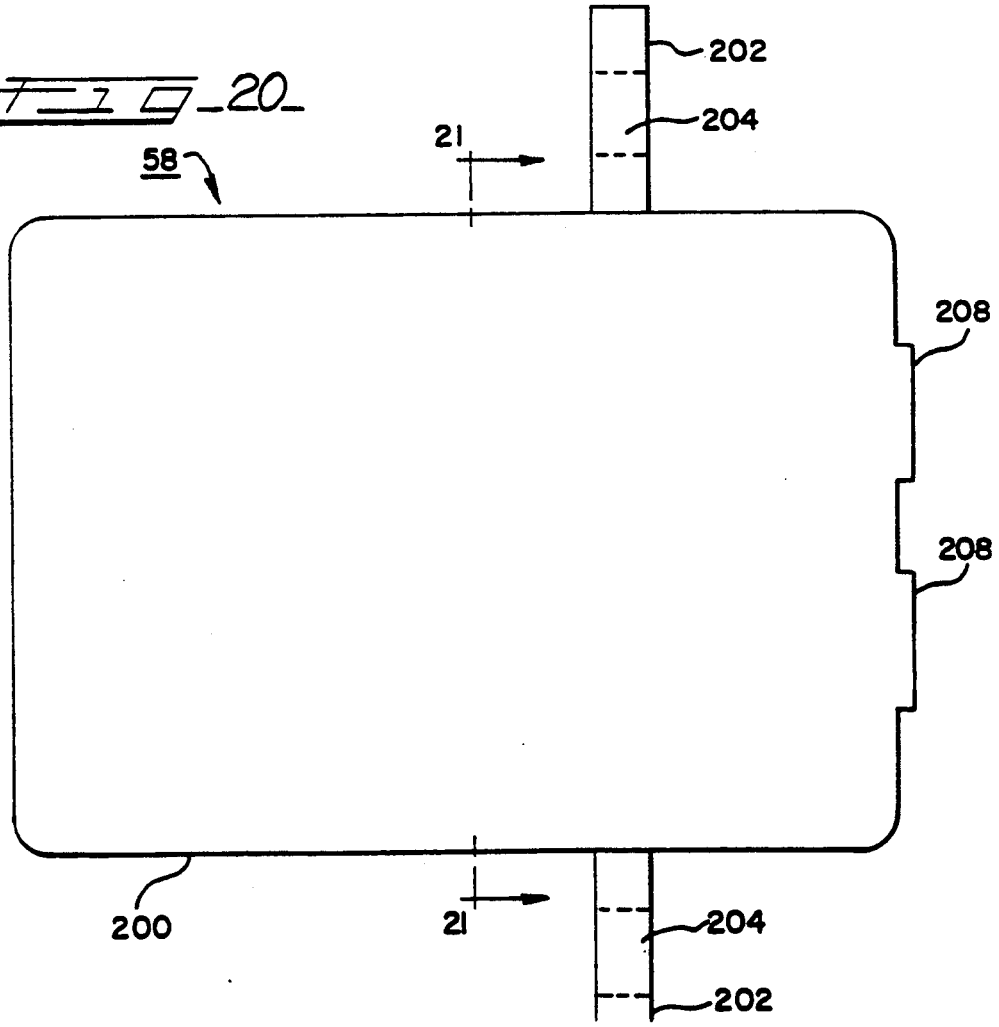
FIG. 20 is a side view of one side of a magnetic field sensor assembly.

FIG. 20 is a view of one side of the magnetic field sensor 58. As shown in FIG. 20 the magnetic field sensor 58 has an outer shell 200 within which are mounted various components described below in connection with FIGS. 22 through 26. The outer shell 200 has two attachment ears 202. Each attachment ear 202 defines a recess 204 for receiving a mounting screw 206 to hold the magnetic field sensor 58 in place adjacent to the token track 54 or the token track 112. The outer shell 200, and the mounting screws 206 shown in FIGS. 11 and 12, are preferably made of non-magnetic materials such as (in the case of the outer shell 200) plastic and (in the case of the mounting screws 206) aluminum.

The outer shell 200 has two faces 208 formed so that, when the sensor shell 200 is mounted adjacent to the token chute 54 or the token chute 112, the faces 208 are adjacent to one wall of the token chute 54 or the token chute 112 adjacent the inclined token track base 56. This location of the sensor 208 is described in greater detail below.

Figure 21:
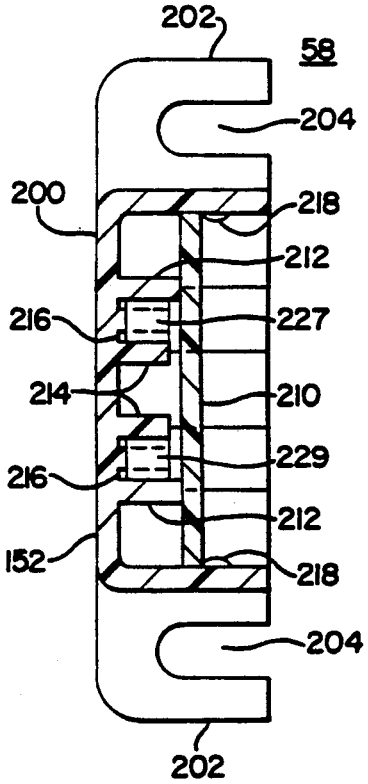
FIG. 21 is a sectional view, taken along the line 21—21 of FIG. 20, of a magnetic field sensor assembly, as shown in FIGS. 11 and 12, (in broken lines) in FIG. 14, (in a simplified cross-sectional view) in FIG. 19, and (in side view) in FIG. 20.

FIG. 21 is a cross-sectional view of the magnetic field sensor 58 taken along the line 21—21 shown in FIG. 20. As shown in FIG. 21 the outer shell 200 contains and holds permanent magnets 227 and 229 and a circuit board 210. The permanent magnets 227 and 229 are each wide enough to fit snugly within, and to be retained by, their respective large rib 212 and medium rib 214, which are formed integrally with the outer shell 200. A small rib 216, also formed integrally with the outer shell 200, further assists in holding each magnet 227 and 229 in position. The circuit board 210 also fits snugly within the outer shell 200, in which it is retained by the large ribs 212 and the bosses 218. Various electronic components, described below in connection with FIGS. 25 or 26 but not shown in FIG. 21, are mounted on the circuit board 210. FIG. 21 also shows the ears 202 with their recesses 204, which are not in the plane of the section 21—21 shown in FIG. 20.

Figure 22:
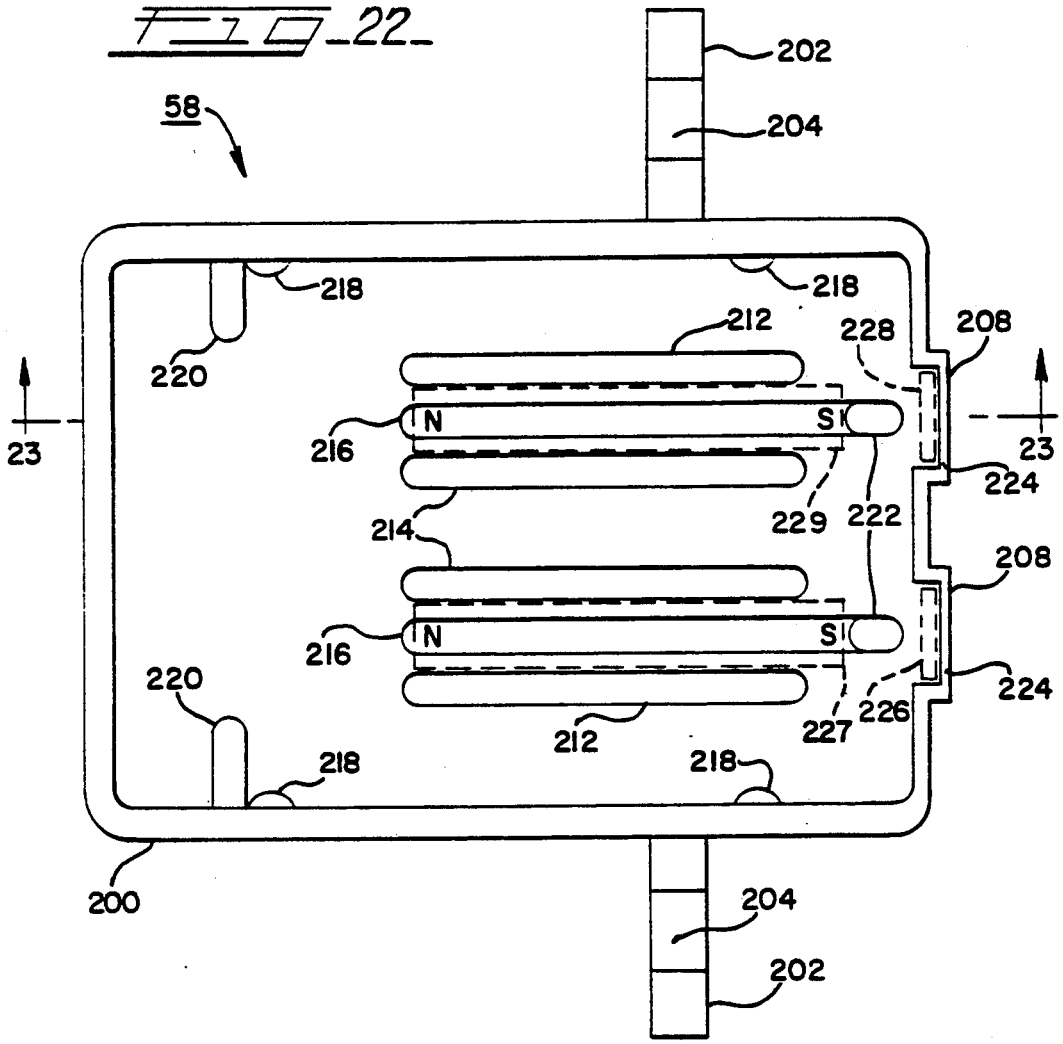
FIG. 22 is a side view, from the other side than the side shown in FIG. 20, of a magnetic field sensor assembly, with many parts removed for clarity.

As shown in FIG. 21, the outer shell 200 has internal structure not visible in the side view shown in FIG. 20. FIG. 22 shows much of that internal structure.

FIG. 22 is a view of the outer shell 200 from the other side than the side view shown in FIG. 20. In the view shown in FIG. 22 the circuit board 210 is removed for clarity. FIG. 22 shows more clearly the location of the bosses 218 which support the circuit board 210 and also shows lateral ribs 220 which provide additional mechanical support for the circuit board 210. FIG. 22 also shows the degree of longitudinal extension of the large ribs 212, the medium ribs 214, and the small ribs 216 which, as shown in FIG. 21, define the position in which the permanent magnets 227 and 229 are held. Each small rib 216 has a projecting portion 222 which projects out of the plane of FIG. 22 toward the viewer. Each projecting portion defines the distance between one end of a magnet 227 or 229 and the associated sensor face 208. The location within which each magnet 227 and 229 will be held, when installed, is shown (in broken lines) in the outlines labeled 227 and 229 shown in FIG. 22.

As also shown in FIG. 22 each sensor face is adjacent a wall portion 224 in which the wall of the outer shell 200 is thinner than in other areas. The outer shell 200, with its ribs 212, 214, and 216, and with the integral projecting portion 222 of the small rib 216, are formed so that the magnets 227 and 229 are held snugly within the ribs 212, 214, and 216 and the projecting portion 222. Any separation in FIG. 22 between the lines of elements 212, 214, 216, and 222 on the one hand, and the broken lines indicating the outlines of the magnets 227 and 229 on the other hand, is solely for clarity and does not indicate an actual space between those elements and the magnets 227 and 229 in the actual magnetic sensor unit 58.

When the circuit board 210 is mounted in the outer shell 200, it rests as described above, on the large ribs 212, the bosses 218, and the lateral ribs 220. Two Hall-effect sensors 226 and 228 are mounted on the circuit board 210 in such a way that, when the circuit board 210 is mounted in the outer shell 200, the two Hall-effect sensors 226 and 228 occupy the area shown by the outlines in broken lines labeled 226 and 228 in FIG. 22. This location places each Hall-effect sensor 226 and 228 between one pole of a magnet 227 or 229, respectively, and the thin portion 224 of the wall of the outer shell 200 with the associated face 208. Each Hall-effect sensor 226 and 228 is mounted so that its active face (that is, the face of the Hall-effect sensor which is most sensitive to magnetic fields) faces the thin portion 224 and the face 208.

As also shown in FIG. 22, each magnet 227 and 229 is mounted with a like pole (in the embodiment shown in FIG. 22, the south pole) mounted closer to the face 208.

Figure 23:
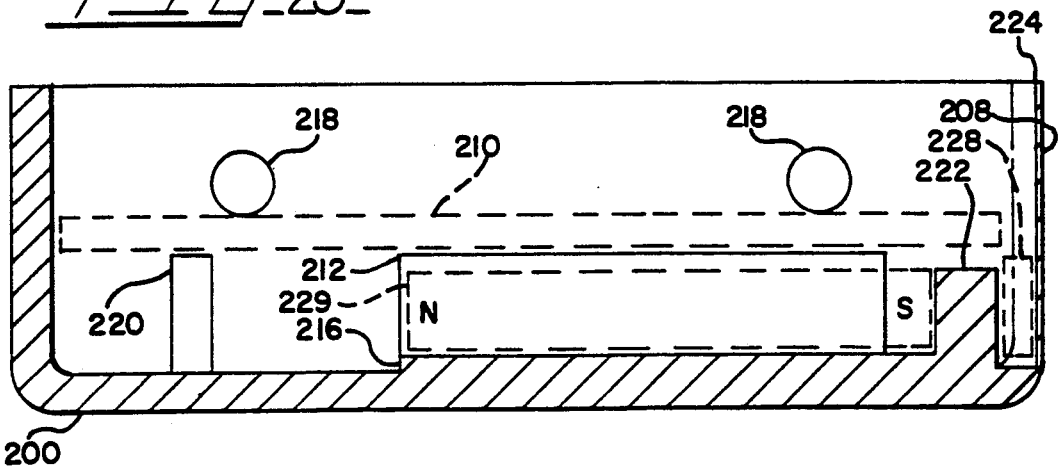
FIG. 23 is a cross-sectional view, taken along the line 23—23 of FIG. 22, of the portion of the magnetic field sensor assembly shown in FIG. 22.

FIG. 23 is a cross-sectional view of the outer shell 200 shown in FIG. 22 along the line 23—23 shown in FIG. 22. In addition to the elements 200, 208, 216, and 222, previously described, which are shown directly in the cross-section 23—23, FIG. 23 also shows the elements 212, 218, and 220, previously described, in planes behind the plane of the cross-section 23—23. As in FIG. 22, the broken outlines 229 and 228 indicate the locations occupied by, respectively, the magnet 229 and the Hall-effect sensor 228 when they are inserted in the outer shell 200. A broken outline shows the location occupied by the circuit board 210 when it is inserted in the outer shell 200. As with FIG. 22, it is only for clarity that: (1) the dashed lines of the outline of the permanent magnet 229 are separated from the small rib 216 and the projecting portion 222; and (2) the dashed lines of the circuit board location 210 are separated from the lateral rib 220 and from the large rib 212.

The Hall-effect sensor 228, shown in outline in FIG. 23, has three lines which lead to the circuit board 210 when the Hall-effect sensor 228 is mounted on the circuit board 210. Those lines are not shown in FIG. 23 but may lead to either surface of the circuit board 210. In practice, those lines also serve to hold the Hall-effect sensor 228 in the position shown in outline in FIG. 23 when the circuit board 210 is inserted as shown in outline in FIG. 23.

The various features formed integrally with the outer shell 200 serve an important function in controlling the operation of the Hall-effect sensors 226 and 228. Because the circuit board 210 and the outer shell 200 are formed so that the circuit board 210 fits precisely and in a predetermined relationship to the outer shell 200, the Hall-effect sensors 226 and 228 will, when the circuit board 210 is mounted in the outer shell 200, be located in a precise, predetermined relationship to the thin portion 224 of the outer shell 200.

The projecting portions 222 of the small ribs 216 establish the closest distance that the permanent magnets 227 and 229 reach to the Hall-effect sensors 226 and 228, respectively. The projecting portions 222 are also formed in the outer shell 200 to regulate the closest distance which a pole of a magnet 227 or 229 may approach to a sensor face 208.

Keeping the nearest pole of a permanent magnet 227 or 229 no closer than this predetermined distance from a face 208 helps to prevent tokens 37 or 39 made of ferrous metal from becoming stuck in the magnetic field of one or both of the magnets 227 and 229 and thus being held against a sensor face 208. Such magnetic capture of a ferrous metal token 37 or 39 could block the token chute 54 or the token chute 112 and can in any event interfere with proper assessment of whether to accept or reject the token.

The precisely controlled distance between the active face of each Hall-effect sensor 226 and 228 and the south pole of the corresponding magnet 227 and 229 assures that the magnetic field at the active face of each Hall-effect sensor is precisely controlled. Likewise, the precisely-controlled distance (established as described below) between the south pole of each magnet 227 and 229 and the inclined token track base 56 assures that the magnetic field through which a token 37 or 39 passes while rolling down the inclined token track base 56 is also precisely controlled. These two controlled distances assure that the change in magnetic field at the active face of each Hall-effect sensor 226 and 228 as a token 37 or 39 rolls past will relatively accurately reflect the magnetic characteristics of the token 37 or 39.

A Hall-effect sensor which may be used with the magnetic field sensor 58 is a UGN 3503, and a permanent magnet which may be used with the magnetic field sensor is a Hamlin Inc. PN-H33 alnico magnet. The south pole of each magnet 227 and 229 is mounted near its respective Hall-effect sensor 226 or 228. Mounting a like pole of each magnet 227 and 229 near the faces 208 further reduces the possibility that a ferrous-metal token 37 or 39 will be held magnetically near the sensor face 208. With the Hamlin PN-H33 alnico magnet the following spacings are effective in promoting the operation of the magnetic field sensor 58 and in avoiding magnetic capture of tokens in the magnetic fields of the magnets 227 and 229: (1) the thickness of the thin wall 224 of the outer shell 200: 0.015 inch; (2) the distance between inactive face of Hall-effect sensor 226 or 228 and south pole of magnet 227 or 229, respectively: 0.170 inch.

Moreover, placing like poles of the magnets 227 and 229 toward their respective Hall-effect sensors 226 and 228 better focuses the magnetic field at the active face of each Hall-effect sensor 226 and 228 and in the region of the token track 54 or 91 in which a token will roll past the magnetic field sensor 58.

Figure 24:
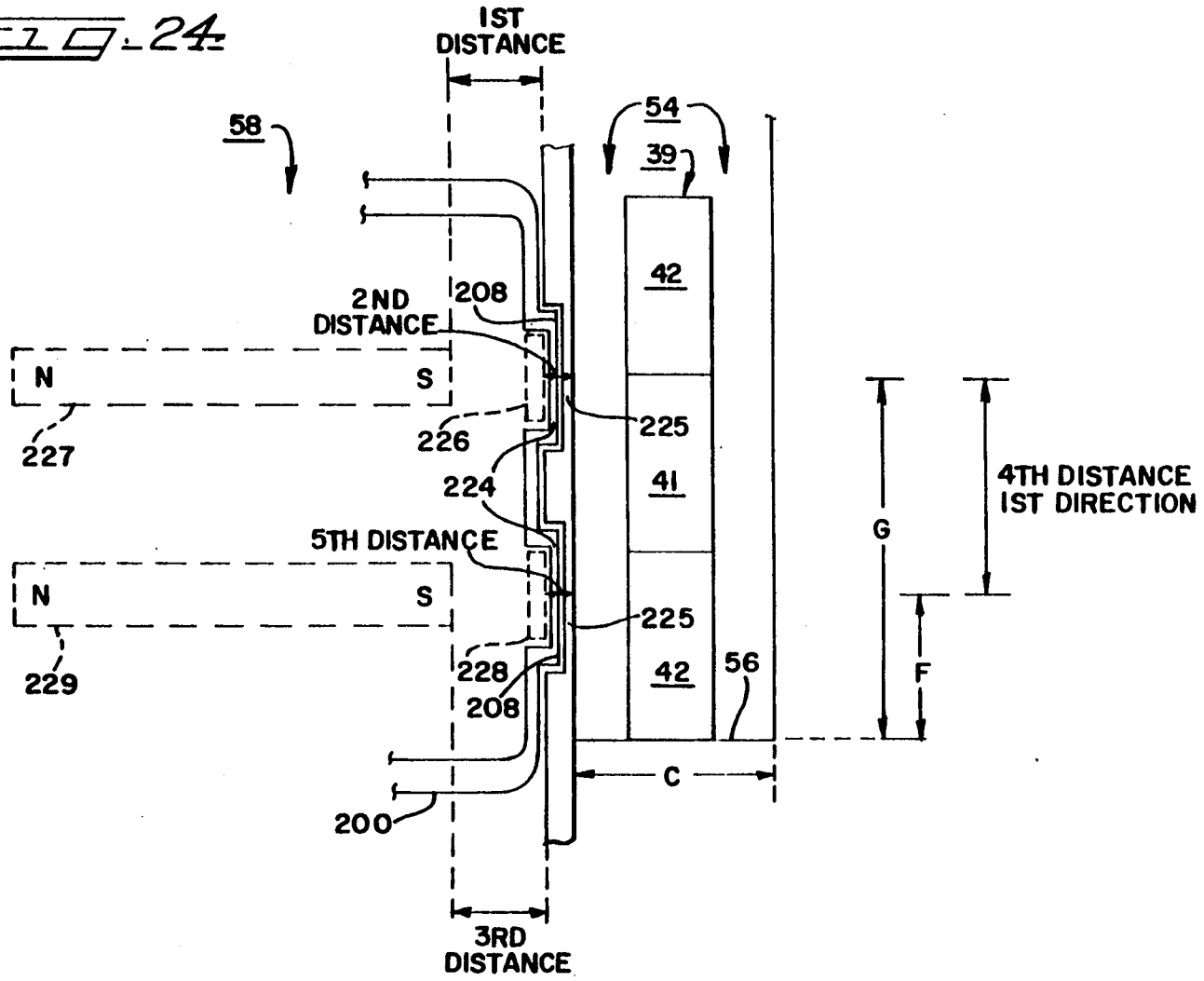
FIG. 24 is a view of part of the magnetic field sensor assembly mounted near the token chute.

FIG. 24 is a simplified view of the position of the two Hall-effect sensors 226 and 228 and of the permanent magnets 277 and 229 relative to the inclined token track base 56 when the magnetic field sensor 58 is mounted adjacent to the token track chute 54 or the token chute 112. As shown in FIG. 24, the active face of each Hall-effect sensor 226 and 228 faces the token chute 54 or 112 but is separated from the interior of the token chute 54 or 112 by the thin wall 224 of the outer shell 200 and by a portion 225 of one wall of the token chute. The thickness of the thin side 224 of the outer shell 200 and of the portion 225 of the wall of the token chute are carefully controlled in manufacturing to assure proper operation of the magnetic field sensor 58. A thickness of 0.015 inch is effective for the wall portions 225.

As also shown in FIG. 24, the center of the active face of each Hall-effect sensor 226 and 228 is positioned above the inclined token track base 56 in relation to the dimensions of a token 39 which the token actuated device is intended to accept as valid. Precise dimensions will vary depending on (a) the parameter N for a token 39 which is to be recognized as valid; (b) the magnetic characteristics of the inner portion 41 and outer portion 42 of such a token 39, and (c) the magnetic characteristics of other types of tokens which are likely to be inserted in the token-actuated device but which the token-actuated device is not to accept as valid.

The choice of the distance from the inclined token track base 56 to the center of the active face of each Hall-effect sensor 226 and 228 will depend on these and other factors noted above, which reflect the magnetic response of the materials from which the valid tokens 39 are made and from which common types of invalid tokens are made. The distances F and G shown in FIG. 24 are selected so that each Hall-effect sensor 226 and 228 will register a representative signal even if the token 39 is bouncing to a small extent, rather than simply rolling, down the inclined token track base 56. As an example, if arranged to detect a New York City subway token, the distance F is approximately 0.12 inch, and the dimension G is approximately 0.52 inch. Other dimensions F and G are possible and should be optimized for particular applications.

The width C of the inclined token track base 56 should be selected to minimize the extent to which a token 37 or 39 can have the plane of its token disk tilted from perpendicular to the inclined token track base 56. Excessive tilting of the plane of the disk of a token 37 or 39 can slightly impair the proper response of the Hall-effect sensors 226 and 228. Moreover, a token 37 or 39 tilted too much may slightly impair the proper response of the Hall-effect sensors 226 and 228. Furthermore, a token 37 or 39 is somewhat more likely to become stuck in the magnetic field of one or both of the magnets 227 and 229, and thus to stop rolling down the token chute 54 or 112, if the plane of the token disk is able to tilt through too great an angle. Too narrow a width C of the inclined token track base 56 can also lead tokens to become stuck in the token chute 54 or 112 either due to friction between the tokens 37 or 39 and the token chute 54 or 112 or due to magnetic capture by the magnetic fields of either or both of the magnets 227

Figure 25:
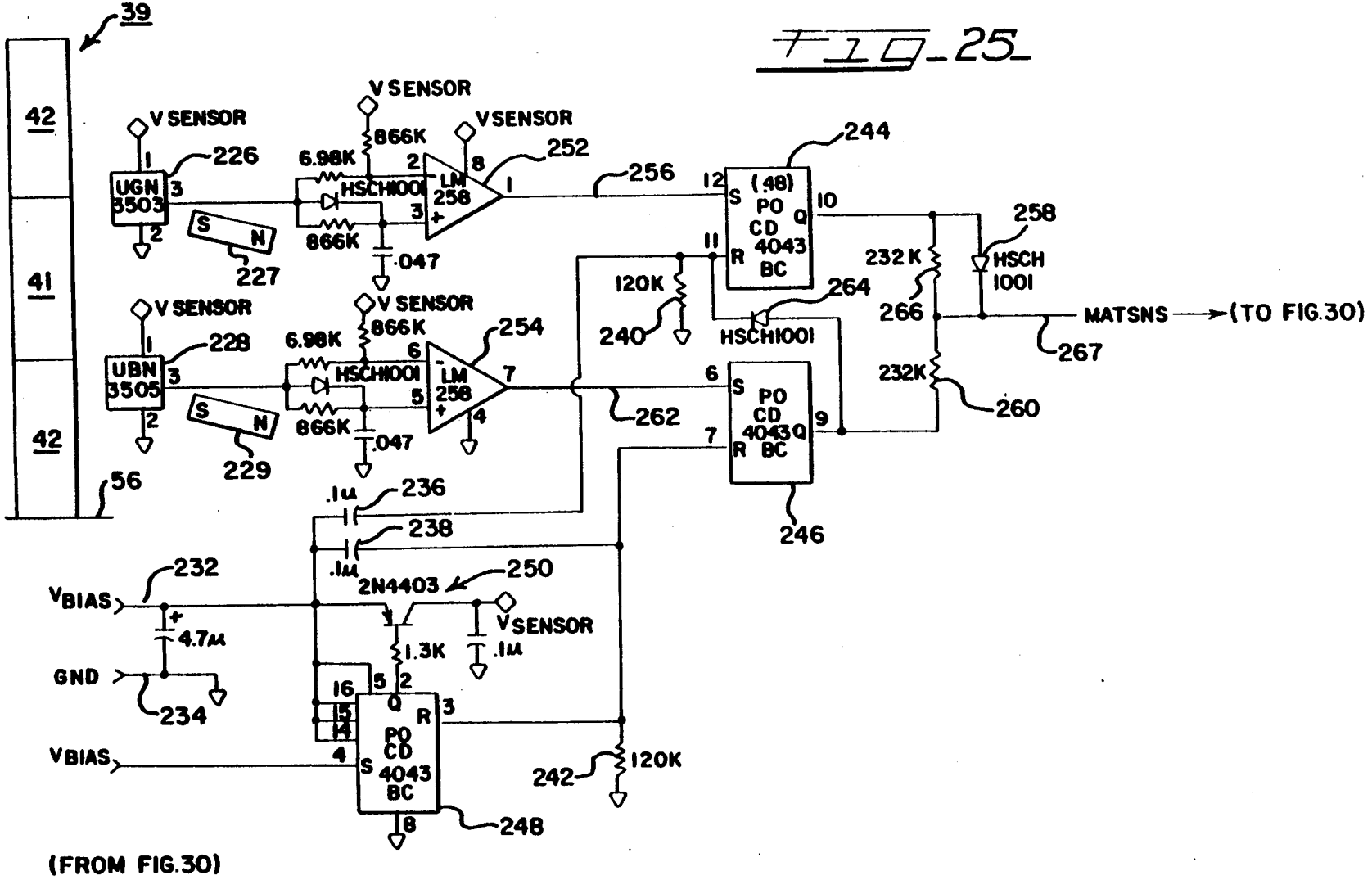
FIG. 25 is a schematic diagram of electronic components which may be used to produce output signals from the magnetic field sensor assembly.

FIG. 25 is a schematic diagram of one embodiment of the electronic circuit which evaluates the signals from the Hall-effect sensors 226 and 228 and provides appropriate signals to the control unit 230 described below in connection with FIG. 30. The three electric leads (not shown in FIGS. 20 through 24) from each Hall-effect sensor 226 and 228 are connected on the circuit board 210 with the elements shown in FIG. 25, which are mounted on the circuit board 210 (but which are also not shown in FIGS. 20 through 24). Although these electronic components can in principle be mounted on the circuit board 210 on either the side facing toward the permanent magnets 227 and 229 or the side facing away from the permanent magnets 227 and 229, it has been found convenient to mount the components on the side facing away from the permanent magnets 227 and 229, and to cover those components, and that entire side of the circuit board 210, with a protective substance such as a plastic or epoxy to protect the electronic components.

The components shown schematically in FIG. 25 receive from the control unit 230, described below in connection with FIG. 30, a power connection $V_{bias}$ and a control sign $V_{mem}$. The components shown schematically in FIG. 25 produce an analog signal MATSNS, which leads to the control unit 230 and is utilized by that control unit 230 in the manner described below. The signal MATSNS has three levels; each level indicates a different combination of magnetic characteristics detected in a token 37 or 39 which has rolled past the Hall-effect sensors 226 and 228.

If the signal MATSNS has the voltage $V_{sensor}$, only the upper Hall-effect sensor 226 detected a magnetic response as a token rolled past. This indicates that the token is a token such as the token 39 and that the inner portion 41 of that token 39 is made of a magnetically responsive material, such as a ferrous metal, but that the outer portion 42 of that token 39 is made of a magnetically non-responsive material, such as copper.

If the signal MATSNS has the voltage $V_{sensor}/2$, both the upper Hall-effect sensor 226 and the lower Hall-effect sensor 228 have detected a magnetic response as a token rolled past. This may indicate that the token is a token such as token 39 and that both the inner portion 41 and the inner portion 41 of that token 39 are made of a magnetically responsive material such as a ferrous metal. Alternatively, a voltage $V_{sensor}/2$ of the signal MATSNS may indicate that that token is a token such as the token 37 which is entirely made of a magnetically responsive material such as a ferrous metal. Because all Canadian coins contain iron, while no United States coins contain iron, the magnetic field sensor 58 is particularly useful in distinguishing Canadian coins from United States coins.

If the signal MATSNS has the voltage 0, this indicates that neither the upper Hall-effect sensor 226 nor the lower Hall-effect sensor 228 has detected a magnetic response as the token rolled past. This may indicate that that token is a token such as the token 39 in which neither the outer portion 41 nor the inner portion 42 are made of a magnetically responsive material such as a ferrous metal. Alternatively, the value 0 of the signal MATSNS may indicate that that token was a token such as the token 37 made entirely of a magnetically non-responsive material.

The circuit shown in FIG. 25 operates as follows. Before the wake-up signal indicates that the token insertion slot lever 47 or 94 is no longer in its lowered position, no voltage is applied on line 232 (that is, line 232 and line 234 are at the same potential). When the wake-up signal indicates that the token insertion slot lever 47 or 94 is no longer in its lowered position, the control unit 230 (shown in FIG. 30 and described below) applies a voltage $V_{bias}$ to line 232. The increase in voltage (relative to line 234) from zero to $V_{bias}$ on the line 232 drives a pulse of current through the capacitors 236 and 238 and the resistors 240 and 242.

This pulse of current raises the potential above the resistors 240 and 242; this pulse of high potential above the resistors 240 and 242 activates the reset inputs of each of the SR flip-flops 244, 246 and 248. This resetting of the SR flip-flops 244, 246, and 248 resets the electronic system depicted in FIG. 25 in a predetermined, known state, irrespective of the state which the flip-flops 244, 246, and 248 may have been in before the resetting occurs. The components 236, 238, 240, and 242 are selected to apply a reset signal to flip-flops 244, 246, and 248 for a time exceeding that required for amplifier stabilization on power-up.

When the SR flip-flop 248 is reset, its Q output goes low, turning on transistor 250 and applying the voltage $V_{sensor}$ to the $V_{bias}$ inputs to the upper Hall-effect sensor 226 and to the lower Hall-effect sensor 228. With the application of this voltage to their bias inputs, the outputs of the Hall-effect sensors 226 and 228 on their output pins 3 go high, which maintains the outputs of their respective operational amplifiers 252 and 254 low. With those outputs low, the set inputs to SR flip-flops 244 and 246 remain low, and the SR flip-flops 244 and 246 remain in the reset state, in which they were placed or confirmed by the pulse of current when the potential on line 232 rose from ground to $V_{bias}$. In their reset state the Q outputs of the SR flip-flops 244 and 246 are low. With the Q outputs of both SR flip-flops 244 and 246 low, the signal MATSNS remains high.

Consider first the case in which a token which has no magnetic effect rolls past the active faces of the Hall-effect sensors 226 and 228. In that case the output of those sensors remains high and, as described above, the signal MATSNS remains low. Thus, when the signal MATSNS remains low after the wake-up signal is activated, this indicates that either (a) a token with no magnetic characteristics has been inserted or (b) no token at all has been inserted and that someone may be attempting to manipulate the token insertion slot lever 47 or 94.

Consider next the case in which a token such as the token 39 (which has an inner portion 41 which is magnetically responsive but an outer portion 42 which is not magnetically responsive) rolls past the Hall-effect sensors 226 and 228. In this case the upper Hall-effect sensor 226 generates a signal indicating the passage of the magnetically responsive inner portion 42 of that token 39 (the signal on the output pin 3 of the Hall-effect sensor 226 will first go low as the token passes and then return high after the token has rolled past). However, the lower Hall-effect sensor 228 does not generate a responsive signal because substantially only the magnetically non-responsive outer portion 42 passes in front of the lower Hall-effect sensor 228.

In response to these changes in the voltage on pin 3 of the upper Hall-effect sensor 226 the operational amplifier 252 produces a signal on line 256 which first goes high and then returns low again. That signal in turn activates the set input to the SR flip-flop 244, which in turn drives the Q output of SR flip-flop 244 high. Because the Q output of the other SR flip-flop 246 is still low, the diode 258 conducts, driving MATSNS high to the voltage $V_{sensor}$ as current flows through the diode 258 and the resistor 260 to the Q output of flip-flop 246, which remains low. Thus, when the signal MATSNS goes high (to $V_{sensor}$) after the wake-up signal has been activated, this indicates that a token such as token 39 with a magnetically responsive inner portion 41 but a magnetically non-responsive outer portion 42 has rolled past the Hall-effect sensors 226 and 228.

Consider finally the case in which a token such as a token 39 which has an inner region 41 and an outer region 42 which are both magnetically responsive (or, alternatively, a token such as a token 37 which is made uniformly of a magnetically responsive material) rolls past the Hall-effect sensors 226 and 228. In this case the output pin 3 of each Hall-effect sensor 226 and 228 will go low as the token approaches and then return high after the token rolls past. Each operational amplifier 252 and 254 will thus produce an output signal which first goes high and then returns low. The output of the operational amplifier 252 for the upper Hall-effect sensor 226 will go high first (because the leading edge of the token, which is magnetically responsive, will pass the upper Hall-effect sensor 226 before the lower Hall-effect 228 detects any change in magnetic field). As the set input to the SR flip-flop 244 goes high, the Q output of the SR flip-flop 244 also goes high.

Shortly thereafter, the output of the operational amplifier 254 for the lower Hall-effect sensor 228 will go high, putting its output line 262 and the set input of SR flip-flop 246 high. This in turn places the Q output of SR flip-flop 246 high; diode 264 conducts, driving the reset input of SR flip-flop 246 high and resetting the Q output of SR flip-flop 244 low. Current then flows from the high potential of the Q output of SR flip-flop 246 to the low potential of the Q output of SR flip-flop 244. The resistors 260 and 266 act as a voltage divider (diode 258 does not conduct), and the resulting voltage of the signal MATSNS is $V_{sensor}/2$.

Thus, when the signal MATSNS assumes the voltage $V_{sensor}/2$ after the wake-up signal is activated, this indicates that a token such as a token 39 has been deposited which has an inner portion 41 and an outer portion 42 which are both magnetically responsive or that a token such as a token 37 has been deposited which is made of a magnetically responsive material. For other applications the values of the resistors 260 and 266 may be chosen to be other than equal to produce a voltage-divided value of the voltage of MATSNS at a value between V and 0 other than $V_{sensor}/2$ for the case in which both Hall-effect sensors 226 and 228 produce a signal.

When the control unit 230 described in connection with FIG. 30 asserts a signal $V_{mem}$ high—which, as described below, occurs when the control unit 230 applies power to a memory unit—the set input to SR flip-flop 248 goes high, which sets the Q output of SR flip-flop 248 high. This in turn turns off transistor 250 and thus terminates the bias current which flows through the components shown in FIG. 25 when the transistor 250 conducts. Turning off the transistor 250 conserves current when the parking meter 10 is not required to evaluate tokens being inserted.

Figure 26:
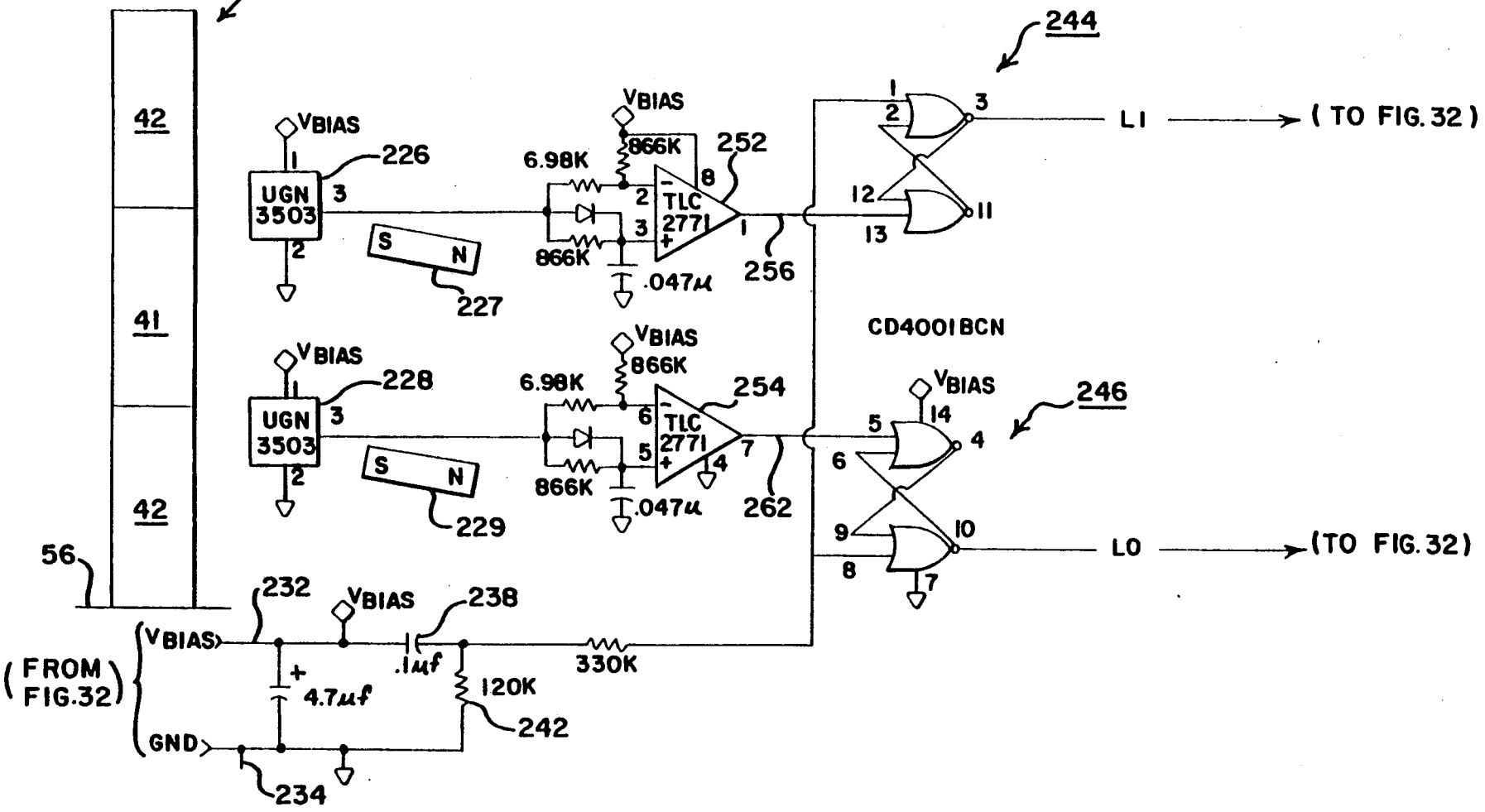
FIG. 26 is a schematic diagram of an alternative embodiment of electronic components which may be used to produce output signals from the magnetic field sensor assembly.

FIG. 26 shows an alternative circuit for conveying signals to a control unit. The circuit shown in FIG. 26 is shown exchanging signals with the control unit 272 for the alternate parking meter 89. The control unit 272 is shown schematically in FIG. 32 and described below in connection with that Figure. Those skilled in the art will appreciate that (with appropriate modifications) the circuit shown in FIG. 26 may be connected to the control unit 230, and that the circuit shown in FIG. 25 may be connected to the control unit 272.

The elements in FIG. 26 which have the same part number as the elements in FIG. 25 are the same as the elements just described in connection with FIG. 25, although the SR flip-flop 246 and 248 and the operational amplifiers 252 and 254 may (as shown in FIG. 26) be other commercially-available products. In the circuit shown in FIG. 26, when the control unit 272 applies the potential $V_{bias}$ to the line 232, the flip-flops 244 and 246, and the signals L0 and L1, are reset as described above in connection with FIG. 25 so that the circuit shown in FIG. 26 can properly assess the magnetic characteristics of the next token. The values of capacitor 238 and resistor 242 are selected, as also described above in connection with FIG. 25, to apply a reset signal for a time exceeding that required for amplifier stabilization. When the amplifiers have stabilized, the output of the operational amplifiers 252 and 254 is low so long as the Hall-effect sensors 226 and 228 detect no magnetically responsive portion of a token passing their respective sensor faces 208. The output signals L0 and L1 are accordingly low.

Assume that a token 39 with a magnetically responsive inner portion 41 passes the Hall-effect sensors 226 and 228. In this case, the signal from the operational amplifier 254 for the lower Hall-effect sensor 228 does not change; L0 accordingly remains low. But the signal from the operational amplifier 252 for the upper Hall-effect sensor 228 goes momentarily high and then low again. This changes the state of the SR flip-flop 244 and drives L1 high. Thus, if, after the wake-up signal is activated, L0 remains low while L1 goes high, this indicates that a token such as a token 39 with a magnetically responsive inner portion 41 but a magnetically non-responsive outer portion 42 has rolled, past the Hall-effect sensors.

Assume that a token such as a token 39 with an inner portion 41 and an outer portion 42 which are both magnetically responsive rolls past the Hall-effect sensors 226 and 228. In this case the output of each operational amplifier 252 and 254 goes high; both SR flip-flops 244 and 246 change states; and the levels on the outputs of both SR flip-flops 244 and 246 go high. Both signals L0 and L1 accordingly go from low to high. Thus, if both L0 and L1 go from low to high after the wake-up signal is activated, this indicates that a token such as a token 39 having an inner portion 41 and an outer portion 42, both of which are magnetically responsive (or alternatively a token such as a token 37 which is uniformly made of magnetically responsive material), has rolled past the Hall-effect sensors 226

At an appropriate time, described below in connection with FIG. 33, the control unit 272 removes the potential $V_{bias}$ from line 232. This removal of $V_{bias}$ eliminates the current drain caused by leaving the elements shown in FIG. 26 under power.

Those skilled in the art will appreciate that a magnetic field sensor could be built by omitting from the magnetic field sensor 58 one Hall-effect sensor and its associated permanent magnet and by making suitable simplifications in the circuits shown in FIGS. 25, 26, 30, and 32. Such a magnetic field sensor would assist in detecting tokens made of ferous metal even in token-actuated devices which do not need to be able to detect tokens such as the token 39.

Moreover, while it is preferable to manufacture the magnetic field sensor 58 as an assembly within the outer shell 200, an equivalent magnetic field sensor can be made by mounting the Hall effect sensors 226 and 228, and the permanent magnets 227 and 229, directly in the token track unit 45 and 91.

The amplifiers 252 and 254 shown in FIGS. 25 and 26 have a gain of about 20,000 at low frequencies. They are biased as shown in FIG. 25 and 26 so that the power-on stabilization time for the amplifiers is short.

The Area Sensor 60

The area sensor 60 is an infrared area sensor. It has a light-source end 108 and a light-sensing end 110 which, as shown in FIGS. 10 and 11, are mounted facing each other on opposite sides of the token chute 54 or 112. The light-source end 108 contains at one end a source of infrared light, such as a light-emitting diode, which illuminates an area at the other end of the light-source end 108. The light-source end 108 is mounted in mounting ring 62 on one side of the token chute 54 or 112 in a region which the token 37 or 39 will roll past. The area which the light-source end 108 illuminates is thus the area-sensing region 59 of the token chute 54 or the token chute 112, as shown in FIGS. 5, 6, and 12 through 14.

The light-sensing end 110 of the area sensor 60 holds an element, such as an infrared phototransistor, which generates an electrical signal responsive to the amount of infrared light from the light-source end 108 which falls on the photodiode. The light-sensing end 110 is mounted on the other side of the token chute 54 or the token chute 112 in the area-sensing region 59. As a token 37 or 39 rolls past the area-sensing region 59, the token 37 or 39 blocks some of the infrared light being emitted by the light-source end and the light-sensing end 110 generates an electrical signal which is indicative of the changing amount of infrared light which reaches the light-sensing end 110 as the token rolls past. That electrical signal is thus indicative of the area of the token 37 or 39. As shown below in FIGS. 30 and 32, this electrical signal leads to the control unit 230 of FIG. 30 or 272 of FIG. 32.

The way in which the area sensor 60 operates is described in the Shah, Pester, and Stern patent. In the Shah, Pester, and Stern patent particular attention should be given to the materials relating to the area sensor at col. 1, lines 39 through 60; col. 2, lines 1 through 25; col. 3, lines 53 through 56 and line 63 through col. 3, line 10; col. 5, line 65 through col. 7, line 5; col. 7, line 63 through line 67; and col. 9, line 15 through line 33. As used herein the term "area sensor 60" comprises the LED driver and LED labelled 26, the photo sensor labelled 28, and the amplifier U1 labelled 30 in the Shah, Pester, and Stern patent.

The improved design of the token unit 54, described above, improves the operation and accuracy of the area sensor 60 when that area sensor 60 is used as described herein and in the portions of the Shah, Pester, and Stern patent just mentioned.

A significant problem in achieving repeatable and reproducible (in the senses of those terms define above) operation of such an area sensor 60 is controlling the motion of a token as the token passes through the area sensing region 59 of the token unit 54. Commercially-available infrared light-source portions 108 and infrared light-sensing portions 110 do not produce a completely uniform infrared illumination in the area sensing region 59. Instead, there tend to be "hot" spots in that region 59 in which the intensity of infrared light is slightly greater than the average over the region 59 and "cold" spots in the region 59 in which the intensity of infrared light is slightly lower than the average across the entire area-sensing region 59. If the same token passes through the area-sensing region 59 on two paths which differ in the extent to which the token disk eclipses "hot" spots and "cold" spots, the signal output from the light-sensing end 110 will not be the same for those two paths. Such differences in output can impair repeatable and reproducible analysis of token characteristics.

As described below in connection with FIG. 30, the control unit 230 or 272 determines whether to recognize a token as valid (and, if valid, what value to recognize for the token) or as invalid by comparing signals from the token characteristic sensors with predetermined parameters of valid and/or of invalid types of tokens stored in a memory. The effectiveness of comparisons between signals generated by a travelling token and predetermined, stored parameters is greatly reduced when the token characteristic sensors do not produce repeatable and/or reproducible signals.

The improvements in the vertical portion 55 of the token chute 54 or 112 proceed from the realization that controlling the velocity and path of an inserted token are more important than improving the operation of the token characteristic sensors.

The improvements in the vertical portion 55 of the token chute 54 or the token chute 112 control the motion of an inserted token so that the token, as it travels down the inclined token track base 56, tends to vibrate rapidly from side to side within the token chute 54 or the token chute 112 rather than bouncing up and down between the top of the token chute 54 or the token chute 112 and the inclined token track base 56. This greatly reduces the possibility that the same token (or different tokens of the same type of token) will follow substantially different paths when travelling (a) past the magnetic field sensor 58 and (b) through the area-sensing region 59. Such control of the path followed by a token greatly increases the likelihood that the magnetic field sensor 58 will produce accurate output signals and also greatly reduces the variability in the signal output from the light-sensing end 110 of the area sensor 60. This greatly improves accuracy in using signals from the magnetic field sensor 58 and from the area sensor 60 to evaluate whether a token should be accepted or rejected. The side-to-side vibrations of a token in practice have little or no significant effect on the signal output from the magnetic field sensor 58 and the area sensor 60.

The improvements in the vertical portion 55 of the token chute 54 or the token chute 112 also control the velocity with which each token 37 or 39 will roll down the inclined token track base 56 past the magnetic field sensor 58 and the area sensor 60. Such controlled velocity further assists in improving the repeatability and reproducibility of decisions to recognize a particular token and tokens of a particular type as valid or as invalid.

The Mass Sensor 64

The mass sensor 64—used in the parking meter 10 but not in the parking meter 89—is of the type described in the Shah, Pester, and Stern patent. Particular attention should be given to the discussion of the mass sensor 64 in the Shah, Pester, and Stern patent at col. 1, line 27 through line 38; col. 2, line 4 though line 11 and line 20 through line 28; col. 3, line 44 through line 52; col. 5, line 12 through line 63; col. 7, line 61 through col. 8, line 7; col. 9, line 1 through line 12.

Of course, in contrast to the location of the piezoelectric mass sensor in the machine disclosed in the Shah, Pester, and Stern patent, in the embodiment of the invention described herein the mass sensor 64 is located after the end of the inclined token track base 56 of the token chute 54, and thus the token 37 or 39 impacts the mass sensor 64 after rolling down that inclined token track base 56 rather than after falling directly down a token chute as disclosed in the Shah, Pester, and Stern patent. Placing the mass sensor 64 in this location takes advantage of the control over token velocity and token path which the improvements in the vertical portion 55 of the token chute 54 and the token chute 112 provide. With the mass sensor 64 in this location a user cannot significantly influence the impact of a token on the mass sensor 64 by snapping a token in through the token insertion slot 22.

Those skilled in the art will readily appreciate that the signal output from the mass sensor 64 over its output lines 134 and 136 will be different for a token of a given type than the output of the piezoelectric mass sensor in the location disclosed in the Shah, Pester, and Stern patent. Those skilled in the art will also readily appreciate how to make appropriate adjustments in the electronics and/or software (described below in connection with FIGS. 30 through 33) so that those electronics will properly evaluate the signal produced by the mass sensor 64 for tokens of a given type.

The Plate 76

The parking meter 10, but not the parking meter 89, includes the token selection region 66 and the token acceptance slot 72 with their associated parts.

As discussed above in connection with FIGS. 5 and 6, the position of the plate 76 controls whether a token falls into the token vault in the vault section 30 or returns to a user through the token return slot 26.

Figure 27:
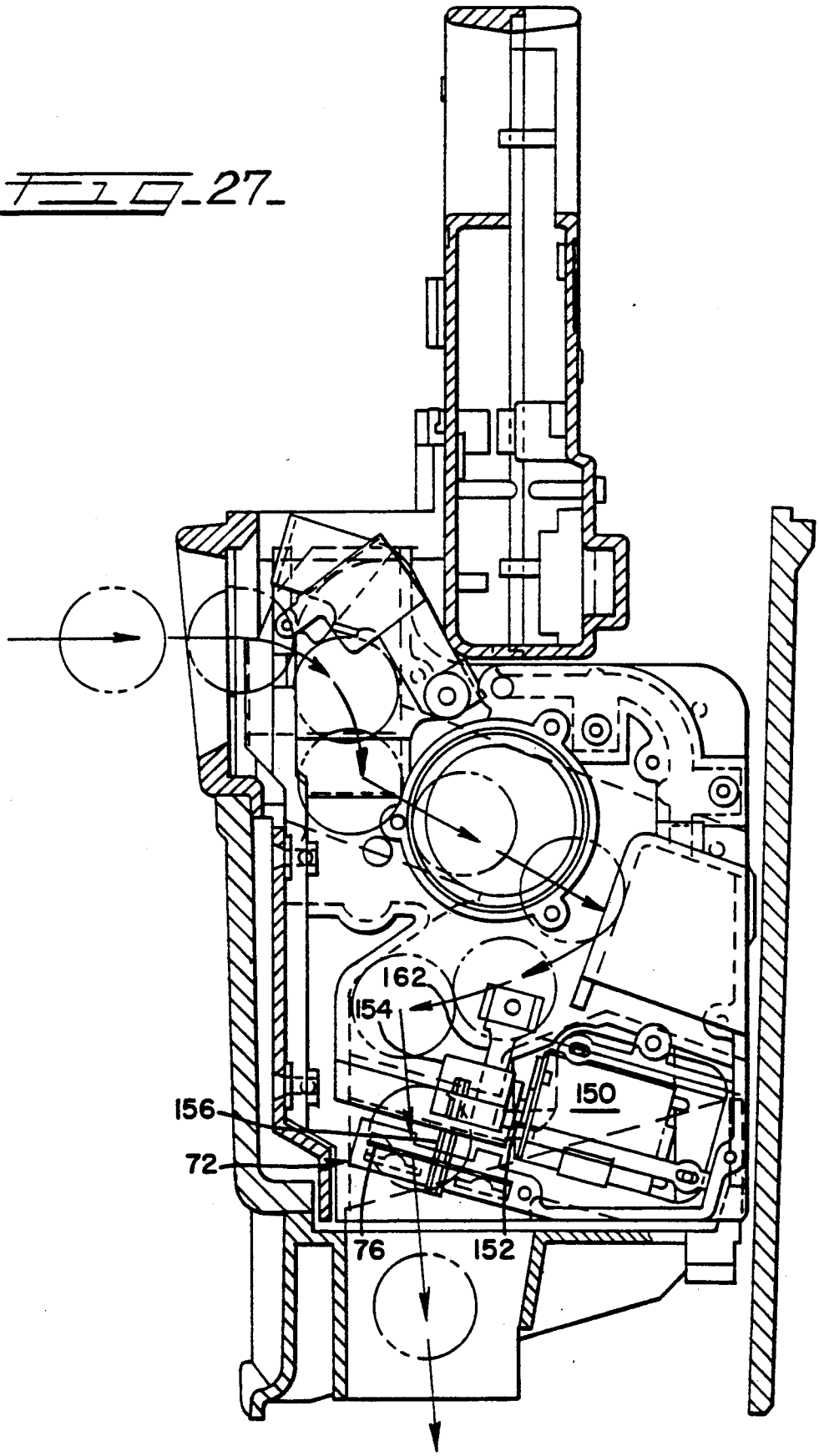
FIG. 27 is the same view as FIG. 5 but labels parts relating to the token gate of the invention.
Figure 28:
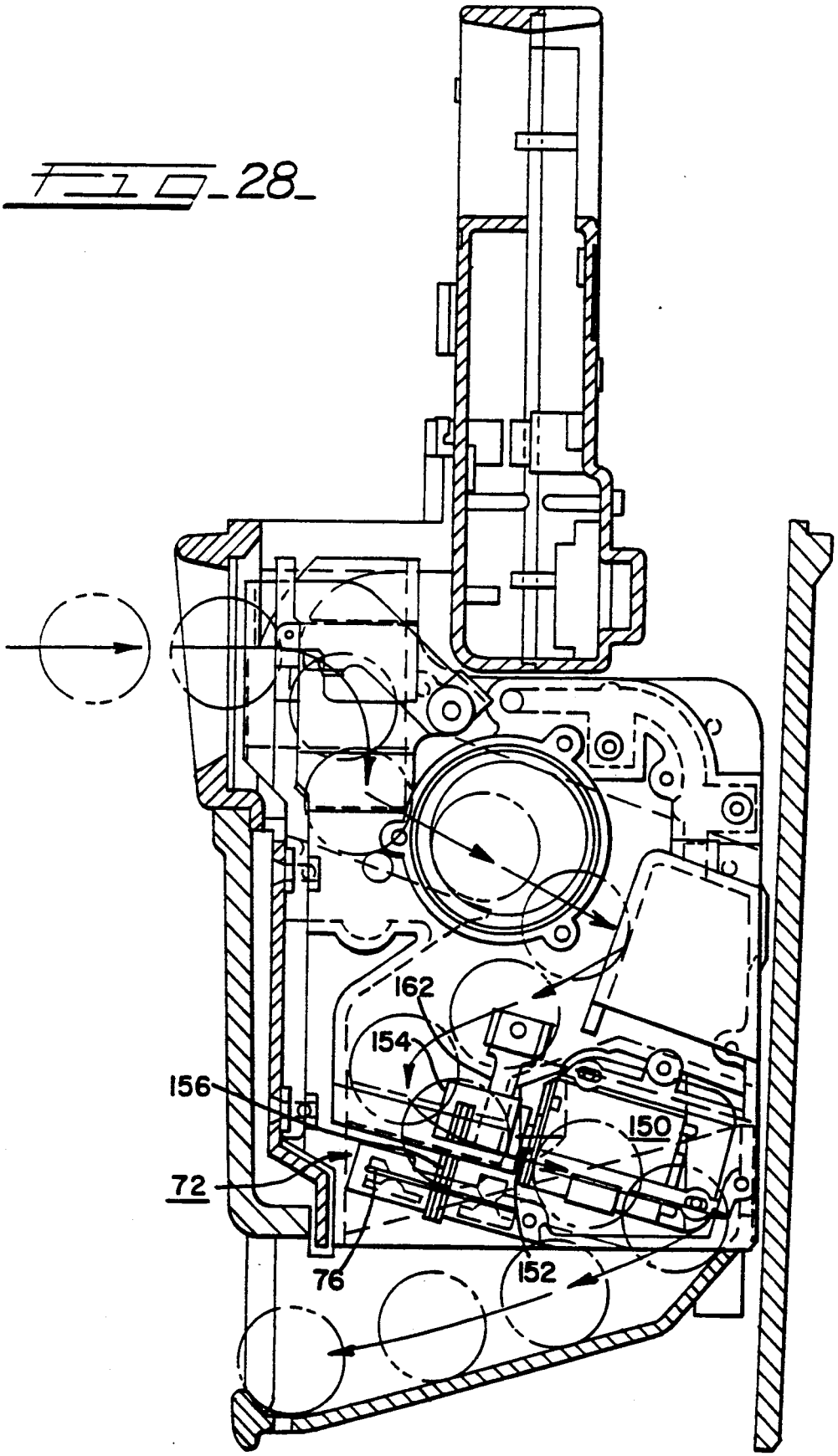
FIG. 28 is the same view as FIG. 6 but labels parts relating to the token gate of the invention.

FIGS. 27 and 28 are the same figures as FIGS. 5 and 6, respectively, but for clarity FIGS. 27 and 28 omit numerous part numbers and lead lines shown in FIGS. 5 and 6 and include numerous part numbers and lead lines, not shown in FIGS. 5 and 6, which concern the components which operate the plate 76.

FIGS. 27 and 28 show the token selection region 66, the token acceptance slot 72 (defining a gate), and the plate 76 (defining a movable barrier). As also shown in FIGS. 27 and 28 a motor 150 is mounted to the token track unit 45. The motor 150 has a shaft 152 to which a prong holder 154 is attached. One end of prong 156 is mounted in the prong holder 154; the other end of the prong holder 156 projects through a prong hole 158 (not visible in FIGS. 5, 6, 27, or 28 due to the view in those figures but shown below in connection with FIGS. 29A and 29B) in the plate 76. Power lines 160 (not shown in FIGS. 27 or 28) for the motor 150 lead to the control unit 230 shown in FIG. 30. A plate spring 162, also mounted in the token track unit 45, presses against the prong holder 156.

The motor 150 may be a DC motor such as the RF-370C-15370 model sold by Mabuchi Motor America Corp., 475 Park Avenue South, New York, N.Y., or another DC motor which draws very little current and operates fast enough to move the plate 76 as necessary for the operation of the invention. The mechanism by which the motor 150 controls the position of the plate 76 is described below in connection with FIGS. 29A and 29B.

FIGS. 29A and 29B depict a cross-sectional view, taken in a plane normal to the plane of the plate 76, of the token selection region 66 including (among other parts) the token acceptance slot 72, the plate 76, and the motor 150. As shown in FIGS. 5, 6, 27 and 28, the plane of the plate 76 is inclined with respect to the vertical so that the upper surface of the plate 76 can form a part of the inclined token return track 80 of the token chute in the token selection region 66. Because the cross-sectional view shown in FIGS. 29A and 29B is in a plane normal to the plane of the plate 76, it will be understood that the cross-sectional views shown in FIGS. 29A and 29B are taken in a plane inclined at an angle from the vertical.

By comparing the side view depicted in FIGS. 5, 6, 27 and 28 with the cross-sectional view depicted in FIGS. 29A and 29B one can see more clearly the relationship among the motor 150, its shaft 152, the prong holder 154, the prong 156, and the prong hole 158 formed in the plate 76, the prong hole 158 being slightly larger in area than the prong 156. The motor 150 is mounted on the token track unit 45 with a motor mounting bracket 164, to which the motor may be secured by mounting screws 166. The direction in which the shaft 152 turns is controlled by the direction of the current in the power lines 160 and 161, which is controlled by the control unit 230 described in greater detail below in connection with FIG. 30.

When the current in the power lines 160 and 161 actuates the motor 150 to turn in one direction, the shaft 152 and the prong holder 154 rotate in that direction, and the prong 156 moves the plate 76 in that direction, which moves the plate 76 into the chute—blocking the path leading from the token acceptance slot region 78 to the token vault section 30—and thus causes a token to roll to the token return slot, as shown in FIGS. 6, 28, and 29A.

When the current in the power lines 160 and 161 actuates the motor 150 to turn in the other direction, the shaft 152 and the prong holder 154 rotate in that direction, and the prong 156 moves the plate 76 in that direction, which withdraws the plate 76 and permits a token 37 or 39 to fall through to the token drop chute portion 78, as depicted in FIGS. 5, 27, and 29B.

When the power lines 160 and 161 to the motor 150 carry no current, the force provided by the contact of the plate spring 162 with the prong holder 154 holds the shaft 152, the prong holder 154, the prong 156, and the plate 76 in the position in which they were placed by the motor 150 when the control unit 230 last directed current through the power lines 160 and 161 leading to the motor 150. The prong holder 154 has two planar recesses 168 and 170 formed in its circumference. One planar recess 168 lies in contact with the plate spring 162 when the prong 156 holds the plate 76 in the extended position, as shown in FIG. 29A. The other planar recess 170 lies in contact with the plate spring 162 when the prong 156 holds the plate 76 in the retracted position, as shown in FIG. 29B.

The interaction of the plate spring 162 with each planar recess 168 and 170 tends to conserve current—an advantage for parking meters and many other token-actuated devices—by holding the prong holder 154 (and thus also the prong 156 and the plate 76) in a location after the motor 150 has moved the prong holder 154 to that location and after the power lines 160 and 161 are no longer carrying current. The motor 150 thus need be supplied with only enough current to cause the shaft 152 to rotate through a sufficient angle to cause the prong 156 to move the plate 76 to either the retracted or the extended position. Once the plate 76 has reached either position, no further current need be supplied to the motor 150 to hold the plate 76 in that position.

The interaction between the plate spring 162 and the planar recesses 168 and 170 also holds the plate 76 in position even when someone tries to tamper with the parking meter 10 by hitting it.

Using the motor 150 to move the plate 76 provides substantial advantages over a solenoid with a spring-loaded return. Because the moving element of a solenoid remains in the magnetic field coil of the solenoid for only a limited time and a limited distance of movement, a solenoid has considerable power disadvantages over the DC motor 150, in which the rotating armature remains under the influence of applied magnetic fields. Thus the motor 150 draws much less current for much less time than a solenoid, and the interaction between the plate spring 162 and the planar recesses 168 and 170 consumes much less energy than powering a solenoid to overcome the resistance of a spring-loaded return. This greatly reduced power demand enables the use of small batteries to power the parking meter 10 and improves the lifetime in the parking meter 10 of the batteries which are used. Moreover, with the interaction of the plate spring 162 and the planar recesses 168 and 170 the position of the plate 76 is (from a mechanical point of view) bistable; that is, the plate 76 will remain in or out of the token acceptance slot even when no current is supplied to the motor 150. This mechanically bistable operation further reduces the current needed in comparison with earlier techniques.

FIGS. 29A and 29B also show more clearly the slanted portion 70 of the token chute wall which is shown in a side view in FIGS. 5, 6, 27, and 28. The token 37 or 39 falls and/or rolls into contact with this slanted portion 70 while the token 37 or 39 is traveling through the token chute 54 after the token has impacted on the mass sensor 64. This slanted portion 70 centers the falling token over the token acceptance slot 72 so that the token will either fall into the token vault or roll toward the token return slot. This centering reduces the possibility that the token 37 or 39 will bounce on impact with the plate 76 and thus tends to assure that the token 37 or 39 will follow a proper path either through the token return track 86 or through the token drop chute portion 78. It is particularly important that a first token 37 or 39 be well past the plate 76 before a second inserted token passes the last token characteristic sensor before the plate 76 so that the path followed by the first token will not be affected if the plate 76 moves to the other position to direct the second token along a different path than the first token.

The Control Unit 230 For The Parking Meter 10

Figure 30:
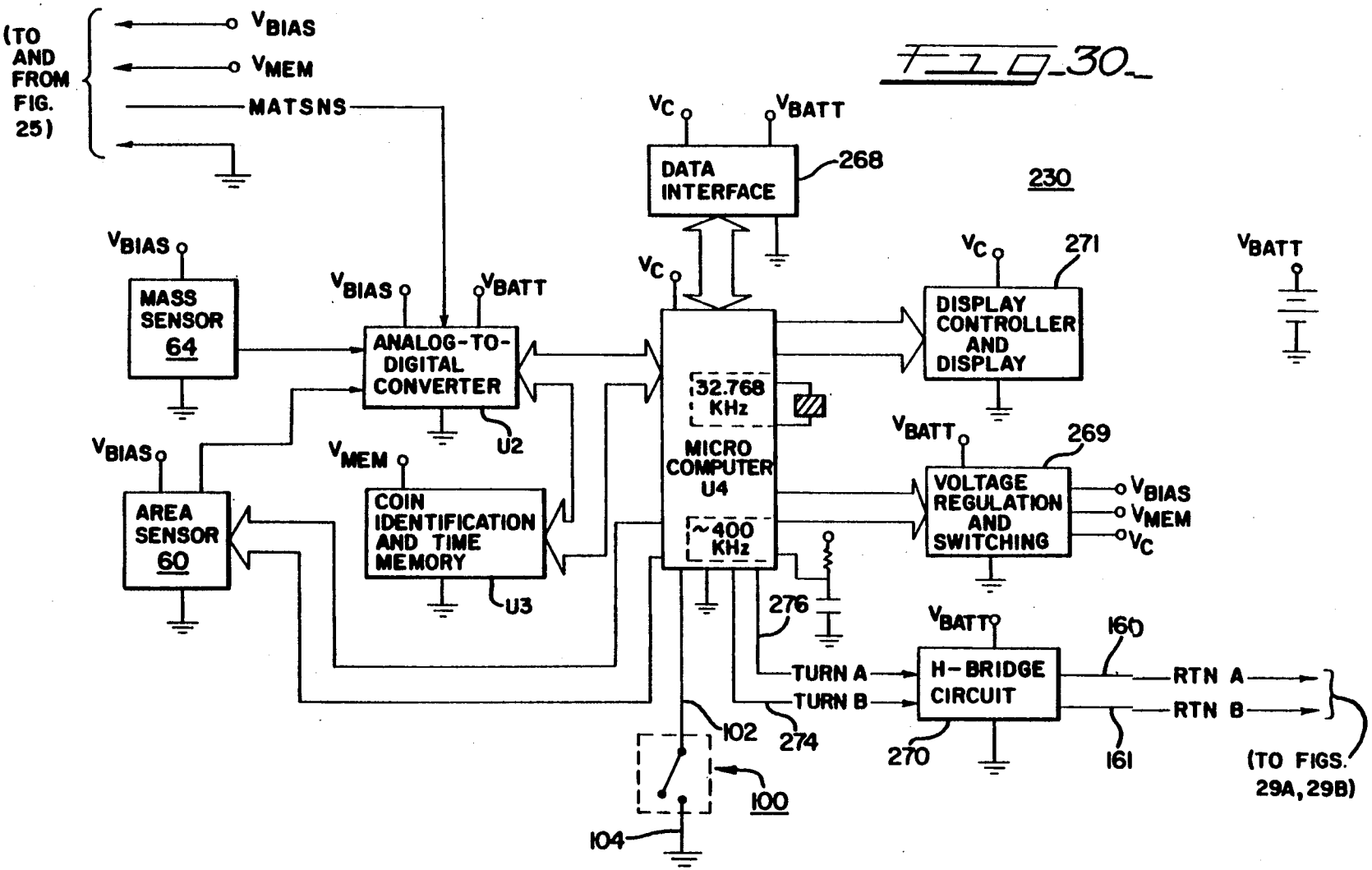
FIG. 30 is a functional block diagram of the electronic circuits which control the operation of the parking meter shown in FIGS. 1, 2, 5 through 9, and 27 through 29.

FIG. 30 is a schematic diagram of the control unit 230 used with the parking meter 10. A microcomputer U4, with its two clocks controlled by an external crystal oscillating at 32.768 kHz and an external R-C circuit setting a clock speed of approximately 400 kHz, operates substantially as disclosed in the Shah, Pester, and Stern patent. The microprocessor U4 exchanges control and data signals with an analog-to-digital converter U2 and with a coin identification and time memory U3. The analog-to-digital converter U2 receives signals from the mass sensor 64 and from the area sensor 60. The analog-to-digital converter U2, the coin identification and time memory U3, the mass sensor 64, and the area sensor 60 are and operate substantially as described in the Shah, Pester, and Stern patent. The microcomputer U4 operates substantially as described in the Shah, Pester, and Stern patent in calculating parking time and in displaying remaining parking time through a display controller and display 271. The microcomputer U4 controls the operation of a voltage regulating and switching circuit 269, which preferably comprises the voltage regulating circuit disclosed in the '781 patent but (in the case of FIG. 30) could comprise an RV4193 regulator as disclosed in the Shah, Pester, and Stern patent. The display controller and display 271 may comprise the LCD driver labelled 36 and U7, and the LCD and flags labelled 38, in the Shah, Pester, and Stern patent or electromechanical flags; the mass sensor 64 comprises the piezo transducer labelled 14 and the amplifier and integrator labelled U1 in the Shah, Pester, and Stern patent; and the area sensor 60 comprises the LED driver and LED labelled 26, the photo sensor labelled 28 and the amplifier labelled U1 and 30 in the Shah, Pester, and Stern patent.

FIG. 30 also shows the connections between the control unit 230 and the magnetic field sensor 58 shown in FIG. 25. Those connections include a connection for $V_{bias}$; the microcomputer U4 activates the magnetic field sensor 58 by instructing the voltage regulation and switching circuit 269 to supply the power voltage $V_{bias}$. Those connections also include a connection for conveying the original MATSNS from the magnetic field sensor 58 (with the circuitry shown in FIG. 25) to the analog-to-digital converter U2, which (in addition to performing the functions of the A/D converter U2 disclosed in the Shah, Pester, and Stern patent) converts the analog signal MATSNS to digital form and supplies the digital form of that signal to the microcomputer U4. Those connections also include a connection for $V_{mem}$. When the microcomputer U4 instructs the voltage regulation and switching circuit 269 to apply power to $V_{mem}$, $V_{mem}$ clears the latched output of, and removes power from, the magnetic field sensor 58 (with the circuitry shown in FIG. 25) in addition to providing power for the coin identification and time memory U3.

FIG. 30 also shows an H-bridge circuit 270, controlled by the microcomputer U4, for driving the motor 150. The H-bridge circuit 270 is shown schematically in FIG. 34 and is described below in connection with that Figure.

FIG. 30 also shows a data interface 268 connected to the microcomputer U4. The data interface 268 may be a wire connector or, preferably, comprises the infrared transmitting and receiving circuits described in the Ultra-Low-Power Amplifier application, which has been incorporated herein by reference.

FIG. 30 also shows the connection to the microcomputer U4 of the wake-up switch 100 actuated by the wake-up switch actuation lever 47 or 94.

The microcomputer U4 must be programmed appropriately to implement the inventions described herein. The microcomputer U4 need not be a National Semiconductor COP324CN microprocessor as disclosed in the Shah, Pester, and Stern patent but can (for example) be another microprocessor such as a National Semiconductor COP344CN microprocessor. Those of ordinary skill in the art are able readily to write for the particular microprocessor selected a program to carry out the steps described herein.

Figure 31A:
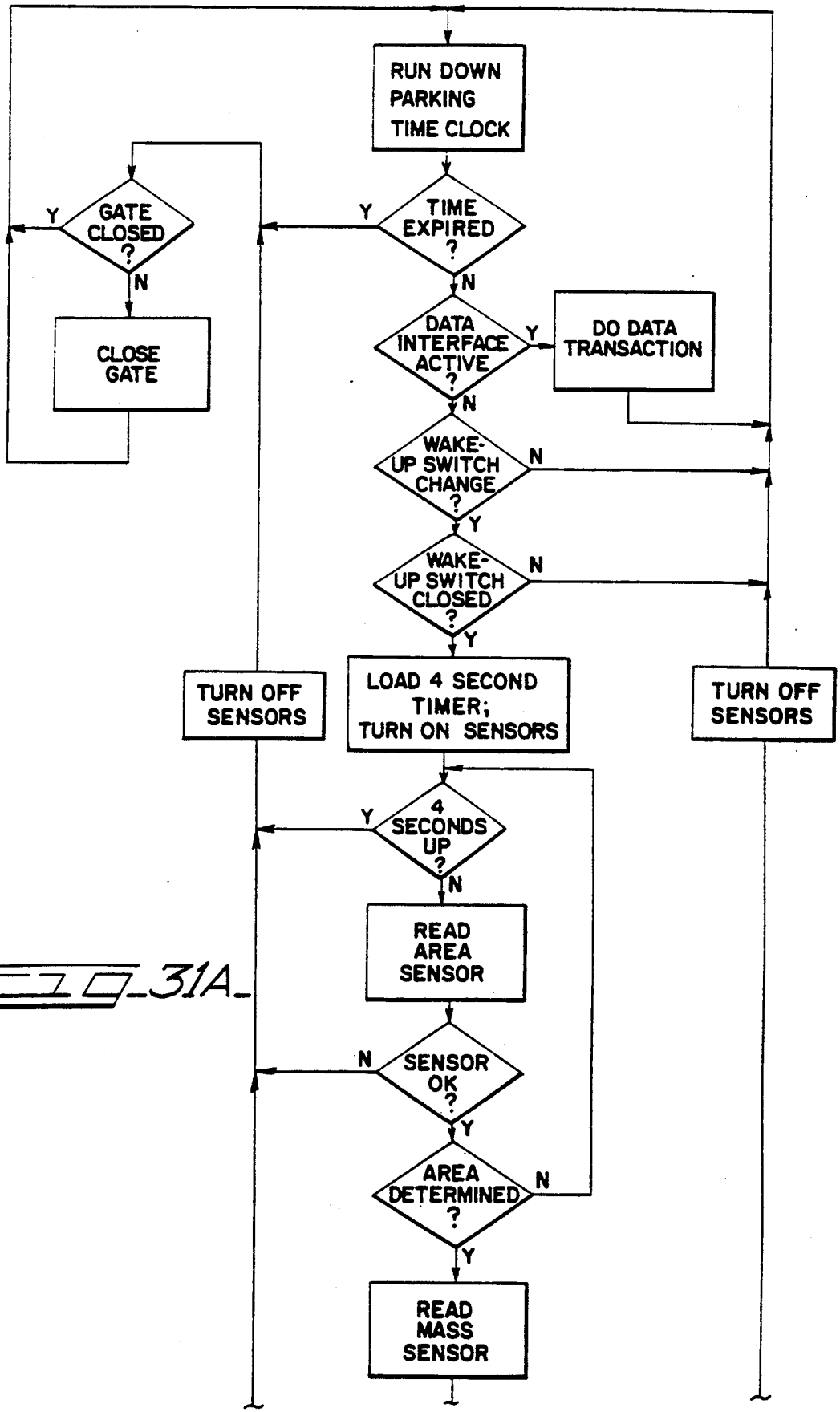
FIGS. 31A and 31B is a flow chart of operations carried out in the electronic circuits schematically shown in FIG. 30.
Figure 31B:
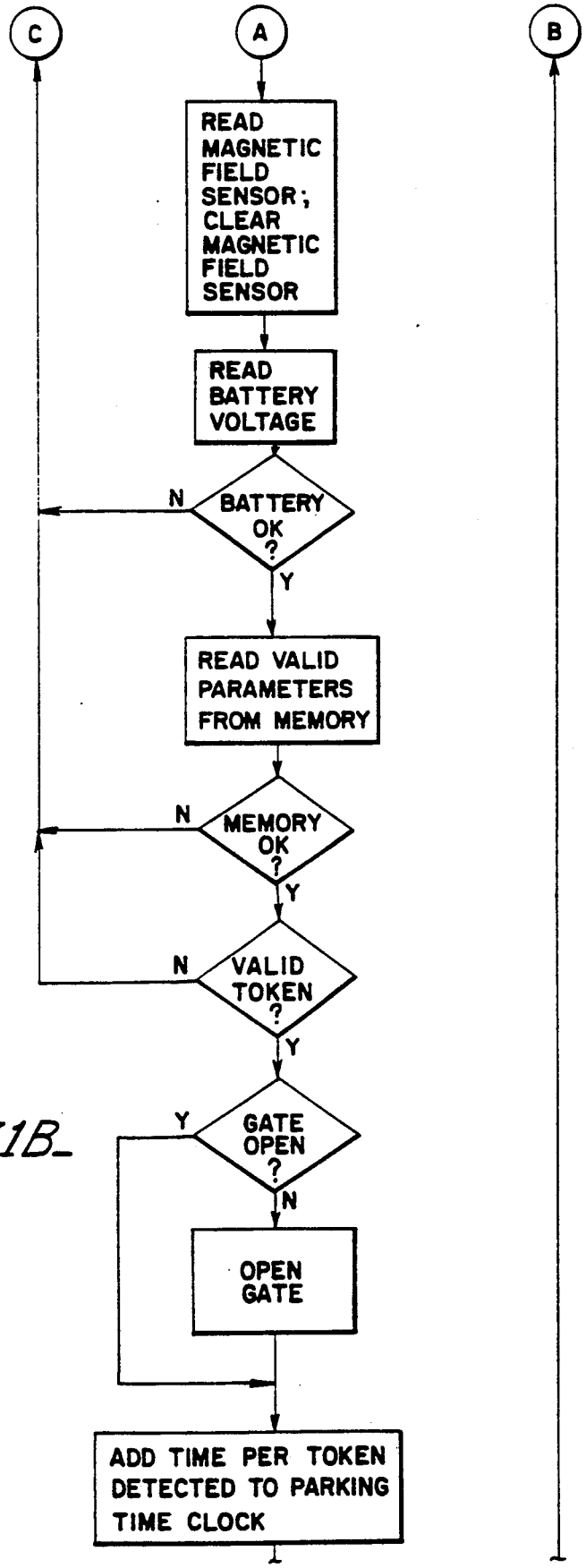

The operation of the parking meter 10 is straightforward and is illustrated by the flow chart which is FIG. 31. As described in the Shah, Pester, and Stern patent, and as shown in FIG. 31, the parking meter 10 initially runs down its parking time clock (if purchased time remains on the meter).

After the parking time clock has run down, the microcomputer U4 checks a memory location (the "token acceptance slot memory location") in which is stored a quantity indicating whether the token acceptance slot 72 is open or closed. If the token acceptance slot 72 is not closed when parking time runs out, the microcomputer U4 asserts a signal to the H-bridge circuit 270 to activate the DC motor 150 to close the token acceptance slot 72. The microcomputer U4 then stores in the token acceptance slot memory location a quantity indicating that the token acceptance slot 72 is closed.

In every case—not just in the specific case just described—in which the microcomputer U4 asserts a signal to the H-bridge circuit 270 to cause the H-bridge circuit to cause the DC motor 150 to move the plate 76, the microcomputer U4 stores in the token acceptance slot memory location a quantity indicating whether the signal the microcomputer U4 asserted to the H-bridge circuit 270 was a signal which would open or close the token acceptance slot 72. The microcomputer U4 uses the value stored in the token acceptance slot memory location as a proxy for directly sensing the position of the plate 76.

The token acceptance slot memory location, by serving as a proxy for the position of the plate 76, permits further conservation of scarce current by (1) dispensing with a need for a sensor to sense directly the open or closed position of the plate 76 and (2) permitting the microcomputer U4 to leave the plate 76 in the position the plate 76 is in if the token travelling through the parking meter 10 should be accepted or returned consistently with the position the plate 76 is in when that token is inserted in the parking meter 10. To further conserve current the microprocessor U4 leaves the plate 76 in the withdrawn position, while the parking meter 10 is measuring parking time, if the parking meter 10 has determined to accept the last inserted token as valid.

Also while running down the parking time clock, the microcomputer U4 checks whether the serial data interface 268 is active; if the serial data interface 268 is active, the microprocessor U4 completes the data transaction by sending and/or receiving data.

If he serial data interface 268 is not active, the microcomputer U4 checks to see whether there has been a change in the wake-up switch 100. Because the token insertion slot lever 47 or 94 normally is in the lowered position, and the wake-up switch 100 is thus normally open, a change in the wake-up switch 100—from an open to a closed position—indicates that the token insertion slot lever 47 or 94 is raised. While the wake-up switch 100 remains closed, the microcomputer U4 loads a four-second timer and turns on the token characteristic sensors and the analog-to-digital converter U2 by instructing the voltage regulation and switching circuit 269 to apply power to the line $V_{bias}$. The purpose of the four-second timer is to set an outer limit on the time during which the microcomputer U4 will check for the characteristics of an inserted token. If the four second interval runs out before an area of an inserted token is determined, the microcomputer U4 turns off the token characteristic sensors, checks whether the token gate is closed, closes the token gate if the token gate is open, and returns to running down the parking time clock and the other actions discussed above. The token characteristic sensors are left off until the wake-up switch 100 opens (that is, the token slot insertion lever 47 or 94 returns to the lowered position) and then closes (that is, the token insertion slot lever 47 or 94 is moved to a raised position) to conserve current during times when no token is being inserted in the parking meter 10.

During the four seconds set by the four-second timer the microcomputer U4 (through the analog-to-digital converter U2) samples the output of the area sensor 60, repeatedly checking that the area sensor 60 is operating properly and checking to see whether the area sensor 60 has determined an area of an inserted token. (One way to check whether the area sensor 60 is operating properly is to check whether the output voltage at the light-sensing end 110 after the area sensor 60 is turned on corresponds to the voltage expected for a properly-operating area sensor 60. Those of ordinary skill in the art can readily design a circuit and write appropriate software to perform such a check or to perform other diagnostic tests of whether the area sensor 60 is working properly.) If the area sensor 60 is working properly, and if the area sensor 60 has determined an area—which typically is an area of an inserted token which has rolled through the area sensing region 59—the microcomputer U4 (through the analog-to-digital converter U2) reads and stores that area and then proceeds (again, through the analog-to-digital converter U2) to read first the output of the mass sensor 64 and then the output of the magnetic field sensor 58. The mass sensor 64 is located after the area sensor 60 along the path which an inserted token follows; thus, the microcomputer U4 reads the output of the mass sensor 64 only if the area sensor 60 has just determined an area. Such a restriction on reading the output of the mass sensor 64 conserves current and limits the possibility that the microcomputer U4 will read and act on signals (which are likely to be incorrect) from the mass sensor 64 produced when there is no preceding indication from the area sensor 60 that a token is rolling toward the mass sensor 64. Although the magnetic field sensor 58 is located before the area sensor 60 along the path which an inserted token follows, the signal from the magnetic field sensor 58 is latched by the circuits shown in FIG. 25 and 26; the latches hold the signal until the microprocessor U4 reads the signal.

After reading the magnetic field sensor 58 the microcomputer checks (through the analog-to-digital converter U2) whether the battery on which the electronic components of the parking meter 10 run is operating properly. (One way to perform such a check is to check whether the voltage $V_{batt.}$ across the battery exceeds a predetermined level below which the electronic components in the parking meter 10 may not operate properly. Those of ordinary skill in the art can readily design circuitry for the analog-to-digital converter U2, and can readily write appropriate software, to perform such a test or to perform other diagnostic tests of whether the battery is operating properly.)

If the battery is operating properly, the microcomputer U4 then instructs the voltage regulation and switching circuit 269 to apply power to $V_{mem}$; with power applied to $V_{mem}$, the coin identification and programming memory U3 is under power, and (as described in connection with FIG. 25) the latch for the magnetic field sensor 58, is cleared and power is removed from the magnetic field sensor 58. The microcomputer U4 then reads from the memory U3 the parameters of valid tokens which have been stored in the memory U3 (which may be a NOVRAM device). The microcomputer U4 then checks whether the memory U3 is operating properly; and if the memory U3 is operating properly, the microcomputer U4 compares the outputs it has read from the area sensor 60, the mass sensor 64, and the magnetic field sensor 58 with the parameters of valid tokens read from the memory U3 to determine whether the received token is valid and, if valid, what the value of the token is. (One way of checking whether the memory U3 is operating properly is to check whether parity bits for the parameters retrieved from the memory U3 indicate that the data retrieved from the memory U3 was correctly received. Those of ordinary skill in the art can readily write appropriate software to perform such a check or design appropriate circuits, and write appropriate software, to perform other diagnostic tests of whether the memory U3 is operating properly.)

If the token is valid, the microcomputer U4 checks the token acceptance slot memory location to see whether the token acceptance slot 72 is open or closed. If the value stored in the token acceptance slot memory location indicates that the token acceptance slot 72 is closed, the microcomputer U4 asserts a signal causing the H-bridge circuit 270 to open the token acceptance slot 72 and (as described above) stores in the token acceptance slot memory location a value indicating that the token acceptance slot 72 is open. If the value stored in the token acceptance slot memory location indicates that the token acceptance slot 72 is open, the microcomputer U4 asserts no signal to the H-bridge circuit 270, which thus leaves the token acceptance slot 72 open. The microcomputer U4 then adds to the parking time clock the amount of time (previously read from the memory U3 along with the parameters of valid tokens) which corresponds to the particular valid token which the microcomputer U4 has determined to accept. The microcomputer U4 then begins again (or continues) to follow the steps indicated in FIG. 31 and described above.

If the token is invalid, the microcomputer U4 checks the token acceptance slot memory location. If the value stored in the token acceptance slot memory location indicates that the token acceptance slot 72 is open, the microcomputer U4 asserts a signal to the H-bridge circuit 270 which causes that circuit to close the token acceptance slot 72; the microcomputer U4 also (as described above) stores in the token acceptance slot memory location a value indicating that the token acceptance slot 72 is closed. If the value stored in the token acceptance slot memory location indicates that the token acceptance slot 72 is closed, the microcomputer U4 asserts no signal to the H-bridge circuit 270, and that circuit directs no current through the DC motor 150. The microcomputer U4 then returns to running down the parking time clock and the other steps indicated at the beginning of FIG. 31.

The inserted token moves by gravity through the token chute 54 while the microcomputer U4 carries out the steps after determining that the wake-up switch has changed position. Between the time the inserted token passes the mass sensor 64 and the time the inserted token reaches the token acceptance slot 72, (a) the microcomputer U4 determines whether or not to recognize the inserted token as valid, (b) if the token acceptance slot 72 is closed and is to be opened, the microcomputer U4 asserts to the H-bridge circuit 270 a signal causing the H-bridge circuit to deliver to the DC motor 150 a pulse of current causing the motor 150 to open the token acceptance slot 72 and (as described above) updates the quantity stored in the token acceptance slot memory location, and the DC motor 150 opens the token acceptance slot 72, and (c) if the token acceptance slot 72 is open and is to be closed, the microcomputer U4 asserts to the H-bridge circuit 270 a signal causing the H-bridge circuit 270 to deliver to the DC motor 150 a pulse of current causing the DC motor 150 to move the plate 76 to bar the token insertion slot 72 and (as described above) updates the quantity stored in the token acceptance slot memory location, and the DC motor 150 closes the token acceptance slot 72.

As shown in FIG. 31, the token characteristic sensor on which the microcomputer U4 relies for control of the token evaluation process is the area sensor 60, which is a more reliable and sensitive indicator that a token has been inserted than are the mass sensor 64 and the magnetic field sensor 58. The mass sensor 64 is the secondary token characteristic sensor because it is somewhat less reliable an indicator of an inserted token than is the area sensor 60 but is a more reliable indicator than the magnetic field sensor 58. The mass sensor 64 typically comprises a piezoelectric crystal and may register incorrect signals caused by bumps to the parking meter 10 or by other mechanical motion. Accordingly, the microcomputer U4 does not proceed further through the evaluation until the area sensor 60 is determined to be working properly and until the area sensor 60 has determined an area of an inserted token. The mass sensor 64 is read after the area sensor 60 has indicated a measured area. This delayed reading isolates the output of the mass sensor 64 so that only in a short interval of time after the area sensor 60 has determined an area is the output of the mass sensor 64 evaluated by the microprocessor U4. Moreover, for some tokens with low mass (such as tokens made of aluminum) the mass sensor 64 may not produce any output signal. While such a possible absence of output for an inserted token makes the mass sensor 64 inappropriate as the primary token characteristic sensor, such an absence of output from the mass sensor 64 after the area sensor 60 has measured a token area can be very important in evaluating an inserted token (by indicating that the token has so little mass that the mass sensor 64 did not produce an output signal).

The magnetic field sensor 58 is the last sensor to be read and is read only if the area sensor 60 has indicated a measured area. The magnetic field sensor 58 may not produce any signal at all as a token rolls past (for example, the magnetic field sensor produces no signal if the token is substantially not magnetically responsive, which is the case with all United States coins), and thus the magnetic field sensor 58 is also inappropriate as the primary token characteristic sensor. By waiting until an area is determined before reading the output of the magnetic field sensor 58, the microcomputer U4 reads the output of the magnetic field sensor 58 only when the output will be in a state (which may be an unchanged state) influenced by the characteristics of a token which has just rolled past. The latch features of the circuits for the magnetic field sensor 58, which are described in connection with FIGS. 25 and 26, hold the output signal for an inserted token until the microcomputer U4 clears the latched signal. Thus, the output from the magnetic field sensor 58 is present on those latches when the microcomputer U4 reads that output some time after the inserted token has rolled past the magnetic field sensor 58. The microcomputer U4 clears the latches of the magnetic field sensor 58 (by causing the voltage regulation and switching circuit 269 to assert $V_{mem}$) only after it has read the output from the magnetic field sensor 58. As shown in FIG. 25, this step also removes power from the magnetic field sensor 58 to conserve current.

Using the microcomputer U4 to control the position of the plate 76 allows several additional functions to be implemented by appropriately programming the microcomputer. The plate 76 may be in the withdrawn position while the parking meter 10 is measuring parking time. As indicated in FIG. 31, the microcomputer U4 is programmed to assert a signal to the H-bridge 270 which causes the H-bridge circuit 270 to close the token acceptance slot 72 (if that slot is then open) by inserting the plate 76 when parking time on the parking meter 10 expires. This fail-safe mode assures that when time on the parking meter 10 expires the plate 76 is put in the position which returns tokens. With this feature, if power is lost or if another failure occurs when the parking meter 10 is not measuring parking time, any inserted tokens will be returned. Of course, if the token acceptance slot is closed when parking time runs out, the microcomputer U4 asserts no signal to the H-bridge circuit 270, and the slot remains closed without expending current in actuating the DC motor 150.

As also indicated in FIG. 31, the microcomputer U4 is also programmed so that, if the parking meter 10 goes into an error mode for such reasons as (for example) low battery power, failure of the area sensor 60, or a token jam in the token chute 54, the plate 76 will move to the closed position if it is not already closed. In these conditions the parking meter 10 will return any inserted tokens (assuming that they are not caught in a token jam) and will not register any parking time in response to an inserted token.

As also indicated in FIG. 31, the microcomputer U4 is programmed to respond to potential attempts to tamper with the parking meter 10. If the wake-up signal is asserted, but no signal indicating the passage of a coin is asserted by the area sensor 60, it is highly likely that someone has lifted the token insertion slot lever 47 or 94 without inserting a token and is attempting to tamper with the parking meter. Accordingly, if, at the end of the four second interval (or some other suitable predetermined time interval) after the wake-up signal is asserted, the microcomputer U4 receives no signals indicating that a token has passed the area sensor 60, the microcomputer U4 asserts a signal to the H-bridge circuit 270 which causes the H-bridge circuit 270 to issue a pulse of current to the motor 150 to place the plate 76 in the position which blocks the token acceptance slot.

As also shown in FIG. 31, the microcomputer U4 turns off the token characteristic sensors (and also removes power from the memory U3) when various logic conditions are satisfied. The microcomputer U4 accomplishes this step by instructing the voltage regulation and switching circuit 269 to remove power from its $V_{bias}$ and $V_{mem}$ outputs. Removing power from the token characteristic sensors and from the memory U3 conserves scarce current by not supplying power to those units when there is no inserted token to be detected and evaluated.

The Control Unit 272 For The Parking Meter 89

Figure 32:
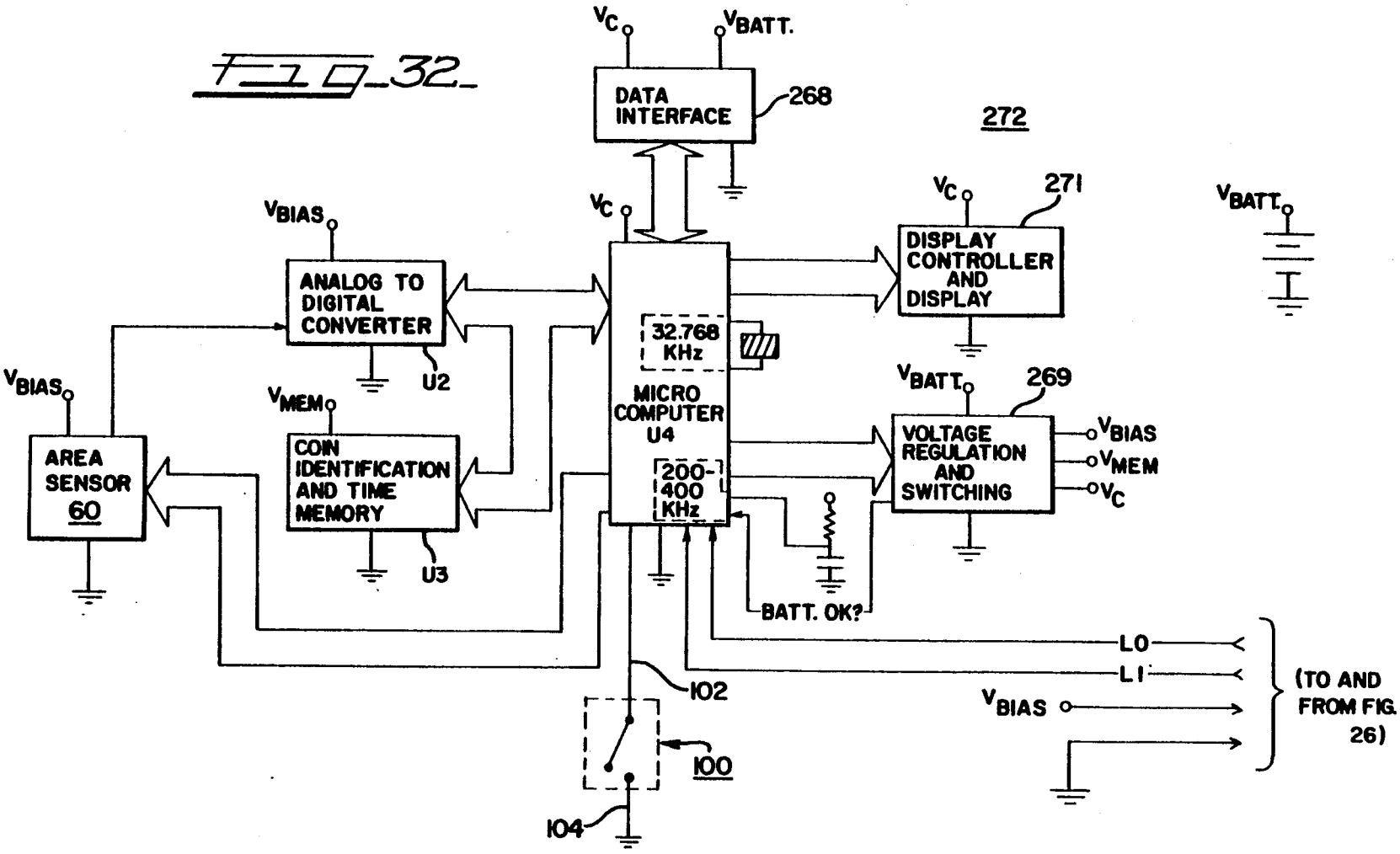
FIG. 32 is a schematic diagram of the electronic circuits which control the operation of the interior mechanism of the alternative parking meter shown in FIGS. 10 through 14.

FIG. 32 is a schematic diagram of the control unit 272 for the parking meter 89. FIG. 32 differs FIG. 30 in that FIG. 32 does not show components relating to the mass sensor 64 or to the H-bridge circuit 270 because the parking meter 89 does not incorporate the mass sensor 64, the token selection region 66, or the token acceptance slot region 72. FIG. 32 also differs from FIG. 30 in that the microcomputer U4 receives the signals L0 and L1 directly from the circuit shown in FIG. 26 rather than receive through the analog-to-digital converter U2 a digital signal indicative of the output of the magnetic field sensor 58. As in FIG. 30, the data interface 268 preferably comprises the infrared transmitting and receiving circuits disclosed in the Ultra-Low-Power Amplifier application, and the voltage regulator 269 is preferably the voltage regulator disclosed in the '781 application.

With appropriate modifications (which those of ordinary skill in the art can readily accomplish) to reflect these differences, the microcomputer U4 in the control unit 272 operates in substantially the same manner as the microcomputer U4 in the control unit 230. The operation of the control unit 272 is summarized in the flow chart which is FIG. 33.

Figure 33:
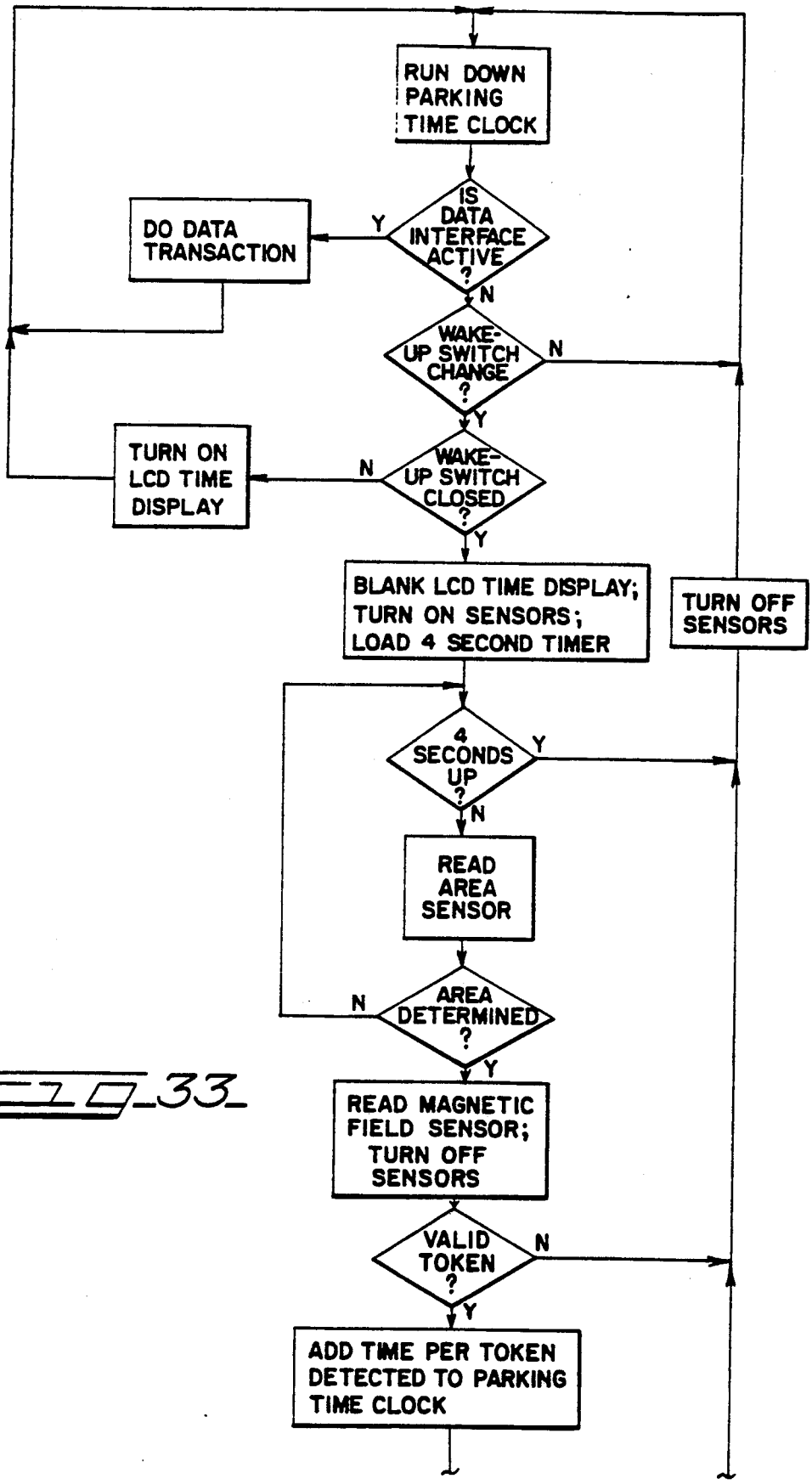
FIG. 33 is a flow chart of operations carried out in the electronic circuits schematically shown in FIG. 32.

The principal differences between FIG. 33 and FIG. 31 reflect the absence from the alternate parking meter 89 of the mass sensor 64 and of the token return slot 72. As with FIG. 31, the alternate parking meter 89 begins by running down its parking time clock. If the serial data interface 268 is active, the microcomputer U4 processes the data transaction.

The wake-up switch normally indicates that the token insertion slot lever 94 is in a lowered position. If the microcomputer U4 detects no change in the wake-up switch 100, the microcomputer U4 turns on the liquid crystal time display and continues to count down the parking time clock so long as the data interface 268 is not active and so long as the wake-up switch 100 does not change.

If the wake-up switch 100 changes, the microcomputer U4 takes three actions: (1) it loads a four second timer as discussed above in connection with FIG. 31; (2) it blanks the LCD time display; and (3) it turns on the token characteristic sensors by instructing the voltage regulation and switching circuit 269 to apply power to $V_{bias}$. The second of these actions provides an indication, visible from the outside of the parking meter, that the wake-up switch 100 has changed. If the area sensor 60 does not produce an area signal within four seconds after the wake-up switch has changed position, it is likely that the change in the wake-up switch indicates an attempt at manipulating the alternate parking meter 89; the microcomputer U4 returns to running down the time clock when the four seconds have run in the absence of an area signal from the area sensor 60. As indicated above in connection with FIG. 26, turning on the magnetic field sensor 58 by applying the high potential $V_{bias}$ clears the signals L0 and L1 and resets the magnetic field sensor circuit shown in FIG. 26 to a condition for responding to the magnetic characteristics of an inserted token.

During the four second interval on the timer the microcomputer U4 (through the analog-to-digital converter U2) samples the output of the area sensor 60. If a token has been inserted in the parking meter 89, the token rolls past the area sensor 60, which, as described in the Shah, Pester, and Stern patent, produces a signal which feeds to the analog-to-digital converter U2 and (in digital form) to the microcomputer U4. If the area sensor 60 has not determined the area of the inserted token, the microcomputer U4 (through the analog-to-digital converter U2) continues sampling the area sensor 60 (within the four seconds allotted by the timer) until the token area is determined. The microcomputer U4 then reads directly the latched output of the magnetic field sensor 58 and turns off the sensors by instructing the voltage regulation and switching circuit 269 to remove power from $V_{bias}$. The microcomputer U4 then applies power to the memory U3 by instructing the voltage regulation and switching circuit 269 to apply power to $V_{mem}$; the microprocessor U4 then reads token parameters and time values from the memory U3. If the memory U3 is operating properly, the microcomputer U4 then compares the output of the area sensor 60 and the output of the magnetic field sensor 58 with parameters of valid tokens. If the comparison indicates that the token is not valid, the microcomputer U4 grants no parking time for that token and returns to running down the parking time clock and the other steps indicated at the beginning of the flow chart which is FIG. 33. If the comparison indicates that the token is valid, the microcomputer U4 adds the time corresponding to the type of token which was detected to the parking time clock and turns off the memory U3 by directing the voltage regulation and switching circuit 269 to remove power from $V_{mem}$. The microcomputer U4 then returns to running down the parking time clock and the other steps indicated at the beginning of the flow chart which is FIG. 33.

The circuits shown in FIGS. 25 and 26 each include a latch which holds the output signal (the signal MATSNS in FIG. 25, and the signal formed by the levels of L0 and L1 in FIG. 26) until the output signal is cleared by the microprocessor 20. This latch feature allows the microprocessor 20 to wait to read the output of the magnetic field sensor until after the token has passed the area sensor 64. By permitting this postponed reading, the latch feature saves processing resources by allowing the microprocessor 20 to read the output of the magnetic field sensor only once rather than having to sample that output at numerous different times.

The H-Bridge Circuit 270

An H-bridge circuit is particularly useful in controlling the application of current to the motor 150 because an H-bridge permits fast and precise control of a pulse of current. Such control conserves current by delivering only substantially the amount of current required to cause the motor 150 to change the position of the plate 76.

Figure 34:
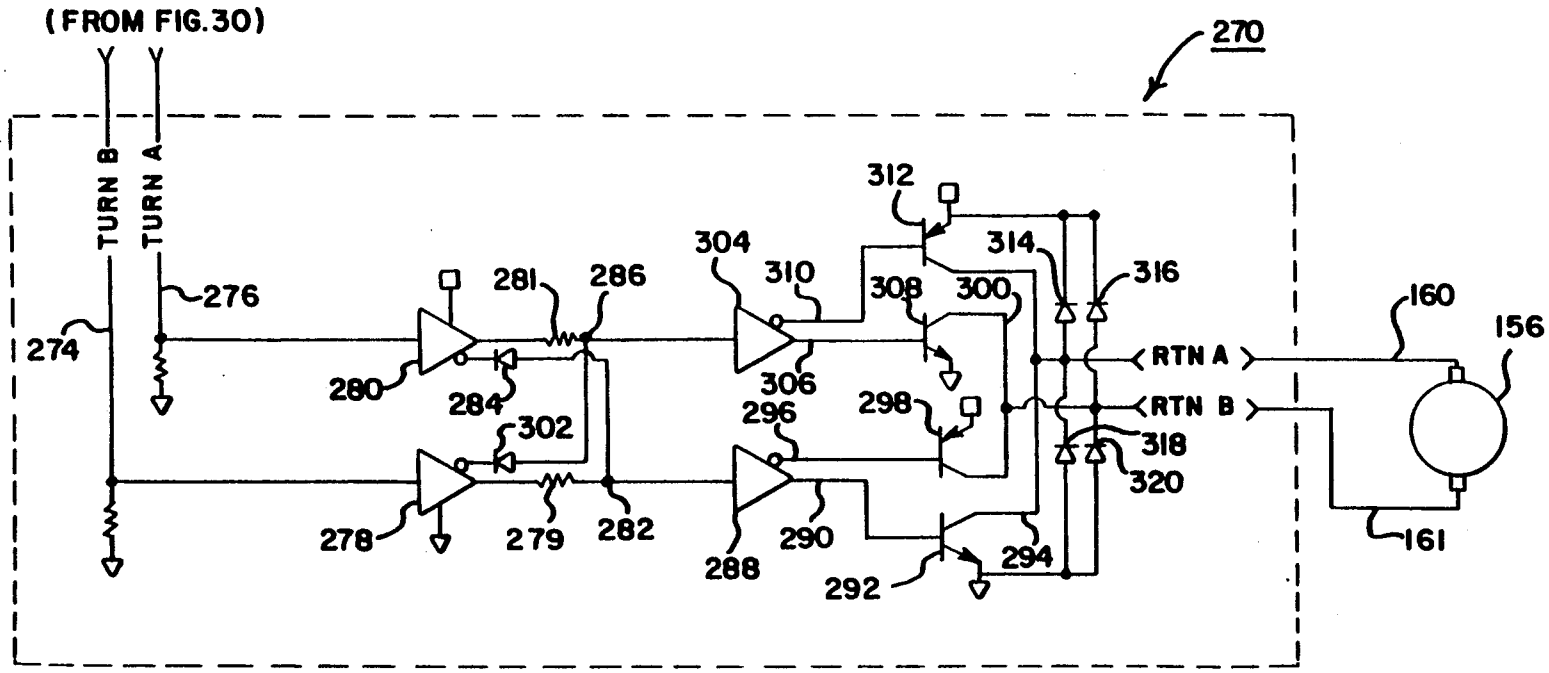
FIG. 34 is a schematic diagram of the H-bridge circuit shown (in block diagram form) in FIG. 30.

FIG. 34 is a schematic diagram of the H-bridge circuit 270 shown (in block diagram form) in FIG. 30. Two signal lines 274 and 276 lead from the microcomputer U4 shown in FIG. 30 to the H-bridge circuit 270. The H-bridge circuit 270 employs four differential drivers. The non-inverting output of each differential driver follows the input to the differential driver; the inverting output of each differential driver follows the inverse of the input to the differential driver.

When the microcomputer U4 asserts line 276 high, the signal TURN A travels over that line to a differential driver 280; the microcomputer U4 simultaneously holds line 274 low. When the microcomputer U4 asserts line 274 high, the signal TURN B travels over that line to a differential driver 278; the microcomputer U4 simultaneously holds line 276 low.

When TURN A is high, the output of differential driver 280 to line 286 is high. Because the microcomputer U4 holds the level in line 274 low while TURN A is high, the differential driver 278 asserts no signal on its output line 282. Because the level at the inverting output of the differential driver 278 is high when the level on line 274 is low, and because the level on line 286 is slightly below the level at the inverting output of the differential driver 278 because of the ohmic voltage drop across a resistor 281 between the non-inverting output of the differential driver 280 and line 286, the diode 302 prevents the inverting output of the differential driver 278 from affecting the potential on line 286. The operation of the H-bridge circuit 270 is thus controlled solely by the differential driver 280.

The high signal on line 286 also leads to a differential driver 304: in response to the high signal on its input line 286, the differential driver 304 asserts a high signal on its output line 306. This high signal causes the NPN transistor 308 to conduct and thus connects line 300 to ground. The high input on line 286 also causes the differential driver 304 to assert a low signal on line 310. This low signal on line 310 causes PNP transistor 312 to conduct, connecting line 294 to the positive potential.

In response to these connections current flows from line 294 (as the signal RTN A) to the line 160 of the motor 150 and from the line 161 of the motor 150 through the line 300 to ground. This current causes the motor 150 to turn in a direction which may, for example, be the direction which moves the plate 76 to open the token acceptance slot.

When the microcomputer U4 asserts the signal TURN A on line 276 low, the levels on lines 286 and 306 go low and the level on line 310 goes high. This causes transistors 308 and 312 to become non-conducting and thus cuts off the flow of current through the motor 150. By programming the microcomputer U4 to assert the signal TURN A for only the length of time necessary to move the plate 76, unnecessary current drain in operating the motor 150 is avoided.

A similar sequence of events occurs when the microcomputer U4 asserts the signal TURN B high on the line 274.

When TURN B is high, the output of differential driver 278 to line 282 is high. Because the microcomputer U4 holds the level on line 276 low while TURN B is high, the differential driver 280 asserts no signal on its output line 286. Because the level at the inverting output of the differential driver 280 is high when the level on line 276 is low, and because the level on line 282 is lower than the level at the inverting output of the differential driver 280 because of the ohmic voltage drop across a resistor 279 between the non-inverting output of the differential driver 278 and line 282, the diode 284 prevents the inverting output of the diferential driver 280 from affecting the potential on line 282. The operation of the H-bridge circuit 270 is thus controlled solely by the differential driver 278.

The high signal on line 282 also leads to a differential driver 288; in response to the high signal on its input line 282, the differential driver 288 asserts a high signal on its output line 290. This high signal causes NPN transistor 292 to conduct and thus connects line 294 to ground. The high input on line 282 also causes the differential driver 288 to assert line 296 low. This low signal on line 296 causes PNP transistor 298 to conduct, connecting line 300 to the positive potential.

In response to these connections current flows from line 300 (as the signal RTN B) to the line 161 of motor 150 and from the line 160 of motor 150 through the line 294 to ground. This current causes the motor to turn in a direction which may, for example, be the direction which moves the plate 76 to close the token acceptance slot.

When the microcomputer U4 asserts the signal TURN B on line 274 low, the levels on lines 282 and 290 go low and the level on line 296 goes high. This causes transistors 292 and 298 to become non-conducting and thus cuts off the flow of current through the motor 150. By programming the microcomputer U4 to assert the signal TURN B high for only the length of time necessary to move the plate 76, unnecessary current drain in operating the motor 150 is avoided.

The diodes 284 and 302 protect the H-bridge circuit 270 against a malfunction which would otherwise occur if, through component malfunction or through a programming error, TURN A and TURN B were both asserted high at the same time. If TURN A is high, the non-inverting output of differential driver 280 is also high. If TURN B is asserted high while TURN A is high, the inverting output of differential driver 278 goes low, diode 302 conducts, and the level on line 286 goes low. This drives the input to differential driver 304 low and thus makes transistors 308 and 312 nonconducting. Likewise, because the inverting output of differential driver 280 is low when TURN A is high, when TURN B is simultaneously high the diode 284 conducts, holding the potential on line 282 low and thereby keeping transistors 292 and 298 non-conducting. The result of these events is that the previous flow of current through the DC motor 150 in response to the assertion of TURN A stops, and no current flows through the DC motor 150. As can be seen from FIG. 34 in view of the foregoing explanation, the diodes 284 and 302 play a similar protective role (a) when TURN B is high and then TURN A goes from low to high and (b) when TURN A and TURN B go high simultaneously. In each case the H-bridge circuit 270 returns to normal operation when the signals TURN A and TURN B are no longer simultaneously asserted.

The diodes 314, 316, 318, and 320 protect the control unit 230 and the differential drivers 278, 280, 288, and 304 against voltage spikes which could otherwise occur if the flow of current through the motor 150 were cut off (such as by the return of a signal TURN A or TURN B to the low state, or by the protective action of the diodes 284 and 302) while the motor 150 was still turning. The diodes 314, 316, 318, and 320 do not conduct when the transistors 308 and 312 (or alternatively the transistors 292 and 294) are conducting—the condition which corresponds to power being supplied from the H-bridge circuit 270 to the motor 150.

If the motor 150 is still turning when the transistors 308 and 312 (and/or the transistors 292 and 294) become non-conducting, the motor 150 will supply power to the H-bridge circuit 270 drawn from the energy of rotation of the rotating armature of the motor 150, the rotating shaft 152, the rotating prong holder 154, and the rotating prong 156, and from the translational kinetic energy of the plate 76. In such an eventuality the diodes 314 and 320 (or alternatively the diodes 316 and 318) will conduct. In each alternative the one of the power lines 160 and 161 which the rotating armature drives to a higher potential leads through a diode to the high potential, and the other of the power lines 160 and 161 which the rotating armature drives to a lower potential leads through a diode to ground.

Such connections greatly reduce the possibility that if the transistors 308 and 312 (or alternatively, the transistors 292 and 294) did not become non-conducting at precisely the same time (while the shaft 152 was turning) an extremely large voltage spike might be delivered to the positive potential or to local ground through the H-bridge circuit 270 or could affect the differential drivers. Such extreme voltage spikes would impair the proper operation of the control unit 230.

The diodes 314, 316, 318 and 320 also provide protection to the power supply and to the H-bridge circuit from consequences of any unwanted inductive arcing in the DC motor 150.

Moreover, with the diodes 314, 316, 318, and 320, the microcomputer U4 can be programmed to assert TURN A or TURN B high for only so long a time as necessary to give the plate 76 and parts connected to it enough momentum to change position. Thus, current may be cut off from the motor 150 even before the plate 76 has finished moving to its new position, and the momentum of the plate 76 and the parts connected to it will carry the plate 76 to its new position. This programming option, if used, can further reduce the current needed to operate the plate 76. This option is preferably not used if foreign objects such s dirt or lint could come in contact with the plate 76 and affect the amount of current needed to cause the plate 76 to move from one position to the other.

CONCLUSION

Those skilled in the art will appreciate that the embodiments described herein may be modified without departing from the invention and that, in particular, the improved vertical portion 55 of the token chute 54 or of the token chute 112, the improved magnetic field sensor 58, and the token acceptance and rejection system with the movable plate 76 may be implemented in many different combinations and with many other components of token-actuated devices.

Those skilled in the art will also appreciate that the improvements described herein are not limited to parking meters or newspaper vending racks but can be implemented in virtually any type of token-actuated device or even in any type of device which must evaluate tokens or sort tokens into groups of tokens which do and which do not share common characteristics.

Likewise, those skilled in the art will understand that components and component values are illustrated and that other components and component values may be used.

Thus, although particular alternative embodiments are described above, those embodiments are only examples of the invention. Numerous changes in the embodiments described above may be made without departing from the spirit and scope of the invention, which is defined by the following claims.

We claim:

1. A token receiving chute for use as part of a token operated device in order to convey a token by gravity to an appropriate location, comprising a front wall, a back wall, a first side wall, and a second side wall which together define a token receiving chute;

wherein the front wall has a token insertion slot whereby a token may be inserted therethrough into the token receiving chute;

wherein the token receiving chute comprises an upper portion proximal to the token insertion slot and a lower portion extending downward therefrom;

wherein the four walls defining the upper portion of the token receiving chute are vertically oriented so that a token inserted therein falls straight downward;

wherein the second side wall of the lower portion of the token receiving chute has an upper inclined section which slopes toward the first side wall and a vertically oriented lower section; and, wherein the token receiving chute operates so that a token inserted therein moves downward through the upper portion of the chute until the token contacts the inclined section of the second side wall which then causes the token to move laterally toward the first side wall, the lateral momentum thus imparted to the token causing the token to bounce back and forth between the first and second side walls of the lower portion of the chute to thereby dissipate kinetic energy.

2. The token receiving chute as set forth in claim 1 wherein the second side wall of the lower portion of the token receiving chute is recessed so as to increase the distance between the first and second side walls.

3. The token receiving chute as set forth in claim 1 wherein the lower portion of the chute connects to an inclined token track base, the two side walls and base thereby defining a groove by which the token may roll to an appropriate location within the token operated device.

4. The token receiving chute as set forth in claim 1 wherein the token insertion slot is vertically oriented.

5. The token receiving chute as set forth in claim 3 wherein the token insertion slot is nearer the second side wall than the first side wall.

6. The token receiving chute as set forth in claim 1 wherein the inclined section of the second side wall is inclined at an angle approximately 60 degrees to the horizontal.

7. The token-receiving apparatus of claim 1, further comprising a arm having a first end and a second end, said first end being pivotally mounted adjacent to said chute, said second end equipped with a flange, said arm having a first position in which said flange partially bars said token insertion slot to a first extent and a second position in which said flange partially bars said token insertion slot to a second extent, said arm pivoting from said first position to said second position, said flange formed so as to impel said token into said token chute after said token is inserted more than substantially half way in said token insertion slot.

* * * * *